US007105282B2

(12) United States Patent
Yamane et al.

(10) Patent No.: US 7,105,282 B2
(45) Date of Patent: Sep. 12, 2006

(54) IMAGE FORMING METHOD USING PHOTOTHERMOGRAPHIC MATERIAL

(75) Inventors: Katsutoshi Yamane, Kanagawa (JP); Sumito Yamada, Kanagawa (JP); Eiichi Okutsu, Kanagawa (JP); Tomoyuki Ohzeki, Kanagawa (JP); Yutaka Oka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 69 days.

(21) Appl. No.: 10/644,789

(22) Filed: Aug. 21, 2003

(65) Prior Publication Data

US 2004/0058281 A1 Mar. 25, 2004

(30) Foreign Application Priority Data

| | | |
|---|---|---|
| Aug. 26, 2002 | (JP) | 2002-244770 |
| Aug. 27, 2002 | (JP) | 2002-247121 |
| Sep. 5, 2002 | (JP) | 2002-259719 |
| Sep. 26, 2002 | (JP) | 2002-281390 |

(51) Int. Cl.
*G03C 5/16* (2006.01)

(52) U.S. Cl. ..... 430/350; 430/523; 430/531; 430/536; 430/619; 396/575

(58) Field of Classification Search ..... 430/350, 430/619, 531, 523, 536; 396/575
See application file for complete search history.

(56) References Cited

U.S. PATENT DOCUMENTS

| | | | | |
|---|---|---|---|---|
| 6,171,767 | B1 * | 1/2001 | Kong et al. | 430/350 |
| 6,288,370 | B1 * | 9/2001 | Ogawa et al. | 219/469 |
| 6,420,102 | B1 * | 7/2002 | Bauer et al. | 430/350 |
| 6,468,720 | B1 * | 10/2002 | Hirabayashi et al. | 430/350 |
| 6,524,781 | B1 * | 2/2003 | Wada | 430/523 |
| 6,649,338 | B1 * | 11/2003 | Mitsuhashi | 430/619 |
| 6,814,506 | B1 * | 11/2004 | Nanami | 396/569 |

* cited by examiner

*Primary Examiner*—Thorl Chea
(74) *Attorney, Agent, or Firm*—Margaret A. Burke; Sheldon J. Moss

(57) ABSTRACT

An image forming method using a photothermographic material a photosensitive silver halide, a reducing agent, a binder and a non-photosensitive organic silver salt, wherein:

the photothermographic material is discharged from a thermal developing device within 35 seconds after heating for thermal development is ceased.

18 Claims, 3 Drawing Sheets

IMAGE FORMING METHOD USING PHOTOTHERMOGRAPHIC MATERIAL

CROSS-REFERENCE TO RELATED APPLICATIONS

This application claims priority under 35USC 119 from Japanese Patent Application Nos.2002-244770, 2002-247121, 2002-259719, and 2002-281390, the disclosures of which are incorporated by references herein.

BACKGROUND OF THE INVENTION

1. Field of the Invention

The present invention relates to a method of forming an image using a photothermographic material. More particularly, the present invention relates to a method of forming an image using a photothermographic material that provides constant output images even in a thermal developing apparatus with high line speed at the time of thermal development.

2. Description of the Related Art

Recently, in the field of films for medical imaging and the field of films for graphic arts, there is a strong demand for reducing the volume of waste processing liquid from the viewpoint of environmental preservation and economy of space. There have been demands for technologies relating to use of a photothermographic material as a film for medical imaging and a film for graphic arts. In particular, there is a demand for a photothermographic material that is efficiently exposed by a laser image setter or a laser imager, and provides black-toned images with high resolution and sharpness. Such a photothermographic material can provide users with a more simple and ecological thermal developing system without the use of liquid processing chemicals.

Although there are similar demands in the field of general image forming materials, high image quality (i.e., excellent sharpness and fine graininess) is particularly required for images used in medical imaging where high image quality of excellent sharpness and granularity are necessary. Further, images with blue-black tones are preferred from the perspective of facilitating diagnosis. Various types of hard copy systems using pigment or dye, such as an inkjet printer and an electrophotograph system, are commonly used as a general image forming system. But none of these is satisfactory as an output system for medical images.

In general, thermal image forming systems using organic silver salts are described on page 279 to 291, Chapter 9, "Thermally Processed Silver Systems," (Imaging Processes and Materials) Neblette, 8th edition, edited by D. Klosterboer, compiled by J. Sturge, V. Walworth and A. Shepp (1989), the disclosure of which is incorporated herein by reference.

A photothermographic material typically includes a photosensitive layer in which a photocatalyst (e.g., silver halide) of a catalytically active amount, a reducing agent, reducible silver salt (e.g., organic silver salt) and a toner for controlling the tone of a developed silver image as needed are dispersed in the matrix of a binder.

After an image is exposed thereon, a photothermographic material is heated to a high temperature (e.g., 80° C. or above) to cause an oxidation-reduction reaction between reducible silver salt (which acts as an oxidizing agent) and a reducing agent, thus providing a black silver image. The oxidation-reduction reaction is accelerated by the catalytic action of a latent image of the exposed silver halide (see U.S. Pat. (USP) No. 2,910,377 and Japanese Patent Application Publication (JP-B) No. 43-4924).

In view of the expanding fields of application and higher processing volume, it is necessary to record and develop images further rapidly. There has always been demand for improving processing capacity of the thermal developing process and thereby reducing processing time for the above-described photothermographic materials.

There has also been demand for improving adaptability of an image recording apparatus to the place where it is installed and to its environs. Thus the total size of the apparatus including an optical system for laser exposure and a thermal developing section needs to be reduced.

Another important problem in improving the developing process is to develop a photothermographic material adapted to high speed processing.

The problems facing thermal processing of photothermographic materals cannot be adequately addressed by handling the problems regarding the exposing and developing devices and the problems regarding the photothermographic material separately, as has often been the case in the past. Thus it is very difficult to achieve rapid developing process, to reduce the size of the image recording apparatus and to form constant images at the same time in the processing of photothermographic materals.

SUMMARY OF THE INVENTION

The present invention intends to solve the above problems in the prior art by providing image forming methods for photothermographic materials with stable output images and rapid development time using a reduced sized image recording apparatus.

1) A first aspect of the present invention is to provide an image forming method using a photothermographic material comprising, on at least one side of a support, at least a photosensitive silver halide, a non-photosensitive organic silver salt, a reducing agent and a binder, wherein: the photothermographic material has a gamma value of 2.0 to 4.0 at an optical density of 1.2 in a photographic characteristic curve; and the photothermographic material is developed in a thermal developing device configured such that a distance between an exposing section and a developing section is not more than 50 cm.

2) A second aspect of the present invention is to provide an image forming method using a photothermographic material comprising an image forming layer formed on at least one side of a support, the image forming layer comprising at least a photosensitive silver halide, a non-photosensitive organic silver salt, a reducing agent and a binder, wherein: the non-photosensitive organic silver salt includes a silver salt of fatty acid; the photothermographic material has a silver salt of fatty acid at an application amount of 5 $mmol/m^2$ to 18 $mmol/m^2$; and the photothermographic material is developed in a thermal developing device configured such that a distance between an exposing section and a developing section is not more than 50 cm.

3) A third aspect of the invention is to provide an image forming method using a photothermographic material comprising, on at least one side of a support, at least a photosensitive silver halide a non-photosensitive organic silver salt, a reducing agent and a binder, wherein: the photothermographic material is discharged from a thermal development device within 35 seconds after heating for thermal development is ceased.

DETAILED DESCRIPTION OF THE INVENTION

1. Photographic Characteristic Curve

Figure 1:
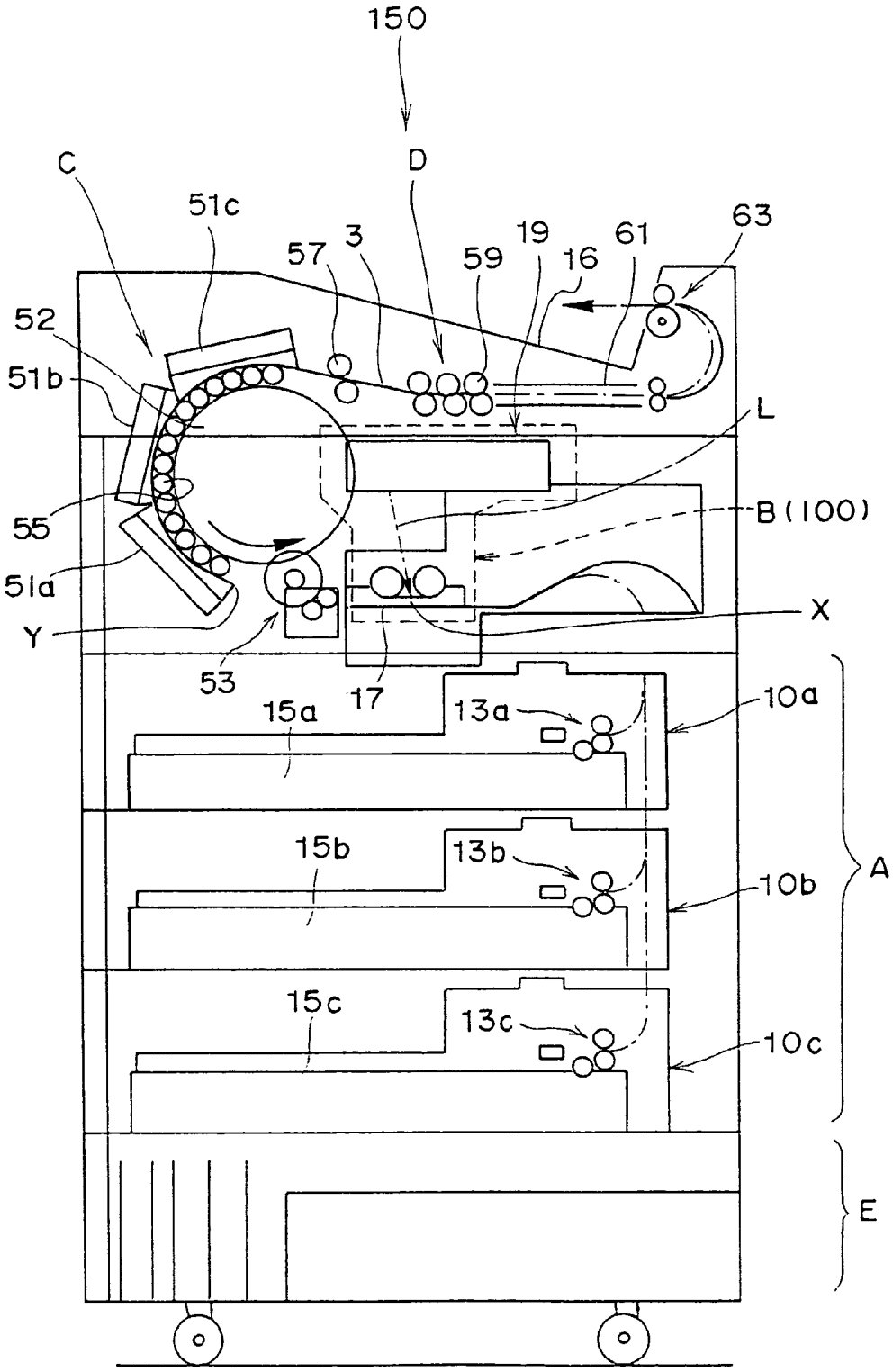
FIG. 1 is a schematic view of a thermal developing device according to the present invention.

In the present invention, a photographic characteristic curve is a D-log E curve representing a relationship between the common logarithm (log E) of a light exposure, i.e., the exposure energy, and the optical density (D), i.e., a scattered light photographic density, by plotting the former on the abscissa and the latter on the ordinate. A gamma (γ) value represents a tangent angle when the optical density D on the photographic characteristic curve is 1.2 (i.e., γ value equals to tan θ when the angle between the tangent and the abscissa is θ).

It is well known that a maximum optical density and a gamma (γ) value in the photographic characteristic curve have some effects on image quality such as sharpness and contrast of an image. To obtain a satisfactory image quality for photothermographic materials used in a laser image setter or a laser imager (i.e., LI photosensitive materials), the maximum optical density and the gamma (γ) value have been adjusted. In such a conventional technique, however, problems such as occurrence of subtle blurring in development caused by reduced processing time have not been recognized. Moreover, any countermeasures have been taken for decreased stability in output images or such problems have not been approached in view of selecting ideal photothermographic materials.

The present inventors have found that conveyance of photosensitive materials at high-speed or contact of the photosensitive materials with a conveyance roller causes vibration on the sensitive materials and thereby causing output images to become unstable. The present inventors have also found that the image quality of the output images is improved remarkably when a photothermographic material having a gamma value of 2.0 to 4.0 at an optical density of 1.2 in the photographic characteristic curve is used. Such a photothermographic material can output images constantly even under such vibration. The gamma value is preferably 2.5 to 3.5, and more preferably 2.0 to 3.0. If the gamma value at optical density of 1.2 is smaller than 2.0, image density becomes insufficient to obtain satisfactory image quality. If the gamma value is larger than 4.0, blurring in thermal development due to high-speed conveyance occurs easily.

The characteristic curve in the present invention can be shifted by various methods, such as by changing the amount of silver halide to be added, by changing the average grain size, by employing another method for chemical sensitization, by changing the degrees of ripening, or by changing the type or the amount of a spectral sensitizing dye adsorbing to the silver halides.

When a silver halide emulsion is used singly, the gamma value can be changed by, for example, (1) changing the grain size distribution of the silver halide, (2) employing another method of chemical sensitization, (3) controlling the heavy metal added to the silver halide, (4) changing the type or the amount of spectral sensitizing dye adsorbing to the silver halides or (5) changing halogen composition of the silver halide.

When at least two silver halide emulsions having different photosensitivity are used, the gamma value can be changed by, for example, (1) employing silver halides having different grain sizes, (2) employing silver halides which have been chemically sensitized in different ways, (3) employing silver halides with different heavy metals added thereto, (4) employing silver halides with different types or amounts of spectral sensitizing dye adsorbing to the silver halides or (5) employing silver halides with different halogen compositions of the silver halide.

The gamma value can also be changed by adding at least two types of silver halides having different photosensitivity to at least two different image forming layers.

The grain size distribution of the silver halide can be changed by, for example, employing at least two types of silver halides having different grain sizes mixed together, or employing silver halide having wide range of grain size distribution. It is also preferable to apply at least two types of silver halides having different grain sizes onto different two image forming layers.

The silver halide can be sensitized by, for example, employing a chemically sensitized silver halide, or changing the type of chemical sensitizing agent or the degree of sensitization. It is also preferable to employ at least two types of silver halides with different types of chemical sensitizing agent or sensitized to different degrees, that are mixed together or applied onto different two image forming layers.

The heavy metal added to the silver halide can be controlled by, for example, changing the types or the amounts of the heavy metal, or employing at least two types of silver halides with different types of heavy metals mixed together or applied onto different two image forming layers.

It is also preferable to mix at least two types of silver halides with different types of spectral sensitizing dyes or to apply the silver halides onto different two image forming layers.

It is also preferable to mix at least two types of silver halides with different halogen compositions of the silver halide or to apply the silver halides onto different two image forming layers.

Now, a composition of the photothermographic material will be described in detail, along with the effects of these compounds on the characteristic curve.

2. Photosensitive Silver Halide

1) Halogen Composition

For the photosensitive silver halide used in the invention, there is no particular restriction on the halogen composition and silver chloride, silver bromochloride, silver bromide, silver bromoiodide, silver chlorobromoiodide and silver iodide can be used. Among them, silver bromide, silver bromoiodide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver bromochloride grains can also be used preferably.

The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be used preferably. Further, a technique of localizing silver bromide or silver iodide to the surface of a grain as form epitaxial parts can also be used preferably.

2) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projection area of the silver halide grain (projection area of a main plane in a case of a tabular grain).

3) Coating Amount

The addition amount of the photosensitive silver halide, when expressed by the coating amount of silver per one $m^2$ of the photothermographic material, is preferably from 0.03 $g/m^2$ to 0.6 $g/m^2$, more preferably, 0.05 $g/m^2$ to 0.4 $g/m^2$ and, further preferably, 0.07 $g/m^2$ to 0.3 $g/m^2$. The photosensitive silver halide is used by 0.001 mol to 0.7 mol, preferably, 0.03 mol to 0.5 mol per one mol of the organic silver salt.

4) Method of Grain Formation

The method of forming photosensitive silver halide is well-known in the relevant art and, for example, methods described in Research Disclosure No. 10729, Jun. 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A No. 11-352627 and Japanese Patent Application No.2000-42336 are also preferred.

5) Grain Shape

The shape of the silver halide grain can include, for example, cubic, octahedral, plate-like, spherical, rod-like or potato-like shape. The cubic grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of [100] face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirror's index [100] face can be determined by the method of utilizing the adsorption dependency of [111] face and [100] face upon adsorption of a sensitizing dye described by T. Tani; in J. Imaging Sci., 29, 165 (1985).

6) Heavy Metal

The photosensitive silver halide grain of the invention can contain metals or complexes of metals belonging to groups 8 to 10 of the periodical table (showing groups 1 to 18). The metal or the center metal of the metal complex in the groups 8 to 10 of the periodical table is preferably rhodium, ruthenium or iridium. The metal complex may be used alone, or two or more kinds of complexes comprising identical or different species of metals may be used together. A preferred content is within a range from $1\times10^{-9}$ mol to $1\times10^{-3}$ mol per one mol of silver. The heavy metals, metal complexes and the addition method thereof are described in JP-A No. 7-225449, JP-A 11-65021 (paragraph Nos. 0018 to 0024) and JP-A No. 11-119374 (paragraph Nos. 0227 to 0240).

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are used preferably.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them forms an insoluble salt with silver ions on the surface of the grain. Since the hexacyano iron (II) silver salt is a less soluble salt than AgI, re-dissolution with fine grain can be prevented and fine silver halide grain with smaller grain size can be prepared.

Metal atoms that can be contained in the silver halide grain used in the invention (for example, $[Fe(CN)_6]^{4-}$), desalting method of a silver halide emulsion and chemical sensitization method are described in JP-A 11-84574 (paragraph Nos. 0046 to 0050), JP-A 11-65021 (paragraph Nos. 0025 to 0031), and JP-A 11-119374 (paragraph Nos. 0242 to 0250).

7) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and low molecular weight gelatin having a molecular weight of 500 to 60,000 is used preferably. The term "molecular weight" as referred herein means a number-average molecular weight, calculated from styrene-reduced gel permeation chromatography (GPC). These low molecular weight gelatins may be used upon grain formation or upon the time of dispersion after desalting treatment and it is preferably used during grain formation.

8) Chemical Sensitization

The photosensitive silver halide in this invention can be used without chemical sensitization, but is preferably chemically sensitized by at least one of chalcogen sensitization method, gold sensitization method and reduction sensitization method. The chalcogen sensitization method includes sulfur sensitization method, selenium sensitization method and tellurium sensitization method.

In sulfur sensitization, unstable sulfur compounds can be used. Such unstable sulfur compounds are described in P. Grafkides, Chemie et Pysique Photographique (Paul Momtel, 1987, 5 th ed.,) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element and active gelatin can be used. Specifically, thiosulfates, thioureas and rhodanines are preferred.

In selenium sensitization, unstable selenium compounds can be used. These unstable selenium compounds are described in JP-B Nos.43-13489 and 44-15748, JP-A Nos.4-25832, 4-109340, 4-271341, 5-40324, and 5-11385, Japanese Patent Application Nos. 4-202415, 4-330495, 4-333030, 5-4203, 5-4204, 5-106977, 5-236538, 5-241642, and 5-286916, and the like.

As typical examples of selenium sensitizer, colloidal metal selenide, selenoureas (eg., N,N-dimethylselenourea, trifluoromethylcarbonyl-trimethylselenourea and acetyltrimethylselemourea), selenamides (eg., selenamide and N,N-diethylphenylselenamide), phosphineselenides (eg., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, diacylselenides can be used. Furthermore, non-unstable selenium compounds such as selenius acid, selenocyanic acid, selenazoles and selenides described in JP-B Nos. 46-4553 and 52-34492 can also be used. Specifically, phosphineselenides, selenoureas and salts of selenocyanic acids are preferred.

In the tellurium sensitization, unstable tellurium compounds are used. Unstable tellurium compounds described in JP-A Nos.4-224595, 4-271341, 4-333043, 5-303157, 6-27573, 6-175,258, 6-180478, 6-208186, 6-208184, 6-317867, 7-140579, 7-301879, 7-301880 and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride and ethoxy-diphenylphosphinetellride), diacyl(di)tellurides (e.g., bis(diphenylcarbamoyl)ditellu ride, bis(N-phenyl-N-methylcarbamoyl)ditelluride, bis(N-phenyl-N-methylcarbamoyl)ditelluride, bis(N-phenyl-N-benzylcarbamoyl)telluride and bis(ethoxycarmonyl)telluride), telluroureas (e.g., N,N'-dimethylethylenetellurourea and N,N'-diphenylethylenetellurourea), telluramides, telluroesters are used. Specifically, diacyl(di)tellurides and phosphinetellurides are preferred. Especially, the compounds described in paragraph No. 0030 in JP-A No.11-65021 and compounds represented by the general formula [II], [III] and [IV] in JP-A No.5-313284 are more preferred.

Selenium sensitization and tellurium sensitization are preferred as chalcogen sensitization and specifically, tellurium sensitization is more preferred.

In gold sensitization, gold sensitizer described in P. Grafkides, Chemie et Pysique Photographique (Paul Momtel, 1987, 5 th ed.,) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belg. Patent No. 691857, and the like can also be used. And another novel metal salts except gold such as platinum, palladium, iridium and so on described in P. Grafkides, Chemie et Pysique Photographique (Paul Momtel, 1987, 5 th ed.,) and Research Disclosure (vol. 307, Item 307,105) can be used.

The gold sensitization can be used independently. But it is preferably used in combination with the above chalcogen sensitization. To speak specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating, and it can be applied, after desalting, (1) before spectral sensitization, (2) simultaneously with spectral sensitization, (3) after spectral sensitization and (4) just before coating.

The amount of chalcogen sensitizer used in the invention may vary depending on the silver halide grain used, the chemical ripening condition and the like and it is used by about $10^{-8}$ mol to $10^{-1}$ mol, preferably, $10^{-7}$ mol to $10^{-2}$ mol per one mol of the silver halide.

Similarly, the addition amount of the gold sensitizer used in the invention may vary depending on various conditions and it is generally about $10^{-7}$ mol to $10^{-3}$ mol and, more preferably, $10^{-6}$ mol to $5\times10^{-3}$ mol per one mol of the silver halide. There is no particular restriction on the condition for the chemical sensitization in the invention and, appropriately, pAg is 8 or less, preferably, 7.0 or less, more preferably, 6.5 or less and, particularly preferably, 6.0 or less, and pAg is 1.5 or more, preferably, 2.0 or more, particularly preferable, 2.5 or more, pH is 3 to 10, preferably, 4 to 9, and temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide or dimethylamine borane is preferred, as well as use of stannous chloride, aminoimino methane sulfonic acid, hydrazine derivatives, borane compounds, silane compounds and polyamine compounds is preferred. The reduction sensitizer may be added at any stage in the photosensitive emulsion production process from crystal growth to the preparation step just before coating. Further, it is preferred to apply reduction sensitization by ripening while keeping pH to 8 or higher and pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per one mol of the silver halide.

In the silver halide emulsion used in the invention, a thiosulfonic acid compound may be added by the method shown in EP-A No. 293917.

The photosensitive silver halide grain in the invention can be chemically unsensitized, but is preferably chemically sensitized by at least one method of gold sensitization method and chalcogen sensitization method for the purpose of designing a high-photosensitive photothermographic material.

9) FED Sensitizer

The photosensitive silver halide emulsion in the invention preferably contains an FED sensitizer (Fragmentable Electron Donating Sensitizer) as a compound generating two electrons by one photon. As the FED sensitizer, those compounds described in U.S. Pat. Nos. 5,747,235, 5,747,236, 6,054,260 and 5,994,051, and Japanese Patent Application No. 2001-86161 are preferred. The FED sensitizer may be added preferably at any stage in the photosensitive emulsion production process from the crystal growth to the preparation step just before coating. The addition amount may vary depending on various conditions and as a standard, it is about from $10^{-7}$ mol to $10^{-1}$ mol, more preferably, $10^{-6}$ mol to $5\times10^{-2}$ mol per one mol of the silver halide.

10) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously.

In the present invention, photothermographic materials which indicate a sufficient and stable sensitivity in the present image recording apparatus are preferably spectrally sensitized by spectral sensitizers having maximum sensitivity in a wave length from 600 nm to 700 nm. It was found that, when the maximum sensitive wave length is 700 nm or more, the sensitivity is unstable and the sensitivity falls slowly with increasing continuously in the amount of a processing volume. It is not clear in the reason, it seems that latent images came from an exposure by a laser of a wave length of 700 nm or more are more unstable to the temperature than that by a laser from 600 nm to 700 nm, and may be degraded through the increasing the temperature of the exposure section affecting from the heating section.

Spectral sensitizers in present invention are preferably indicate a maximum sensitivity in a wave length from 600 nm or more to less than 700 nm, more preferably from 620 nm to 680 nm, most preferably from 640 nm to 670 nm. It is also preferable to have a least subabsorption in the region of more than 700 nm. It is preferable that the halfband width in maximum wave length is 70 nm or less in the region longer than maximum wave length, more preferably 50 nm or less.

As the sensitizing dye applicable in the invention, those existing various sensitizing dyes which satisfy the conditions described above can be selected advantageously. The sensitizing dyes and the addition method are disclosed, for example, JP-A No. 11-65021 (paragraph Nos. 0103 to 0109), as a compound represented by the general formula (II) in JP-A No. 10-186572, dyes represented by the general formula (I) JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. The sensitizing dye is added into the silver halide emulsion preferably within a period after desalting step to coating step and, more preferably, in a period after desalting to the completion of chemical ripening.

In the invention, the sensitizing dye may be added at any amount according to the property of photosensitivity and fogging, but it is preferably added from $1\times10^{-6}$ mol to 1 mol, and more preferably, from $1\times10^{-4}$ mol to $1\times10^{-1}$ mol per one mol of silver in each case.

Particularly preferred examples of the sensitizing dyes in the invention are described in JP-A Nos. 6-258756 and 7-13289. Specific examples are shown below, but it should be understood that the invention is not limited thereto.

1

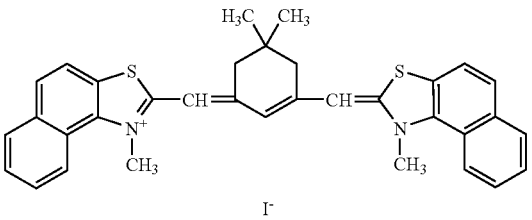

2

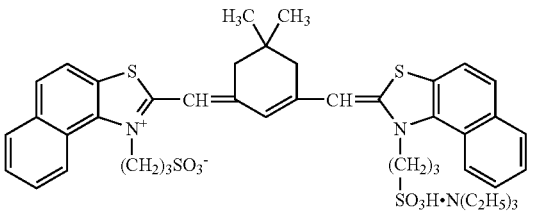

-continued
3
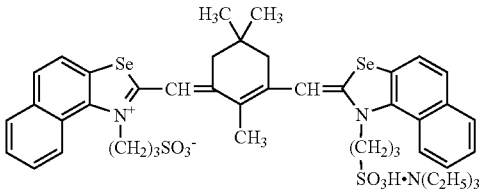
4
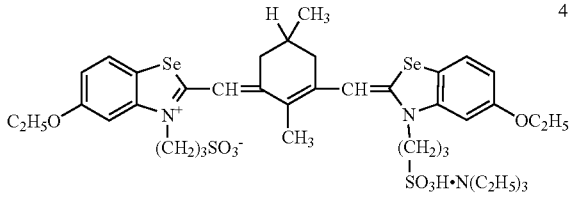
5
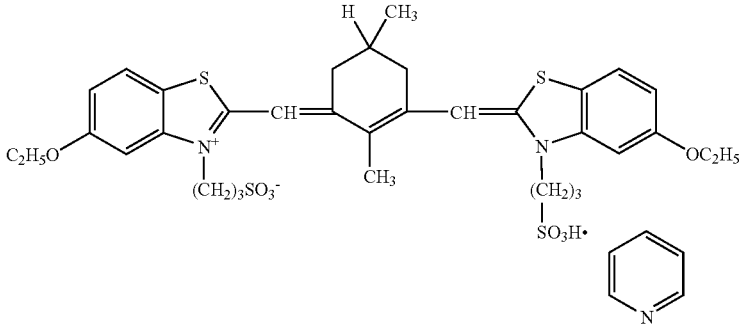
6
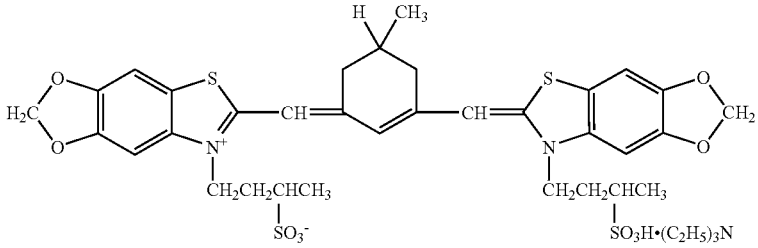
7
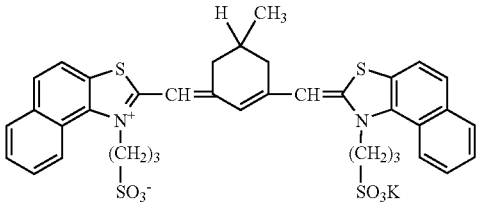
8
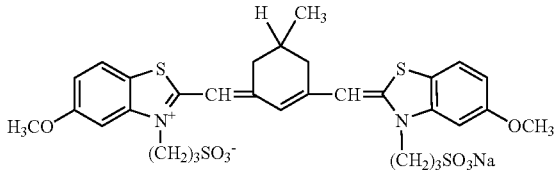
9
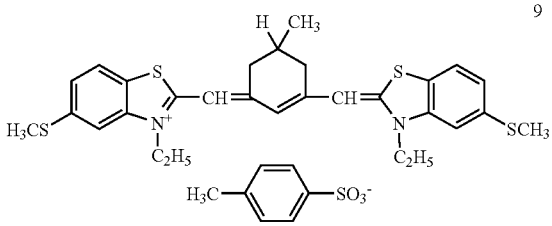
10
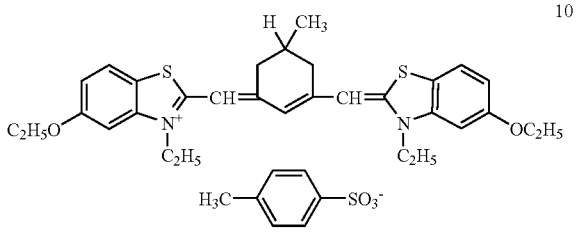
11
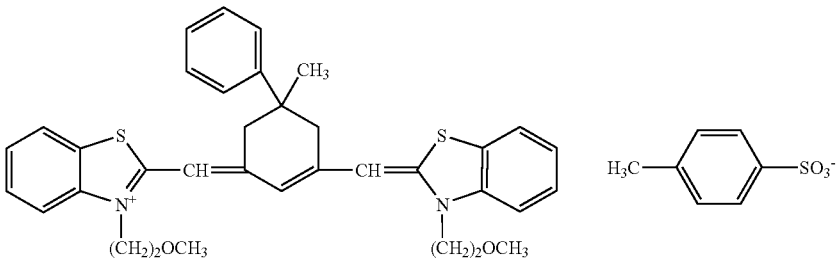

-continued
12
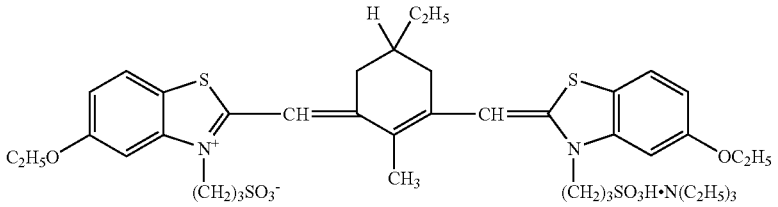
13
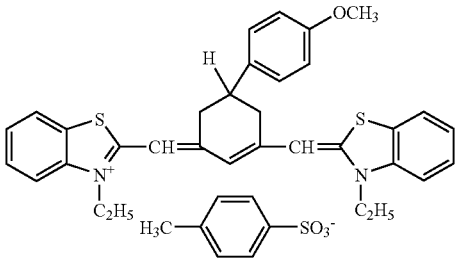
14
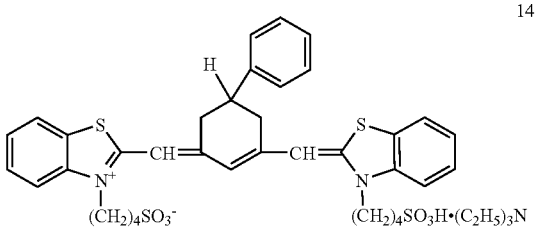
15
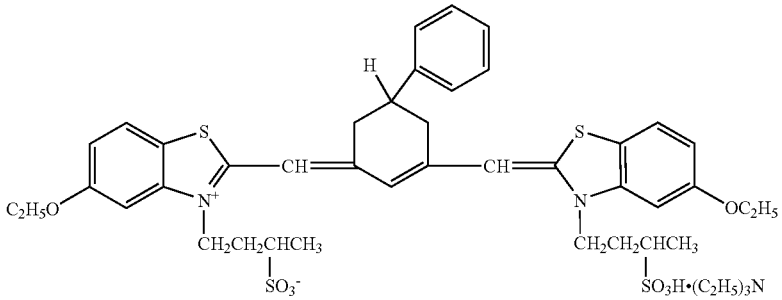
16
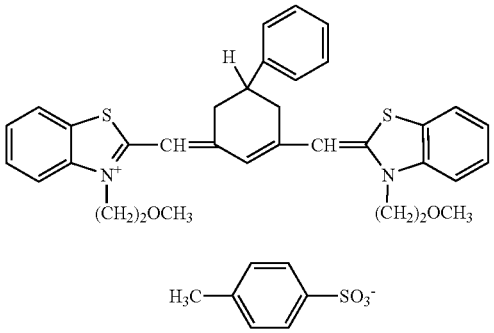
17
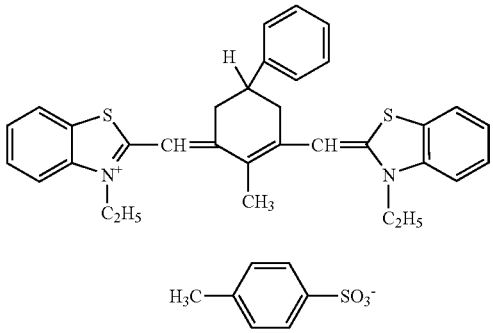
18
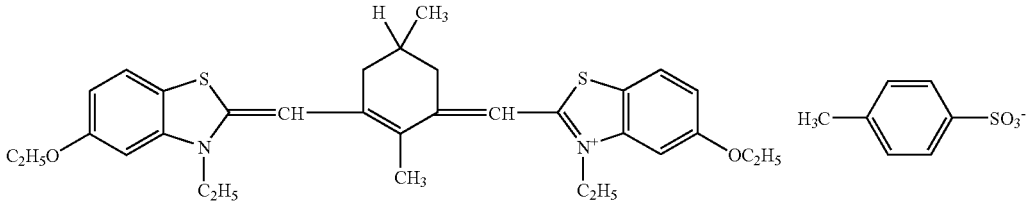
19
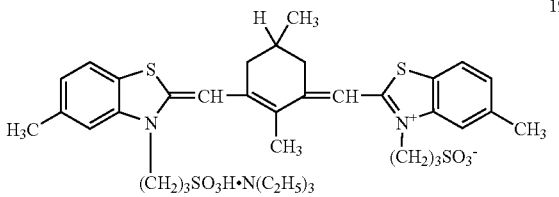
20
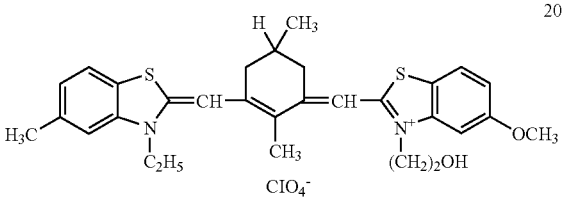

-continued
21
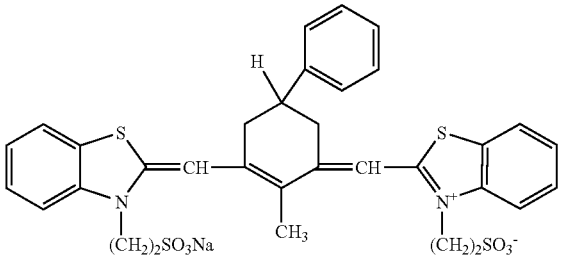
22
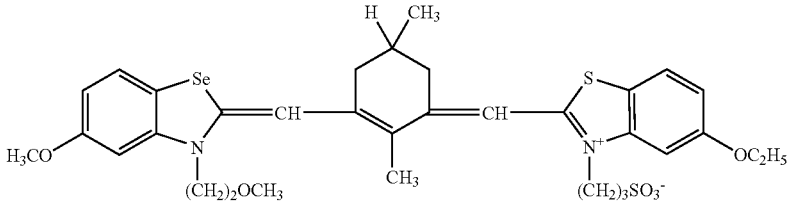
23
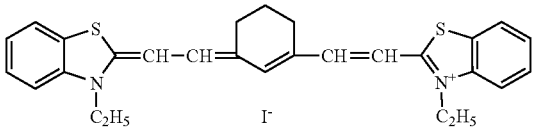
24
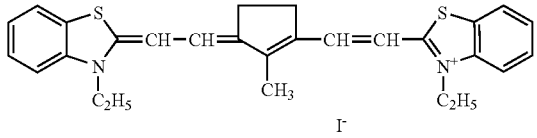
25
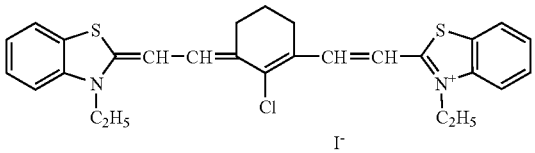
26
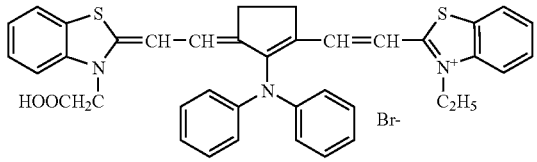
27
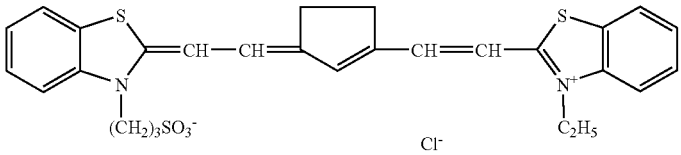
28
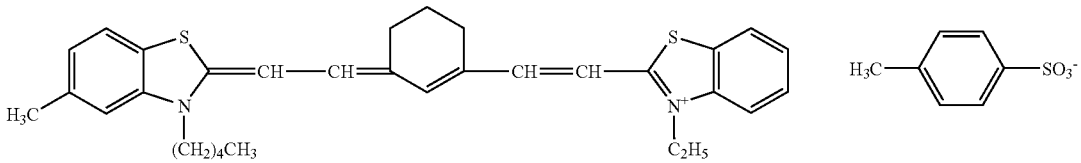
29
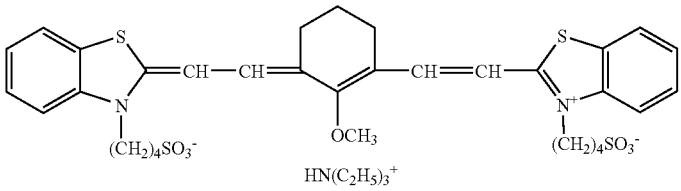
30
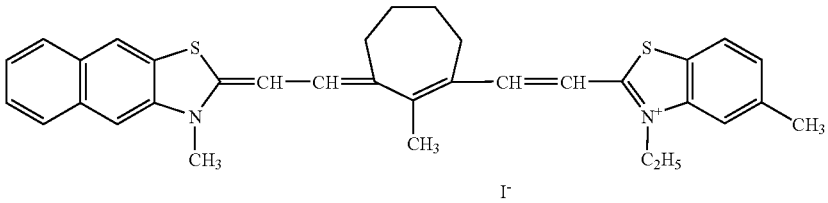

-continued
31
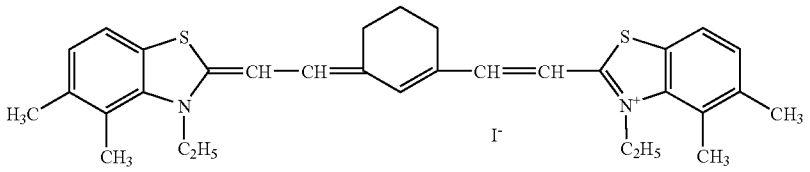
32
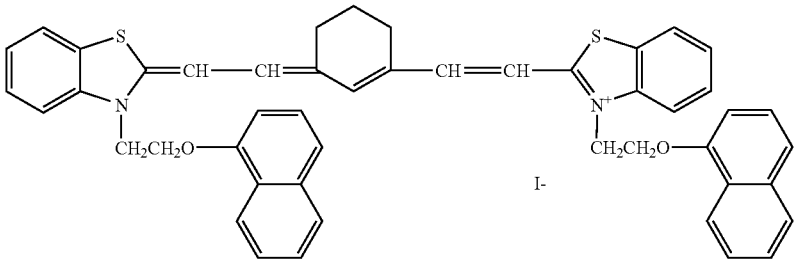
33
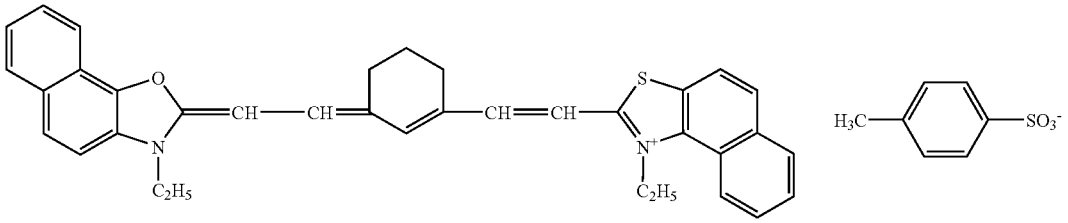
34
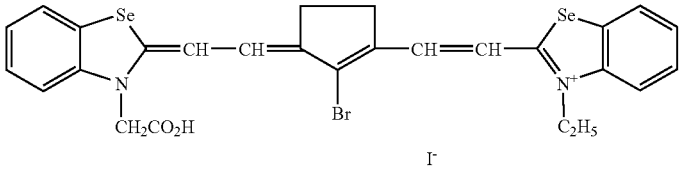
35
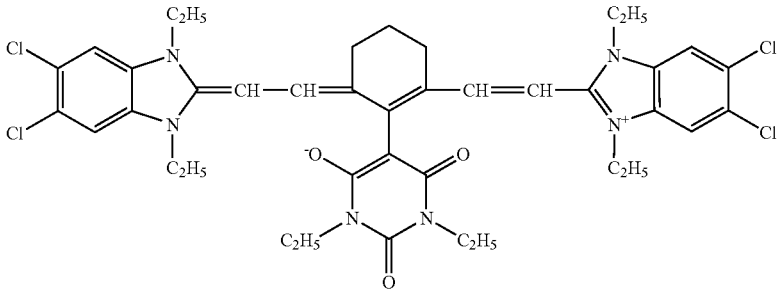
36
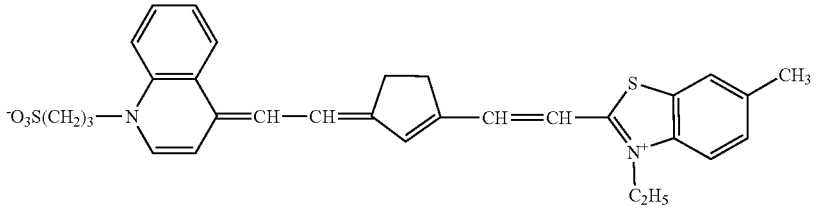
37
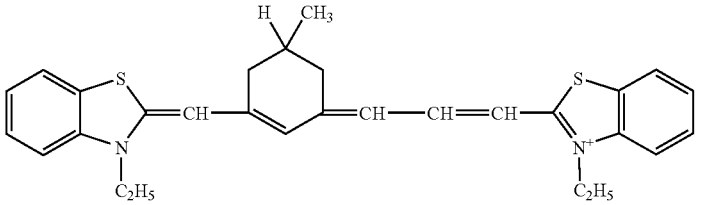

-continued
38
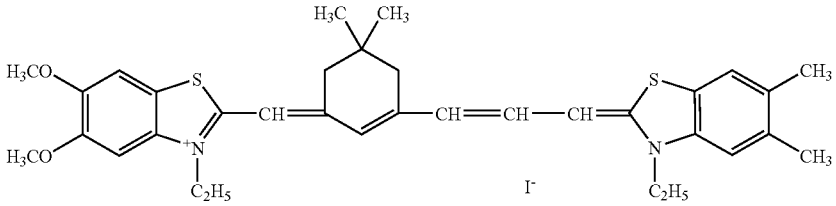
39
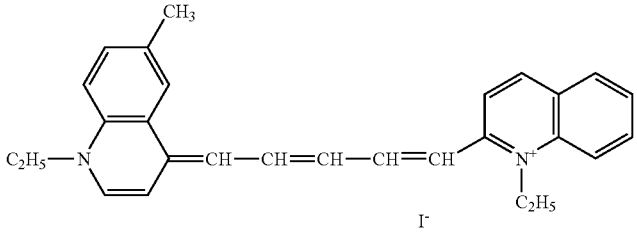
40
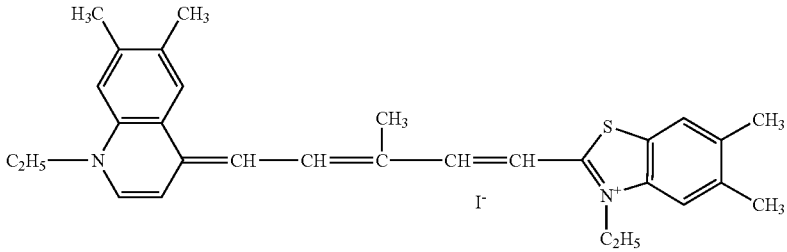
41
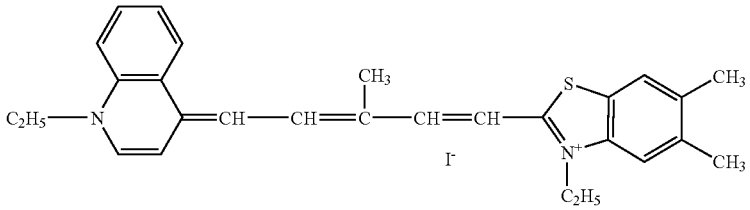
42
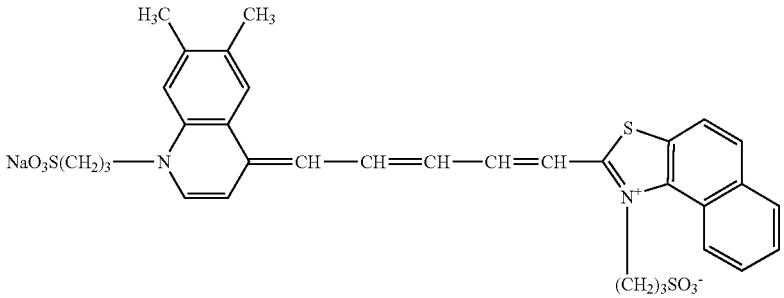
43
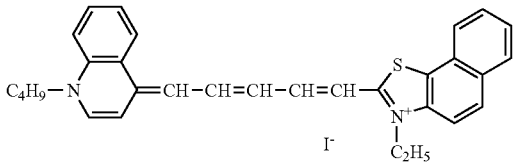
44
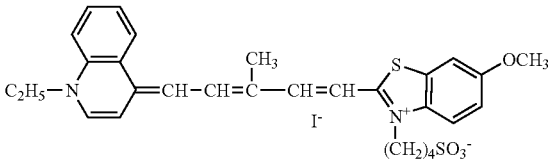
45
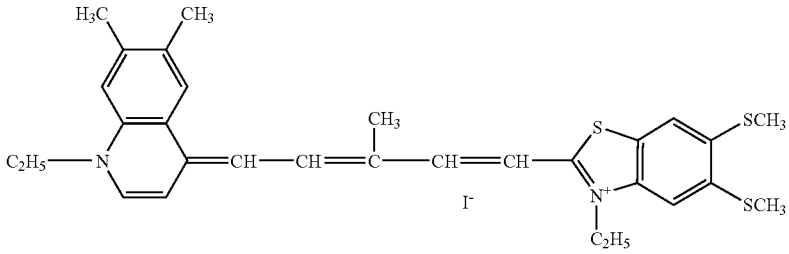

-continued
46
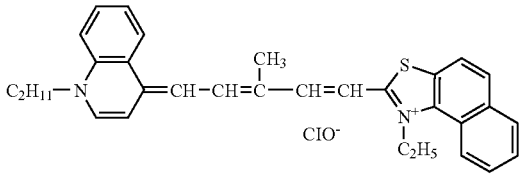
47
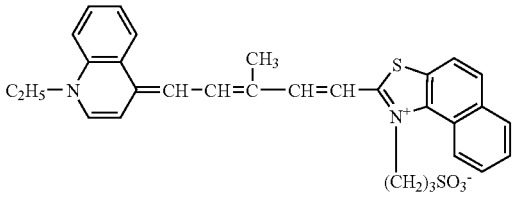
48
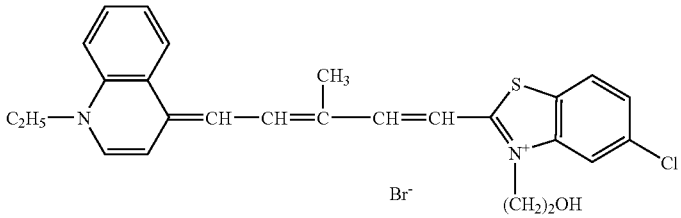
49
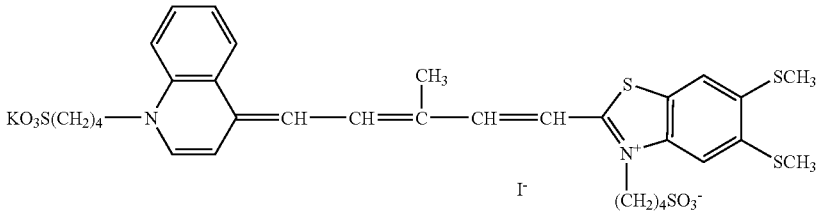
50
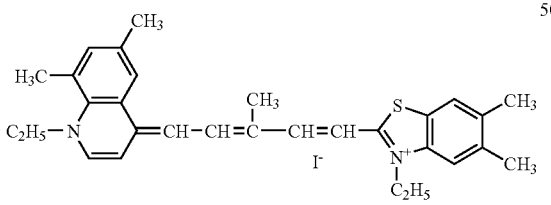
51
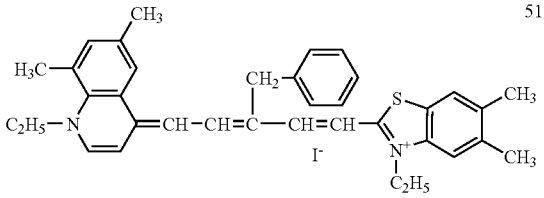
52
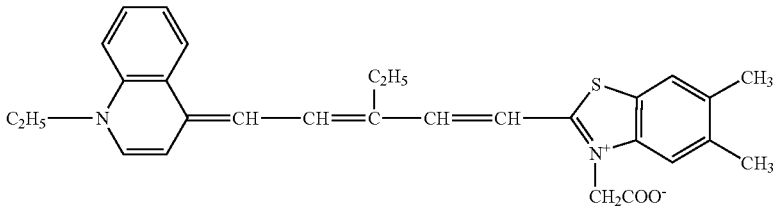
53
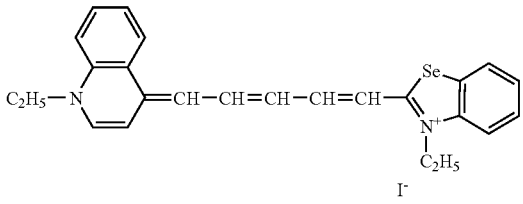
54
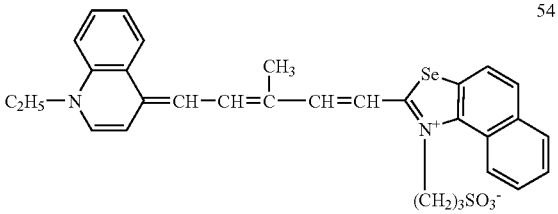
55
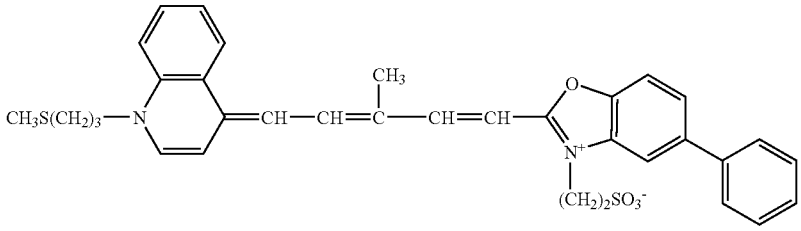

-continued
56
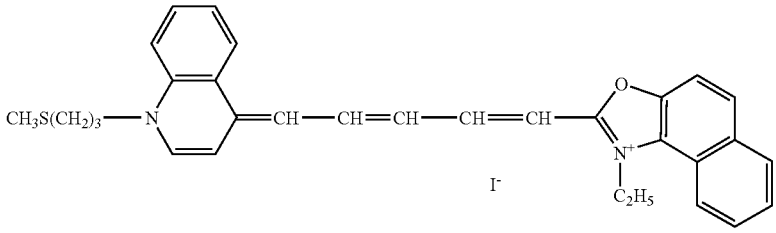
57
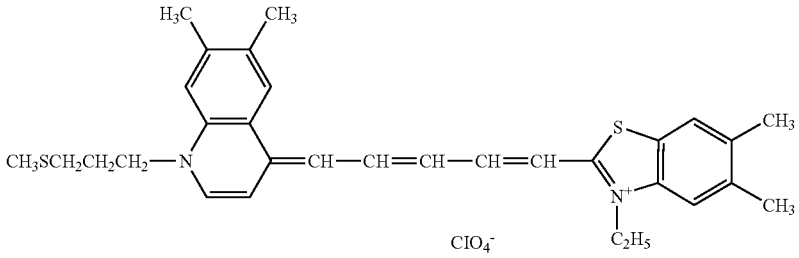
58
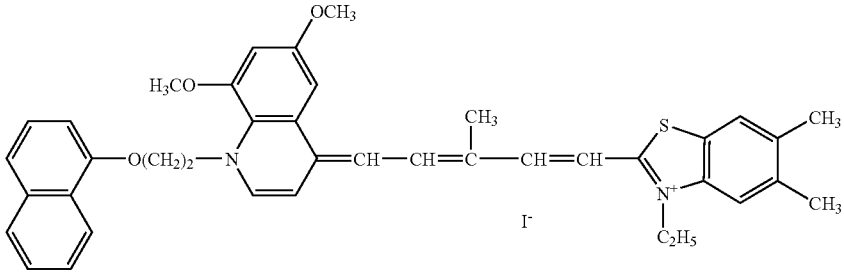
59
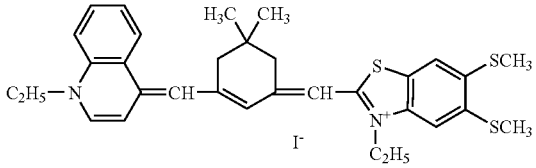
60
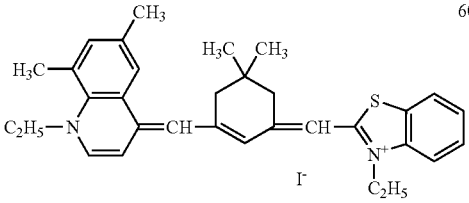
61
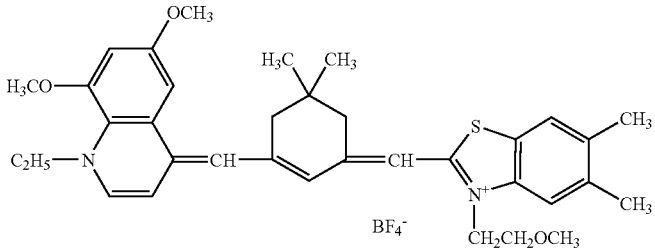
62
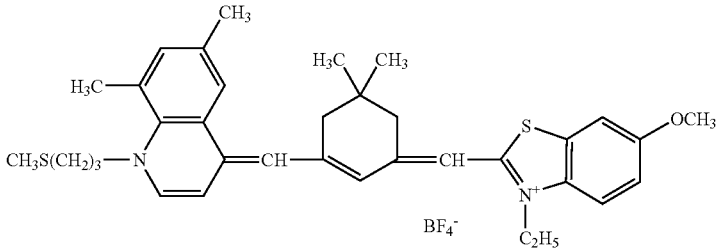

-continued

63

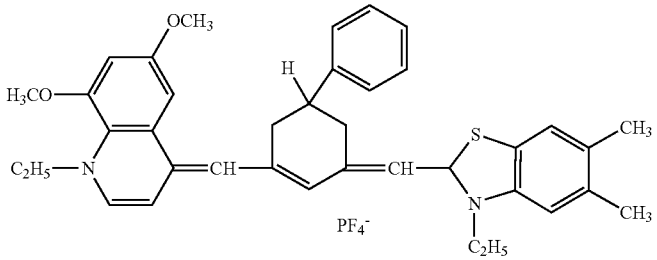

64

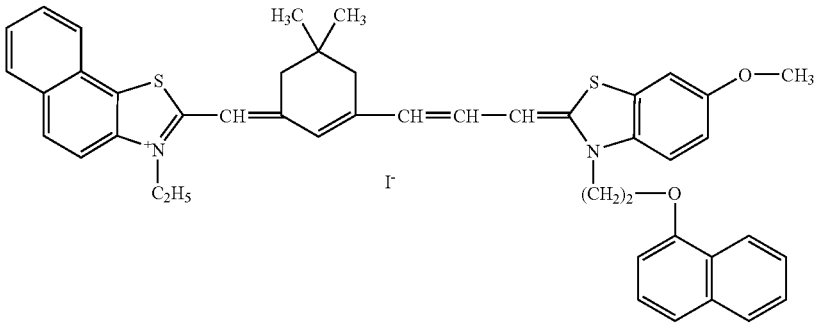

65

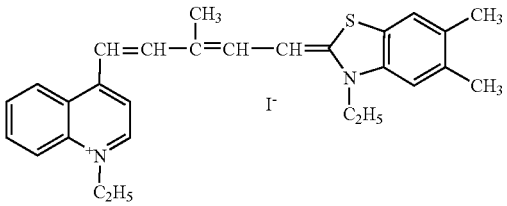

66

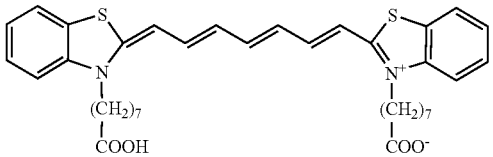

67

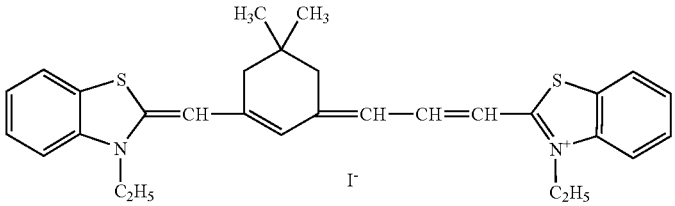

11) Combined Use of a Plurality of Silver Halides

The photosensitive silver halide emulsion in the photosensitive material used in the invention may be used alone, or two or more kinds of them (for example, those of different average particle sizes, different halogen compositions, different crystal habits and of different conditions for chemical sensitization) may be used together. Gradation can be controlled by using a plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 logE or more between each of the emulsions.

12) Mixing Silver Halide and Organic Silver Salt

The photosensitive silver halide in the invention is particularly preferably formed under the absence of the non-photosensitive organic silver salt and then mixed in the process for preparing the organic silver salt. This is because a sufficient sensitivity can not sometimes be attained by the method of forming the silver halide by adding a halogenating agent to the organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

13) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

3. Non-Photosensitive Organic Silver Salt

1) Composition

The organic silver salt particle according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A Nos. 6-130543, 8-314078, 9-127643, 10-62899 (paragraph Nos. 0048 to 0049), 10-94074, and 10-94075, EP-A No. 0803764A1 (page 18, line 24 to page 19, line 37), EP-A Nos. 962812A1 and 1004930A2, JP-A Nos. 11-349591, 2000-7683, and 2000-72711, and the like. A silver salt of organic acid, particularly, a silver salt of long chained fatty acid carboxylic acid (number of carbon atoms having 10 to 30, preferably, 15 to 28) is preferable. Preferred examples of the silver salt of the organic acid can include, for example, silver lignocerate, silver behenate, silver arachidinic acid, silver stearate, silver oleate, silver laurate, silver capronate, silver myristate, silver palmitate, silver erucic acid and mixtures thereof.

Among the organic silver salts, it is preferred to use an organic silver salt with the silver behenate content of 30 mol % to 100 mol %, more preferably, 50 mol % to 100 mol %, further preferably, 85 mol % to 100 mol %, most preferably, 95 mol % to 100 mol %. And, it is preferred to use an organic silver salt with the silver erucic acid content of 2 mol % or less, more preferably, 1 mol % or less, further preferably, 0.1 mol % or less.

It is preferred that the content of the silver stearate is 1 mol % or less. When the content of the the silver stearate is 1 mol % or less, a silver salt of organic acid having low Dmin, high photosensitivity and excellent image stability can be obtained. The content of the silver stearate above-mentioned, is preferably 0.5 mol % or less, more preferably, the silver stearate is not substantially contained.

Further, in the case the silver salt of organic acid includes silver arachidinic acid, it is preferred that the content of the silver arachidinic acid is 6 mol % or less in order to obtain a silver salt of organic acid having low Dmin and excellent image stability. The content of the silver arachidinic acid is more preferably 3 mol % or less.

2) Shape

There is no particular restriction on the shape of the organic silver salt usable in the invention and it may needle-like, bar-like, plate-like or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of 5 or more. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average)≧1.5 and, more preferably, 15≧x (average)≧1.5. By the way, needle-like is expressed as 1≦x (average)≦1.5.

In the flaky shaped particle, a can be regarded as a thickness of a plate particle having a main plate with b and c being as the sides. a in average is preferably 0.01 μm to 0.3 μm and, more preferably, 0.1 μm to 0.23 μm. c/b in average preferably 1 to 9, more preferably, 1 to 6 and, further preferably, 1 to 4 and, most preferably, 1 to 3.

By controlling the sphere equivalent diameter to 0.05 μm to 1 μm, it causes less agglomeration in the photosensitive material and image stability is improved. The spherical equivalent diameter is preferably 0.1 μm to 1 μm. In the invention, the sphere equivalent diameter can be measured by a method of photographing a sample directly by using an electron microscope and then image-processing negative images.

In the flaky shaped particle, the sphere equivalent diameter of the particle/a is defined as an aspect ratio. The aspect ratio of the flaky particle is, preferably, 1.1 to 30 and, more preferably, 1.1 to 15 with a view point of causing less agglomeration in the photosensitive material and improving the image stability.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

3) Preparation 3-1) Preparation of Organic Silver Salt for Addition to Organic Solvent In a case of preparing a coating solution by adding to an organic solvent, the organic silver salt is prepared by adding an alkali metal salt (for example, sodium hydroxide or potassium hydroxide) to an organic acid to prepare an alkali metal organic acid soap and then mixing with a water soluble silver salt (for example, silver nitrate). The silver halide can be added at any of the stages thereof. Main mixing step can include, four steps comprising (A) adding a silver halide previously to an organic acid and, after addition of an alkali metal salt, mixing with a water soluble silver salt, (B) mixing an alkali metal organic acid soap and a silver halide and, subsequently mixing with a water soluble silver salt, (C) forming a portion of an alkali metal soap of an organic acid into a silver salt, then mixing a silver halide and, subsequently, forming a silver salt for the remaining portion and (D) mixing a silver halide in the subsequent step after completion of an organic silver salt. Steps (B) or (C) are preferred, with the step (B) being particularly preferred.

In the step (B) or (C), it is important that the previously prepared photosensitive silver halide is mixed in the step of preparing the organic silver salt to prepare a dispersion of an organic silver salt containing the silver halide. That is, the photosensitive silver halide is formed under the absence of the non-photosensitive organic silver salt and then mixed in the process for preparing the organic silver salt. This is because a sufficient sensitivity can not sometimes be attained by the method of forming the silver halide by adding a halogenating agent to the organic silver salt.

The method of mixing the silver halide and the organic silver salt by the step (D) can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

All of those salt forming steps are carried out in an aqueous solvent and then the salt is dewatered, dried and then re-dispersed into a solvent such as MEK. Drying is preferably conducted in a airflow-type flash jet drier at a partial oxygen pressure of 15 vol % or less, more preferably, at 0.01 vol % to 15 vol % and, more preferably, at 0.01 vol % to 10 vol %. 3-2) Preparation of Organic Silver Salt for Addition to Water Solvent In a case of using water as the solvent to prepare a coating solution, known methods can be applied. For example, reference can be made to JP-A No. 10-62899, EP-A Nos. 0803763A1 and 0962812A1., JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868.

When a photosensitive silver salt is present together during dispersion of the organic silver salt, fog increases and the sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per one mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, within a range from 1 mol % to 30 mol %, more preferably, within a range from 2 mol % to 20 mol % and, particularly preferably, 3 mol % to 15 mol %. A method of mix two or more kinds of aqueous dispersions of organic silver salts and two or more kinds of aqueous dispersions of photosensitive silver salts upon mixing is used preferably for controlling the photographic properties.

4) Coating Amount

The coating amount of the organic silver salt in the invention is, converted to mol of fatty acid, preferably, 5 mmol/m$^2$ to 18 mmol/m$^2$, more preferably, 7 mmol/m$^2$ to 17 mmol/m$^2$ and, further preferably, 10 mmol/m$^2$ to 15 mmol/m$^2$. Herein, conversion to mol of fatty acid means the mol-reduced total amount of fatty acid, used to become a silver salt and the rest of raw material. When the photothermographic material contents more fatty acid and silver salt of fatty acid than described above, the volatile materials increase, and pollute the exposure apparatus (mirror etc.) or the photothermographic materal itself. Besides, when the amount is smaller than this range, it causes trouble to image forming and image stability.

4. Method to Prevent Volatilization

At the thermal developing process, some of various organic compounds in a photothermographic material are vaporized and volatilized to the outside of a layer by heating. Further, in some cases, the volatile substances are formed by the thermal development reaction. The volatile substance formed in the condition stated above causes the smell pollution and effects a photographic action to form a fog or to make a sensitivity decrease on the contrary. In another case, this volatile substance adheres to an exposure apparatus or a thermal developing apparatus to cause the uneven exposure defects and the uneven development defects.

Accordingly, to prevent these undesirable effects, it was necessary to devise the apparatus so that the volatile substance would not adhere to the photographic material, or to set the filter for capturing the volatile substances. However, these counter plans made the apparatus more complicated and larger and these interfered the high-speed processing.

On the other hand, for the thermal developing system, it is required that lots of images should be exposed, the thermal development should be rapidly performed and the apparatus should be devised to compact one. To respond to these requires, the photothermographic material is required to have a high reactivity and many efforts had been tried for the photothermographic material, such as the thickness of layers thinned and the functional materials densely packed in it to make the thermal conductivity faster and also the reaction faster.

However, these plans accelerate the generation of the above volatile substances and their diffusion and scattering to the outside of the layer.

In the present invention, particularly in the thermal developing processor, in which the distance between the exposure part and the development part is shortly 0 cm to 50 cm, it is preferred to arrange a method by which the volatile substances occurred in the thermal developing process can be prevented to scatter out of the photothermographic material.

In the present invention, it is preferred that the method to prevent the formation of the volatile substance is arranged on the same side of the image forming layer for the support and situated on the position far from the support rather than the image forming layer. The method to prevent the scattering can be arranged in the overcoat layer situated at the furthest position from the support or in the interlayer. In the case where the image forming layers are arranged in the both sides of the support, the method to prevent the scattering is preferably arranged in the both sides too. In the present invention, it is preferred that these layers act as a protective layer and a barrier layer. The detail is described in the following.

Preferred methods to prevent the scattering are set forth below, but another method to prevent the scattering can be arranged apart from the limitation of these methods.

1) Protective Layer

For the purpose to prevent the scattering of the volatile substance by trapping, the compound having the binding ability to the volatile substance chemically or physically can be added to the protective layer.

As the compound to trap the volatile substance, the compound having —NH— bond is preferred. As the examples of the compound having a —NH— bond in the molecule, the compounds having an amino bond, an ureido bond, an amido bond or an imido bond are specially effective. Specific examples include hexamethylenediamine, morpholine, 2-amino-4,5-dicyanoimidazole, 3-azahexane-1,6-diamine, 2-acrylamido-2-methylpropane sulfonic acid, α-amino-caprolactam, acetoguanamine, guanine, acetaldehyde ammonia, 4,7-diazadecane-1,10-diamine, pyrrolidine, piperidine, piperazine, polyethylenimine, polyallylamine, polyvinylamine, polyaniline and so on. The examples having an ureido bond include urea, thiourea, methylurea, ethylurea, dimethylurea, diethylurea, ethylene urea, guanylurea, guanylthiourea, azodicarbonamide, glicolylurea, acetylurea and so on. The examples having an amido bond include formamide, acetamide, benzamide, oxamide, oxamic acid, succinamide, malonamide and so on. The examples having an imido bond include succinimide, phthalimideo, maleimide, 1-methylol-5,5-dimethylhydantoin, allantoin compounds, isocyanuric acid, azole compounds, azine compounds, pyridazine compounds and so on.

Examples of an azole compound include diazole compounds, triazole compounds, thiazole compounds and so on. Among them, diazole compounds and triazole compounds are preferrably used.

Specific examples of a diazole compound include the pyrazolone compounds, e.g.; 3-methyl-5-pyrazolone, 1,3-dimethyl-5-pyrazolone, 3-methyl-1-phenyl-5-pyrazolone, 3-phenyl-6-pyrazolone, 3-methyl-1-(3-sulfophenyl)-5-pyrazolone and so on, the pyrazole compounds, e.g.; pyrazole, 3-methylpyrazole, 1,4-dimethylpyrazole, 3,5-dimethylpyrazole, 3,5-dimethyl-1-phenyl-pyrazole, 3-aminopyrazole, 5-amino-3-methylpyrazole, 3-methylpyrazole-5-carboxylic acid, methyl 3-methylpyrazole-5-carboxylate, ethyl 3-methyl pyrazole-5-carboxylate, 3,5-methylpyrazoledicarboxylic acid and so on.

Specific examples of a triazole compound include 1,2,3-triazole, 1,2,4-triazole, 3-n-butyl-1,2,4-triazole, 3,5-dimethyl-1,2,4-triazole, 3,5-di-n-butyl-1,2,4-triazole, 3-mercapto-1,2,4-triazole, 3-amino-1,2,4-triazole, 4-amino-1,2,4-triazole, 3,5-diamino-1,2,4-triazole, 5-amino-3-mercapto-1,2,4-triazole, 3-amino-5-phenyl-1,2,4-triazole, 3,5-diphenyl-1,2,4-triazole, 1,2,4-triazole-3-one, urazole(3,5-dioxy-1,2,4-triazole), 1,2,4-triazole-3-carboxylic acid, 5-hydroxy-7-methyl-1,3,8-triazaindolizine and so on.

Among these compouds, azole compounds are preferred and among azole compounds, especially preferred are triazole compounds, e.g., 1,2,4-triazole and 1,2,3-triazole, pyrazole compounds, e.g., 3,5-dimethylpyrazole and pyrazolone compounds, e.g., 3-methyl-5-pyrazolone.

Specific examples of a thiadiazole compound include 2-amino-5-ethyl-1,3,4-thiadiazole, 5-amino-2-mercapto-1,3,4-thiadiazole, 2,5-dimercapto-1,3,4-thiadiazole, 5-t-butyl-2-methylamino-1,3,4-thiadiazole, 2-amino-5-methyl-1,3,4-thiadiazole, 2-amino-1,3,4-thiadiazole and so on.

Examples of an azine compound include diazine compounds, triazine compounds, pyridazine compounds and so on. Among these, pyridazine compounds can be preferably used.

Specific examples of a diazine compound include 1,3-diazine derivatives, e.g., 1,3-diazine, 2-amino-4,6-dimethyl-1,3-diazine, 4,6-dihydroxy-1,3-diazine, 2-mercapto-1,3-diazine, 2-amino-1,3-diazine and 2,4-dihydroxy-1,3-diazine and 1,4-diazine derivatives, e.g., 2-amino-1,4-diazine, 2,3-dimethyl-1,4-diazine, 2-methyl-1,4-diazine, 1,4-diazine-2-carboxylic acid and 2,3,5-trimethyl-1,4-diazine and so on.

Specific examples of a triazine compound include 3-amino-5,6-dimethyl-1,2,4-triazine, 3-hydroxy-5,6-diphenyl-1,2,4-triazine, benzo-1,2,3-triazine-4(3H)-one, 3-(2-pyridyl)-5,6-diphenyl-1,2,4-triazine and so on.

Specific examples of a pyridazine compound include pyridazine, 6-methyl-8-hydroxytriazolopyridazine, 4,5-dichloro-3-pyridazine, 6-methyl-3-pyridazone and so on.

Specific examples of a 1-aminopyrrolidine compound include 1-aminopyrrolidine and inorganic salts thereof. More specific examples of an inorganic salt of 1-aminopyrrolidine compound include 1-aminopyrrolidine hydrochloride, 1-aminopyrrolidine sulfate, 1-aminopyrrolidine phosphate, 1-aminopyrrolidine carbonate and so on.

The more addition amount of the compound having a —NH— bond in the present invention increases, the more volatilization of low molecular substances at the thermal developing process is inhibited. However, the addition amount is limited by the effect for the photographic property, the breed-out of the compound and the smell of added compound.

Besides the compound having a —NH— bond, the protective layer contains the binder.

As the binder, any polymer can be used. Examples of these binders include polyester, gelatin, polyvinylalchol, and cellulose derivatives. Among these, cellulose derivatives are preferred. Examples of a cellulose derivative are set forth below, however, examples are not limited thereto. Examples of a cellulose derivative include cellulose acetate, cellulose acetate butyrate, cellulose propionate, hydroxypropyl cellulose, hydroxypropyl methylcellulose, methyl cellulose, hydroxyethyl methycellulose, carboxymethyl cellulose and the mixtures thereof.

The compound having a —NH— bond described above may be contained in the structure of the side chain or the main chain of the binder described above. It is preferred to prevent the effect for the photographic property and the breed-out of the compound in the case where the binder has a compound having a —NH— bond in the side chain or the main chain of its structure.

The thickness of the protective layer is preferably from 0.2 μm to 10 μm to work that function. It is more preferably from 1 μm to 5 μm, still more preferably from 1.5 μm to 3.0 μm.

The protective layer may consist of either a monolayer or a multilayer. In the multilayer structure, the compound having a —NH— bond may be the same or different one.

The addition amount is preferably from 0.2 $g/m^2$ to $g/m^2$, more preferably from 0.5 $g/m^2$ to 2 $g/m^2$. In the case where the —NH— bond is included in the structure of the side chain or the main chain of the polymers, these can be used in much more amount. The added amount is preferably from 0.2 $g/m^2$ to 20 $g/m^2$, more preferably from 1 $g/m^2$ to 10 $g/m^2$.

2) Barrier Layer

As the method to prevent scattering of the volatile substances formed in the thermal development to the outside of the photothermographic material, it is preferred to arrange the barrier layer which has the ability to prevent the scattering to the outer layer rather than to the image forming layer. As the barrier layer, the polymers described in U.S. Pat. Nos. 6,352,819, 6,352,820 and 6,350,561, and the like, can be used.

It is preferred that the barrier layer contains at least one polymer selected from polyvinyl alcohol, polystyrene and the copolymer thereof, the copolymer of vinyl chloride and vinyl acetate, water soluble polyester and water insoluble polyester, gelatin and its derivatives and polyvinyl pyrrolidone. Especially preferred are polystyrene, vinyl acetate polymer and polyvinyl alcohol. As polystyrene, the average molecular weight is preferably more than 100,000. Here, the molecular weight means the number average molecular weight calculated by styrene converted value of the gel permeation chromatography (GCP) (hereinafter, all of the molecular weight described here mean the number average molecular weight.). As polyvinyl alchol, preferred is the highly crystallizable polyvinyl alchol having the saponification percent more than 88%.

More preferred is a crosslinkable polymer having more than two epoxy groups in a molecule as reaction groups. Preferred examples of this are preferably polystyrenes copolymerized with glycydyl acrylate and glycydyl methacrylate.

As the polyester, the water insoluble film forming polymer having a glass transition temperature (Tg) more than 150° C. and an average molecular weight more than 10,000 is preferred, and more preferably, a glass transition temperature(Tg) more than 170° C., and most preferably, more than 190° C. From the viewpoint of a film forming, it is necessary that Tg is kept less than 300° C. As a molecular weight, it is more preferably from 20,000 to 250,000.

Preferred are the aromatic polyesters which are water soluble and insoluble in organic solvent and can be prepared by the reaction with aromatic dibasic acids and dihydroxyphenols.

Examples of a dibasic acid include terephthalic acid, isophthalic acid, 2,5-dimethylterephthalic acid, 2,5-dibromoterephthalic acid and so on. It is especially preferred to use a mixture of terephthalic acid and isophthalic acid.

Examples of a dihydroxyphenol include 4,4'-(hexafluoroisopropylidene)diphenol (bisphenol AF) 4,4'-(isopropylidene)diphenol (bisphenol A), 4,4'-isopropylidene-2,2',6,6'-tetrachlorobisphenol, 4,4'-isopropylidene-2,2',6,6'-tetrabromobisphenol and so on. Among these, 4,4'-(hexafluoroisopropylidene)diphenol (bisphenol AF) is especially preferred.

Other preferred groups of a barrier layer are film forming polyacrylates and film forming polymethacrylates. These are easily prepared by the established methods using well-known acrylate monomer and methacrylate monomer.

A crosslinking polymer having more than two epoxy groups in a molecule as reaction groups is preferred. Preferred examples of the crosslinking polymer include polyacrylate and polymethacrylate which are copolymerized with glycydyl acrylate or glycydyl methacrylate. The average molecular weight is preferably from 8,000 to 250,000.

The barrier layer in the present invention can contain another polymer as long as it does not damage the film forming property. Examples of these polymers to be used together include cellulose derivatives, polyesters, polyurethanes. Preferred examples are cellulose esters, e.g., cellulose acetate, cellulose acetate butylate, hydroxymethyl cellulose, cellulose acetate propyonate and so on.

The mixture ratio is less than 95 wt % for the total barrier layers, preferably from 50 wt % to 75 wt %.

The barrier layer can contain additives, e.g., a surfactant, a lubricant, a hardner, a toning agent for the thermal development, an anti-irradiation dye and so on.

The thickness of a barrier layer is preferably from 0.2 μm to 10 μm to work that function, more preferably from 1 m to 5 μm and still more preferably from 1.5 μm to 3.0 μm.

The barrier layer can include the compound having a —NH— group as a trapping compound of volatile substances described before.

3) Others

It is preferred to use the barrier layer in combination with the layer having a trapping compound of the volatile substances described before, for the method to prevent volatilization. At this case, if these layers are situated farther than the image forming layer toward the support, the accumulative order of these layers on the support is unlimited.

5. Reducing Agent

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A 0803764 (p.7, line 34 to p. 18, line 12).

In the invention, a so-called hindered phenolic reducing agent or a bisphenol agent having a substituent at the ortho-position to the phenolic hydroxyl group is preferred and the bisphenolic reducing agent is more preferred. Particularly, the compound represented by the following general formula (R) is preferred.

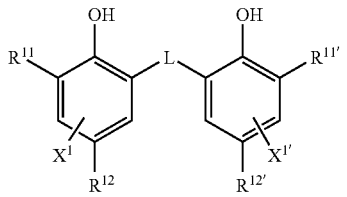

In the general formula (R), $R^{11}$ and $R^{11'}$ each independently represent an alkyl group having 1 to 20 carbon atoms. $R^{12}$ and $R^{12'}$ each independently represents a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. X and $X^1$ each independently represents a hydrogen atom or a group capable of substituting for a hydorgen atom on a benzene ring.

Each of the substituents is to be described specifically.

1) $R^{11}$ and $R^{11'}$ $R^{11}$ and $R^{11'}$ each independently represents a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, and halogen atom.

2) $R^{12}$ and $R^{12'}$, X and $X^1$ $R^{12}$ and $R^{12'}$ each independently represents a hydrogen atom or a group capable of substituting for a hydorgen atom on a benzene ring.

X and $X^1$ each independently represents a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent.

Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group.

Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represents, more preferably, tertiary alkyl group having 4 to 12 carbon atoms and, among them, t-butyl group, t-amyl group, 1-methylcyclohexyl group are further preferred, t-butyl group being most preferred.

$R^{12}$ and $R^{12'}$ are, preferably, alkyl groups having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

X and $X^1$ are, preferably, a hydrogen atom, halogen atom, or alkyl group, and more preferably, hydrogen atom.

L is preferably a group —$CHR^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represents, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represents preferably methyl group. As the primary or secondary alkyl group of 1 to 8 carbon atoms for $R^{13}$, methyl group, ethyl group, propyl group and isopropyl group are more preferred, and methyl group, ethyl group, and propyl group are further preferred.

In a case where each of $R^{11}$, $R^{11'}$ and $R^{12}$, $R^{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above show various different thermo-developing performance depending on the combination of $R^{11}$, $R^{11'}$ and $R^{12}$, $R^{12'}$, as well as $R^{13}$. Since the thermo-developing performances can be controlled by using two or more kinds of reducing agents at various mixing ratios, it is preferred to use two or more kinds of reducing agents in combination depending on the purpose.

Specific examples of the compounds represented by general formula (R) according to the invention are shown below but the invention is not restricted to them.

(R-1)

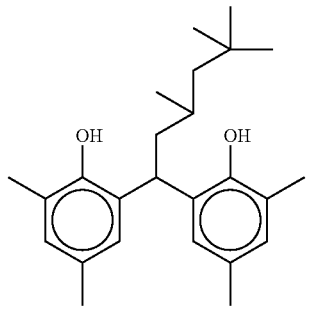

(R-2)

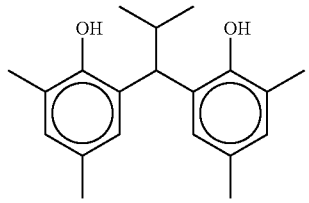

(R-3)

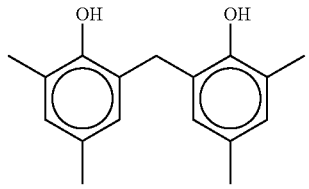

(R-4)

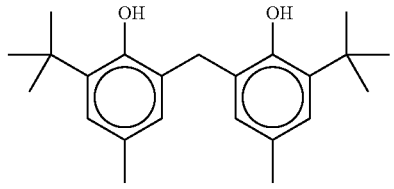

(R-5)

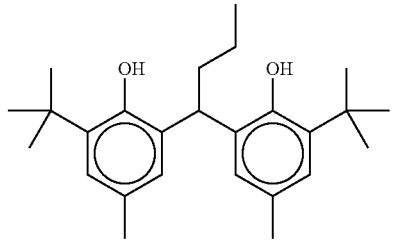

(R-6)

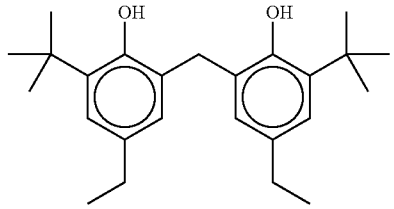

(R-7)

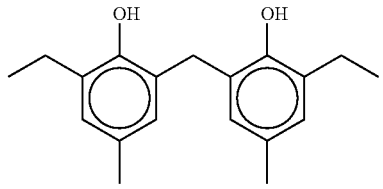

-continued
(R-8)
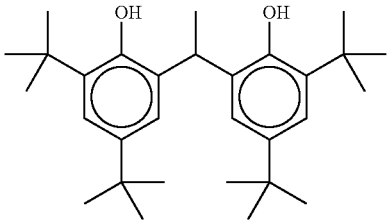
(R-9)
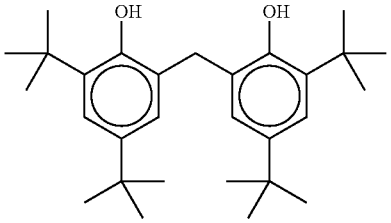
(R-10)
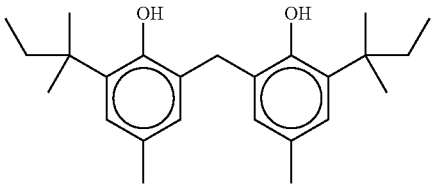
(R-11)
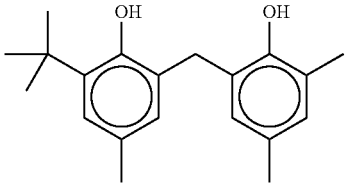
(R-12)
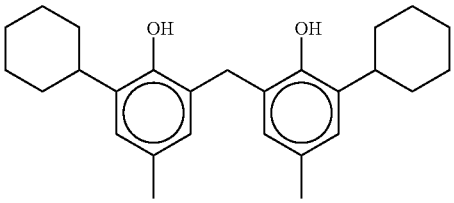
(R-13)
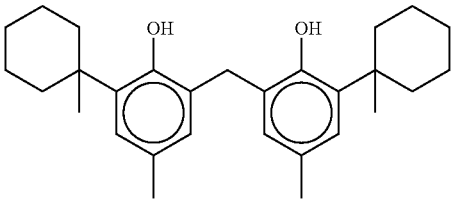
(R-14)
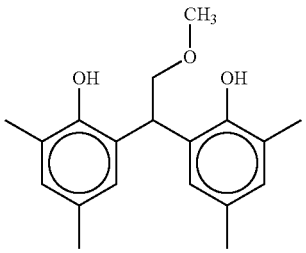
-continued
(R-15)
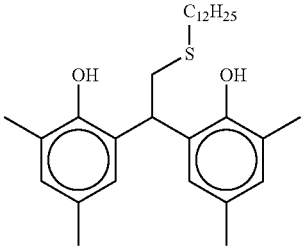
(R-16)
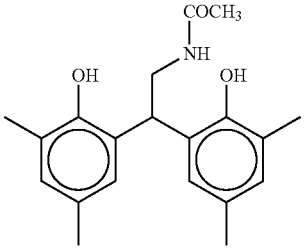
(R-17)
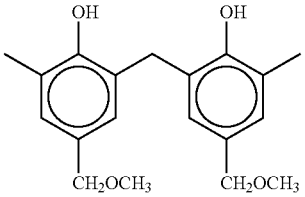
(R-18)
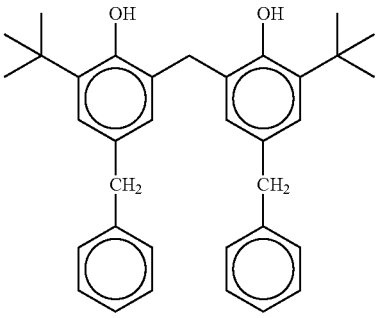
(R-19)
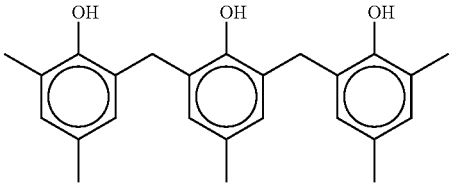
(R-20)
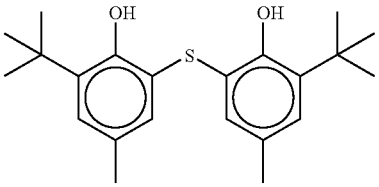

-continued (R-21)

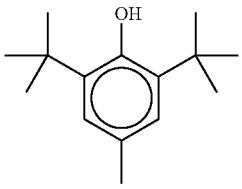

(R-22)

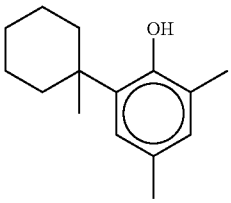

(R-23)

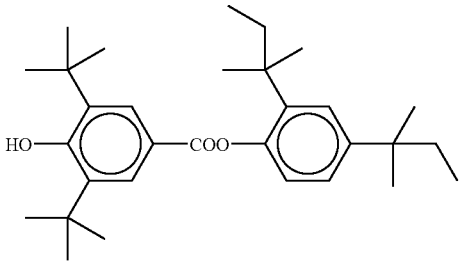

(R-24)

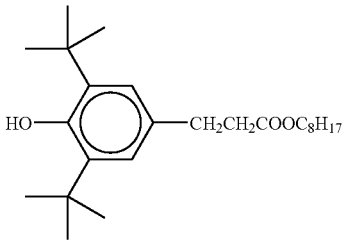

(R-25)

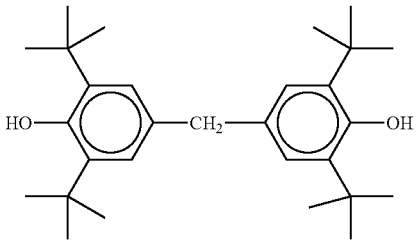

(R-26)

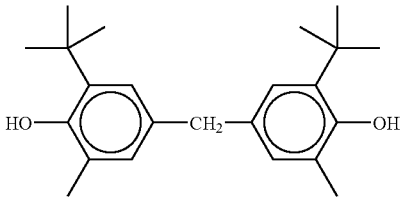

(R-27)

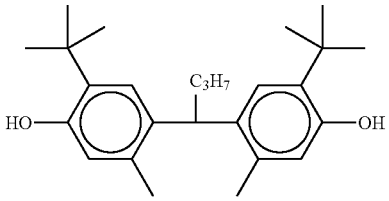

As preferred reducing agents of the invention other than those above, there can be mentioned compounds disclosed in JP-A Nos. 2001-188314, 2001-209145, 2001-350235, and 2002-156727.

In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3 g/m$^2$ to 1.0 g/m$^2$. It is, preferably, contained by 5 mol % to 50 mol % more preferably, 8 mol % to 30 mol % and, further preferably, 10 mol % to 20 mol % per one mol of silver in the image forming layer.

The reducing agent of the invention it is more preferably contained in the image forming layer.

In the invention, the reducing agent may be incorporated into photosensitive material by being added into the coating solution, such as in the form of a solution, an emulsion dispersion, a solid particle dispersion, and the like.

As a well known emulsion dispersion method, there can be mentioned a method comprising dissolving the thermal solvent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid particle dispersion method, there can be mentioned a method comprising dispersing the powder of the thermal solvent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surface active agent (for instance, an anionic surface active agent such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less with respect to 1 g of silver.

Preferably, a preservative (for instance, sodium benzoisothiazolinone salt) is added in the water dispersion.

In the invention, furthermore, the reducing agent is preferably used as solid dispersion, and is added in the form of fine particles having average particle size from 0.01 μm to 10 μm, and more preferably, from 0.05 μm to 5 μm and, further preferably, from 0.1 μm to 2 μm. In the invention, other solid dispersions are preferably used with this particle size range.

6. Antifoggant

As the antifoggant, stabilizer, and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

Organic polyhalogen compounds preferably used in the invention are specifically described below. In the invention, preferred polyhalogen compounds are the compounds expressed by general formula (H) below:

$$Q\text{-}(Y)_n\text{—}C(Z_1)(Z_2)X \qquad \text{General Formula (H)}$$

In general formula (H), Q represents an alkyl group, an aryl group, or a heterocyclic group; Y represents a divalent connecting group; n represents 0 or 1; $Z_1$ and $Z_2$ represent a halogen atom; and X represents hydrogen atom or an electron attracting group.

In general formula (H), Q is preferably an aryl group or a heterocyclic group.

In the case Q is a heterocyclic group in general formula (H), it preferably is a nitrogen-containing heterocyclic group having 1 or 2 nitrogen atoms, and particularly preferred are 2-pyridyl group and 2-quinolyl group.

In the case Q is an aryl group in general formula (H), Q preferably is a phenyl group substituted by an electron-attracting group whose Hammett substitution coefficient σp yields a positive value. For the details of Hammett substitution coefficient, reference can be made to Journal of Medicinal Chemistry, Vol. 16, No. 11 (1973), pp. 1207 to 1216, and the like. As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (σp value: 0.72)), an aliphatic aryl or heterocyclic acyl group (for example, acetyl (σp value: 0.50) and benzoyl (σp value: 0.43)), an alkinyl (e.g., C≡CH (σp value: 0.23)), an aliphatic aryl or heterocyclic oxycarbonyl group (e.g., methoxycarbonyl (σp value: 0.45) and phenoxycarbonyl (σp value: 0.44)), a carbamoyl group (σp value: 0.36), sulfamoyl group (σp value: 0.57), sulfoxido group, heterocyclic group, and phosphoryl group. Preferred range of the σp value is from 0.2 to 2.0, and more preferably, from 0.4 to 1.0. Preferred as the electron-attracting groups are carbamoyl group, an alkoxycarbonyl group, an alkylsulfonyl group, and an alkylphosphoryl group, and particularly preferred among them is carbamoyl group.

X preferably is an electron-attracting group, more preferably, a halogen atom, an aliphatic aryl or heterocyclic sulfonyl group, an aliphatic aryl or heterocyclic acyl group, an aliphatic aryl or heterocyclic oxycarbonyl group, carbamoyl group, or sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. n represents 0 or 1, and preferred is 1.

Specific examples of the compounds expressed by general formula (H) of the invention are shown below.

H-1

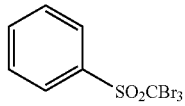

H-2

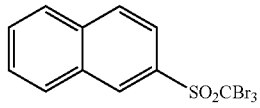

H-3

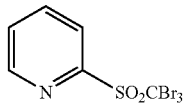

H-4

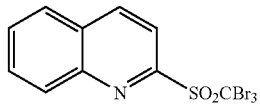

H-5

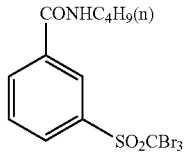

H-6

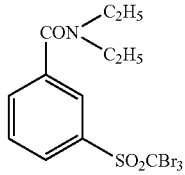

H-7

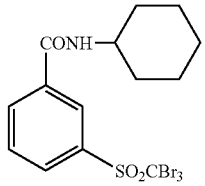

H-8

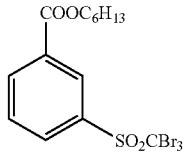

H-9

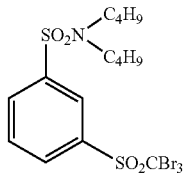

H-10

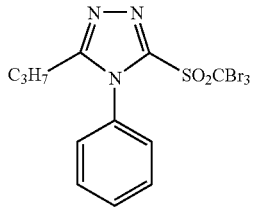

-continued

H-11

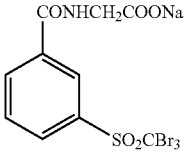

H-12

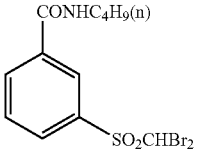

H-13

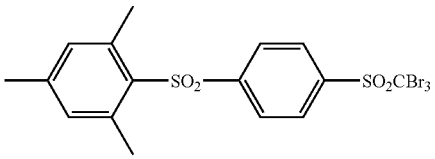

H-14

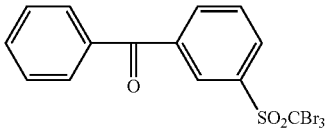

H-15

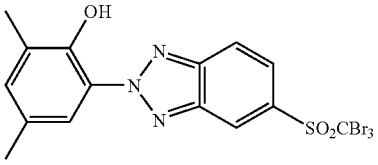

H-16

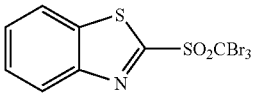

H-17

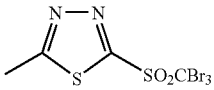

H-18

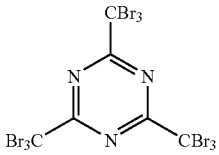

H-19

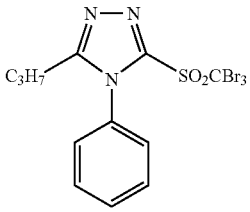

As preferred polyhalogen compounds of the invention other than those above, there can be mentioned compounds disclosed in JP-A Nos. 2001-31644, 2001-56526, and 2001-209145.

The compounds expressed by general formula (H) of the invention are preferably used in an amount of from $10^{-4}$ mol to 1 mol, more preferably, $10^{-3}$ mol to 0.5 mol, and most preferably, $1\times10^{-2}$ mol to 0.2 mol, per one mol of non-photosensitive silver salt incorporated in the image forming layer.

In the invention, usable methods for incorporating the antifoggant into the photosensitive material are those described above in the method for incorporating the reducing agent; similarly, for the organic polyhalogen compound, it is preferably added in the form of a solid particle dispersion.

2) Benzotriazole Compound

<Benzotriazole Compound Represented by General Formula (1)>

It is preferred that the photothermographic material of the present invention contains the benzotriazole compound described in the following general formula (1).

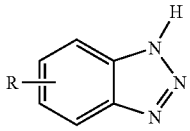

In general formula (1), R represents a hydrogen atom, an alkyl group having 1 to 4 carbon atoms, an aryl group, a halogen atom, an amino group, a nitro group, an alkoxycarbonyl group, a substituted or unsubstituted carboxylic acid group or a salt thereof and a sulfonic acid group or a salt thereof.

Examples of an alkyl group having 1 to 4 carbon atoms represented by R include a methyl group, an ethyl group and a butyl group. Examples of an aryl group include a phenyl group and so on. Examples of a halogen atom include a chlorine atom and a bromine atom and so on. Examples of a salt of carboxylic acid group or a sulfonic acid group include alkaline metal salts, e.g., a sodium salt, a potassium salt and so on.

Specific examples of a compound represented by general formula (1) used in the present invention are set forth below, however, the compound used in the present invention is not limited thereto.

1-1

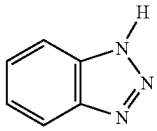

1-2

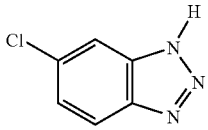

1-3

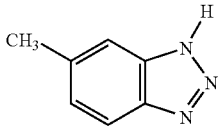

-continued 1-4

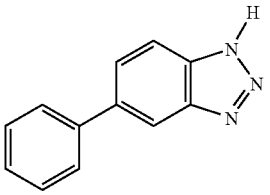

1-5

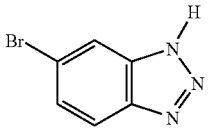

1-6

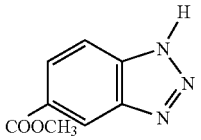

1-7

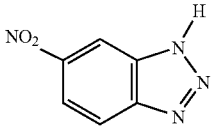

1-8

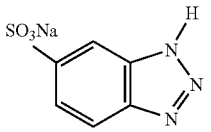

The compound represented by general formula (1) can be added to any layer as long as located on the side of the image forming layer toward the support, most preferably to the layer containing the photosensitive silver halide (hereafter this layer will be describe as "the image forming layer") or the layer adjacent to the image forming layer.

In order to add the compound represented by general formula (1) in these layers, the compound is dissolved to the coating solution directly or with the solvent, e.g., water, metylethylketone(MEK), alcohols and so on.

The addition amount of the compound represented by general formula (1) is from $10^{-4}$ mol to 1 mol per one mol of total silver, preferably from $10^{-3}$ mol to 0.1 mol per one mol of total silver.

The compound represented by general formula (1) can be added either only one kind or more than two kinds of compound.

<Benzotriazole Compound Represented by General Formula (2)>

It is preferred that the photothermographic material of the present invention contains the sulfonylbenzotriazole compound described in the following general formula (2).

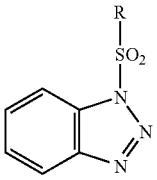

R represent an alkyl group or an alkenyl group having carbon atoms less than 20, preferably an alkyl group or an alkenyl group having carbon atoms less than 10, more preferably an alkyl group or an alkenyl group having carbon atoms less than 5; an aryl group, an alkaryl group or an aralkyl group having carbon atoms less than 20, preferably an aryl group, an alkaryl group or an aralkyl group having carbon atoms less than 10, more preferably an aryl group, an alkaryl group or an aralkyl group having carbon atoms less than 6; an aliphatic or an aromatic hetero ring group having ring atoms less than 6; and a carbon ring group having carbon atoms less than 6.

R can have further substituent itself. In the case where R is an alkyl group, an alkenyl group, a cycloalkyl group, an aryl group, an alkaryl group, an alarkyl group and an aliphatic or an aromatic hetero ring group, these groups can have further substituent. Non-limited typical examples include an alkyl group (e.g., a methyl group, an ethyl group, a propyl group, an iso-propyl group and so on); a halogen atom (e.g., fluorine, chlorine, bromine and iodine); an alkoxy or an aryloxy group (e.g., a methoxy group, an ethoxy group, a phenoxy group and so on); a nitro group, a cyano group, an alkylsulfonyl group, or an arylsulfonyl group and so on. These kinds of subsutituent and these synthetic methods are known among the people having general knowledge about organic chemistry. In the case where R is an aryl group like as a phenyl group and so on, it is particularly general.

Benzotriazole can have a substituent itself. Non-limited typical examples include an alkyl group (e.g., a methyl group, an ethyl group, a propyl group, an isopropyl group and so on); a halogen atom (e.g., fluorine, chlorine, bromine and iodine); an alkoxy or an aryloxy group (e.g., a methoxy group, an ethoxy group, a phenoxy group and so on); a nitro group, a cyano group, an alkylsulfonyl group, or an arylsulfonyl group and so on. These kinds of subsutituent and these synthetic methods are well known among the people having general knowledge about organic chemistry.

Preferred compounds represented by above general formula (2) are the compounds where R is an aryl group such as a phenyl group or a substituted phenyl group and so on.

Specific examples of the compound represented by general formula (2) are set forth below, however, the compound used in the present invention is not limited thereto.

2-1

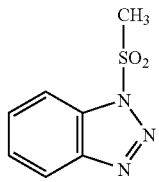

2-2

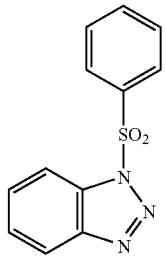

-continued 2-3

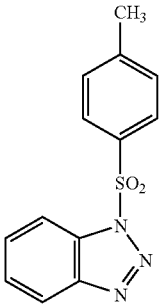

2-4

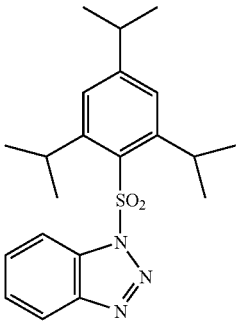

2-5

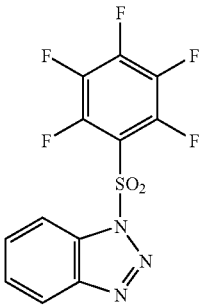

2-6

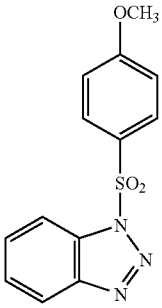

2-7

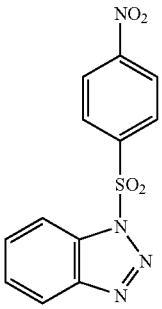

-continued 2-8

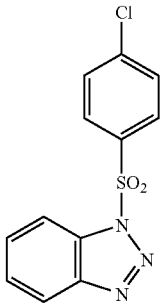

The compound represented by general formula (2) can be added to any layer as long as located on the side of the image forming layer toward the support, most preferably to the layer containing the photosensitive silver halide or the layer adjacent to the image forming layer.

In order to add the compound represented by general formula (2) in these layers, the compound is dissolved to the coating solution directly or with the solvent, e.g., water, metylethylketone(MEK), alcohols and so on.

The addition amount of the compound represented by general formula (2) is from $10^{-4}$ mol to 1 mol per one mol of total silver, preferably from $10^{-3}$ mol to 0.1 mol per one mol of total silver.

The compound represented by general formula (2) can be added either only one or more than two kinds of compound. Further more, the compound represented by general formula (2) can be added individually or together with the compound represented by general formula (1).

3) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by general formula (S) in JP-A No. 2000-221634, a triazine compound related to claim 9 of JP-A No. 11-352624, a compound expressed by general formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by general formula (XI) as described in JP-A No. 59-193447, a compound described in JP-B No. 55-12581, and a compound expressed by general formula (II) in JP-A No. 60-153039. The azolium salt may be added to any part of the photosensitive material, but as the addition layer, preferred is to select a layer on the side having thereon the photosensitive layer, and more preferred is to select a layer containing organic silver salt. The azolium salt may be added at any time of the process of preparing the coating solution; in the case the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, tone adjusting agents, and the like. In the invention, the azolium salt may be added at any amount, but preferably, it is added in a range of from $1\times10^{-6}$ mol to 2 mol, and more preferably, from $1\times10^{-3}$ mol to 0.5 mol per one mol of silver.

7. Development Accelerator

In the photothermographic material of the invention, sulfoneamide phenolic compounds represented by the general formula (A) described in the specification of JP-A No. 2000-267222, and specification of JP-A No. 2000-330234, hindered phenolic compound represented by the general formula (II) described in JP-A No. 2001-92075, hydrazine series compounds represented by general formula (I) described in the specification of JP-A No. 10-62895 and the specification of JP-A No. 11-15116, represented by general formula (D) of JP-A No. 2002-156727 and represented by general formula (1) described in the specification of Japanese Patent Application No. 2001-074278, and phenolic or naphthalic compounds represented by general formula (2) described in the specification of JP-A No. 2001-264929 are used preferably as the development accelerator and they are added preferably. The development accelerator described above is used within a range from 0.1 mol % to 20 mol %, preferably, within a range from 0.5 mol % to 10 mol % and, more preferably, within a range from 1 mol % to 5 mol % to the reducing agent. The introduction method to the photothermographic material can include, the same method as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use, among the development accelerators described above, hydrazine compounds represented by general formula (D) described in the specification of JP-A No. 2002-156727, and phenolic or naphtholic compounds represented by general formula (2) described in the specification of JP-A No. 2001-264929.

Particularly preferred development accelerators of the invention are compounds represented by the following general formulae (A-1) and (A-2).

$Q_1$-NHNH-$Q_2$ General Formula (A-1)

(in which $Q_1$ represents an aromatic group or heterocyclic group coupling at a carbon atom to —NHNH-$Q_2$ and $Q_2$ represents a carbamoyl group, acyl group, alkoxycarbonyl group, aryloxycarbonyl group, sulfonyl group or sulfamoyl group).

In general formula (A-1), the aromatic group or heterocyclic group represented by $Q_1$ is, preferably, 5 to 7 membered unsaturated rings. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituent groups, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substituting, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, of 6 to 40 carbon atoms, for example, not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl} carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, of 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably, of 1 to 50 carbon atoms and, more preferably, of 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably, having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substituting. In a case where the group has two or more substituents, such substituents may be identical or different with each other.

Then, preferred range for the compounds represented by formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

General formula (A-2)

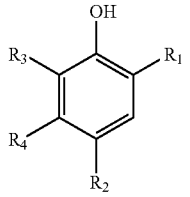

In general formula (A-2), $R_1$ represents an alkyl group, acyl group, acylamino group, sulfoneamide group, alkoxycarbonyl group, and carbamoyl group. $R_2$ represents a hydrogen atom, halogen atom, alkyl group, alkoxy group, aryloxy group, alkylthio group, arylthio group, acyloxy group and carbonate ester group. $R_3$, $R_4$ each represents a group capable of substituting for a hydrogen atom on a benzene ring which is mentioned as the example of the substituent for general formula (A-1). $R_3$ and $R_4$ may join to each other to form a condensed ring.

$R_1$ is, preferably, an alkyl group having 1 to 20 carbon atoms (for example, methyl group, ethyl group, isopropyl group, butyl group, tert-octyl group, or cyclohexyl group), acylamino group (for example, acetylamino group, benzoylamino group, methylureido group, or 4-cyanophenylureido group), carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), acylamino group (including ureido group or urethane group) being more preferred. $R_2$ is, preferably, a halogen atom (more preferably, chlorine atom, bromine atom), alkoxy group (for example, methoxy group, butoxy group, n-hexyloxy group, n-decyloxy group, cyclohexyloxy group or benzyloxy group), and aryloxy group (phenoxy group or naphthoxy group).

$R_3$ is, preferably a hydrogen atom, halogen atom or an alkyl group having 1 to 20 carbon atoms, the halogen atom being most preferred. $R_4$ is preferably a hydrogen atom, alkyl group or an acylamino group, with the alkyl group or the acylamino group being more preferred. Examples of the preferred substituent thereof are identical with those for $R_1$. In a case where $R_4$ is an acylamino group, $R_4$ may preferably be joined with $R_3$ to form a carbostyryl ring.

In a case where $R_3$ and $R_4$ in general formula (A-2) are joined to each other to form a condensed ring, a naphthalene ring is particularly preferred as the condensed ring. The same substituent as the example of the substituent referred to for general formula (A-1) may be joined to the naphthalene ring. In a case where the general formula (A-2) is a naphtholic compound, $R_1$, is, preferably, a carbamoyl group. Among them, benzoyl group is particularly preferred. $R_2$ is, preferably, an alkoxy group or aryloxy group and, particularly, preferably an alkoxy group.

Preferred specific examples for the development accelerator of the invention are to be described below. The invention is not restricted to them.

(A-1)

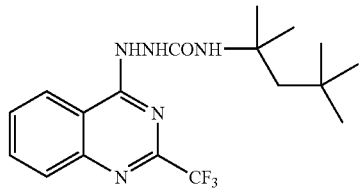

(A-2)

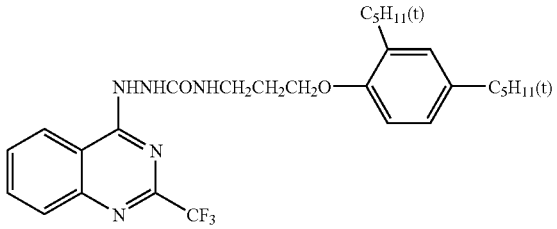

(A-3)

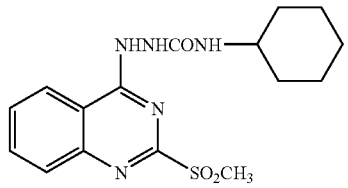

(A-4)

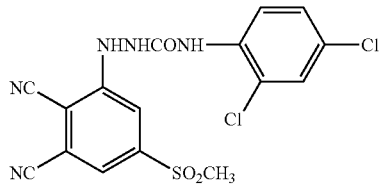

(A-5)

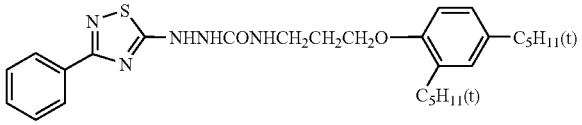

(A-6)

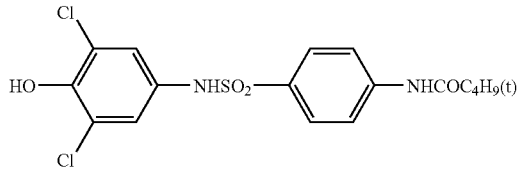

(A-7)

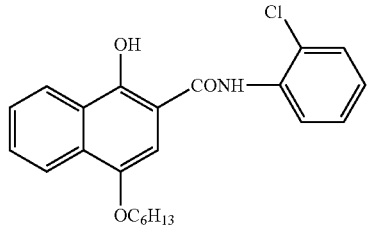

-continued (A-8)

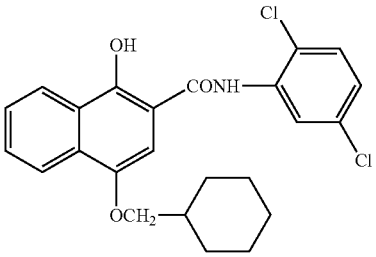

(A-9)

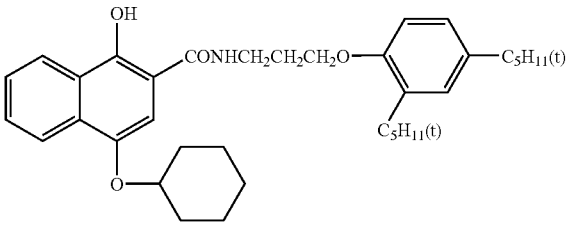

(A-10)

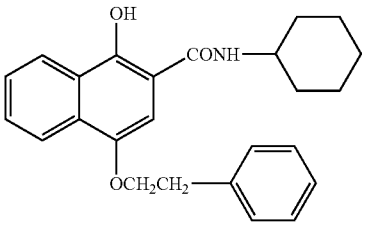

(A-11)

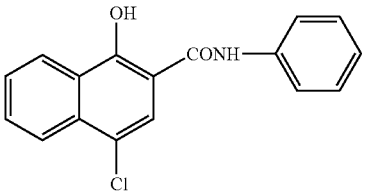

(A-12)

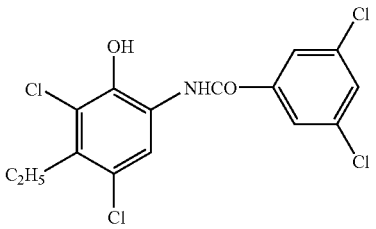

8. Thermal Solvent

The photothermographic material in the invention preferably, contains a thermal solvent. The thermal solvent is defined as a material capable of lowering the thermal development temperature by 1° C. or more with regard to the thermal solvent-containing photothermographic material, compared with the photothermographic material not containing the thermal solvent. Further preferably, this is the material capable of lowering the thermal development temperature by 2° C. or more and, particularly, capable of lowering the temperature by 3° C. or more. For the photothermographic material A containing the thermal solvent and the photothermographic material B not containing the thermal solvent, relative to the photothermographic material A, the material is defined as a thermal solvent when the thermal development temperature is 119° C. or lower for obtaining the density to be obtained by exposing the photothermographic material B and processing the same at a thermal development temperature of 120° C. for a thermal development time of 20 sec, by the photothermographic material A with the identical amount of exposure and thermal development time.

The thermal solvent of the invention has polar groups as substituent groups, and, though not limiting, those expressed by formula (S) are preferred.

$$(Y)_nZ \qquad \text{Formula (S)}$$

In formula (S), Y represents an alkyl group, an alkenyl group, an alkynyl group, an aryl group, or a heterocyclic group; Z represents a group selected from a hydroxyl group, a carboxyl group, an amino group, an amido group, a sulfoamido group, a phosphoamido group, a cyano group, an imido, an ureido, a sulfoxide, a sulfone, a phosphine, a phosphineoxide, or an nitrogen-containing heterocyclic group; n represents an integer from 1 to 3, which is 1 in the case Z is a monovalent group, and is the same as the valence of Z in the case Z is a divalent group or a group with higher valence. In the case n is a numeral 2 or higher, plural Y's may be the same or different.

Y may further contain a substituent group, and may have a group expressed by Z as the substituent group.

Y is explained in further detail below. In formula (S), Y may be a straight chain, a branched, or a cyclic alkyl group (preferably having 1 to 40 carbons, more preferably 1 to 30 carbons, and most preferably, 1 to 25 carbons; more specifically, there can be mentioned a methyl, an ethyl, an n-propyl, an iso-propyl, a sec-butyl, a t-butyl, a t-octyl, an n-amyl, a t-amyl, an n-dodecyl, an n-tridecyl, an octadecyl, an icosyl, a docosyl, a cyclopentyl, a cyclohexyl, and the like), an alkenyl group (preferably having 2 to 40 carbons, more preferably 2 to 30 carbons, and most preferably, 2 to 25 carbons; more specifically, there can be mentioned a vinyl, an allyl, a 2-butenyl, a 3-pentenyl, and the like), an aryl group (preferably having 6 to 40 carbons, more preferably 6 to 30 carbons, and most preferably, 6 to 25 carbons; more specifically, there can be mentioned a phenyl, a p-metylphenyl, a naphthyl, and the like), and a heterocyclic group (preferably having 2 to 20 carbons, more preferably 2 to 16 carbons, and most preferably, 2 to 12 carbons; more specifically, there can be mentioned a pyridyl, a pyradyl, an imidazoyl, a pyrrolisyl, and the like). These substituents may be further substituted by other substituents. Furthermore, these substituents may be combined with each other to form a ring.

Y may further contain substituents, and as examples of the substituents, there can be mentioned a halogen atom (a fluorine atom, a chlorine atom, a bromine atom, or an iodine atom), an alkyl group (a straight chain, a branched, or a cyclic alkyl group, inclusive of bicycloalkyl group and an active methine group), an alkenyl group, an alkynyl group, an aryl group, or a heterocyclic group (irrespective of the position of substitution), an acyl group, an alcoxylcarbonyl group, an aryloxycarbonyl group, a heterocyclic oxycarbonyl group, a carbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group or a salt thereof, an oxaryl group, an oxamoyl group, a cyano group, a carbonimidoyl group, a formyl group, a hydroxyl group, an alkoxy group (inclusive of a group containing a repetition of ethyleneoxy group or propyleneoxy group), an aryloxy group, a heterocyclic oxy group, an acyloxy group, (an alkoxy or aryloxy) carbonyloxy group, a carbamoyloxy group, a sulfonyloxy group, an amino group, (an alkyl, an aryl, or a heterocyclic) amino group, an acylamino group, a sulfonamido group, an ureido group, a thioureido group, an imido group, (an alkoxyl or an aryloxy) carbonylamino group, a sulfamoylamino group, a semicarbazido group, a thiosemicarbazido group, an ammonio group, an oxamoylamino group, an N-(alkyl or aryl) sulfonylureido group, an N-acylureido group, an N-acylsulfamoyl group, a nitro group, a heterocyclic group containing a tertialized nitrogen atom (for instance, a pyridinio group, an imidazolio group, a quinolinio group, an isoquinolinio group), an isocyano group, an imino group, a mercapto group, (an alkyl, an aryl, or a heterocyclic) thio group, (an alkyl, an aryl, or a heterocyclic) dithio group, (an alkyl or an aryl) sulfonyl group, (an alkyl or an aryl) sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, a silyl group, and the like. An active methine group herein signifies a methine group substituted by two electron-attracting groups, and an electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, or a carbonimidoyl group. The two electron-attracting groups may combine with each other to form a ring structure. A salt as referred herein signifies a cation such as that of an alkali metal, an alkaline earth metal, a heavy metal, and the like, or an organic cation such as an ammonium ion, phosphonium ion, and the like. These substituents may further be substituted by the substituents enumerated above. Y may further contain a group expressed by Z as a substituent.

As the reason why the thermal solvent shows the effect of the invention, it is believed that the thermal solvent melts at a temperature in the vicinity of the development temperature to show compatibility with the substance related with the development, and that it enables reaction at a temperature lower than the case no thermal solvent is added to the system. Thermal development is a reduction reaction in which carboxylic acids and silver ion carriers having relatively high polarity contribute to the reaction. Thus, it is preferred to incorporate a thermal solvent having polar groups to form a reaction field having an appropriate degree of polarity.

The melting point of the thermal solvent of the invention is in a range not lower than 50° C. but not higher than 200° C., but is preferably in a range not lower than 60° C. but not higher than 150° C. In the case of a photothermographic material in which stability of image storage and the like with respect to external environment is stressed, in particular, thermal solvent having a melting point in a range not lower than 100° C. but not higher than 150° C. is preferred.

Specific examples of thermal solvents of the invention are given below, but it should be understood that the invention is not limited thereto. Melting point of the solvent is given in parenthesis.

N-methyl-N-nitroso-p-toluenesulfonamide (61° C.), 1,8-octanediol (62° C.), phenyl benzoate (67° C.–71° C.), hydroquinone diethyl ether (67° C.–73° C.), ε-caprolactam (68° C.–70° C.), diphenyl phosphate (68° C.–70° C.), (±)-2-hydroxyoctanoic acid (68° C.–71° C.), (±)-3-hydroxydodecanoic acid (68° C.–71° C.), 5-chloro-2-methylbenzothiazole (68° C.–71° C.), β-naphthyl acetate (68° C.–71° C.), butyl alcohol (68° C.–73° C.), (±)-2-hydroxydecanoic acid (69° C.–72° C.), 2,2,2-trifluoroacetamide (69–72° C.), pyrazole (69° C.), (±)-2-hydroxyundecanoic acid (70° C.–73° C.), N,N-diphenyl formamide (71° C.–72° C.), dibenzyldisulfide (71° C.–72° C.), (±)-3-hydroxyundecanoic acid (71° C.–74° C.), 2,2'-dihydroxy-4-methoxybenzophenone (71° C.), 2,4-dinitrotoluene (71° C.), 2,4-dimethoxybenzaldehyde (71° C.), 2,6-di-t-butyl-4-methylphenol (71° C.), 2,6-dichlorobenzaldehyde (71° C.), diphenylsulfoxide (71° C.), stearic acid (71° C.), 2,5-dimethoxynitrobenzene (72° C.–73° C.), 1,10-decanediol (72° C.–74° C.), (R)-(−)-3-hydroxytetradecanoic acid (72° C.–75° C.), 2-tetradecylhexadecanoic acid (72° C.–75° C.), 2-methoxynaphthalene (72° C.–75° C.), methyl 3-hydroxy-2-naphthoate (72° C.–76° C.), tristearin (73.5° C.), dotriacontane (74° C.–75° C.), flavanone (74° C.–78° C.), 2,5-diphenyloxazole (74° C.), 8-quinolinol (74° C.), o-chlorobenzyl alcohol (74° C.), oleic acid amide (75° C.–76° C.), (±)-2-hydroxydodecanoic acid (75° C.–78° C.) n-hexatriacontane (75° C.–79° C.), iminodiacetonitrile (75° C.–79° C.), p-chlorobenzyl alcohol (75° C.), diphenyl diphthalate (75° C.), N-methylbenzamide (76° C.–78° C.), (±)-2-hydroxytridecanoic acid (76° C.–79° C.), 1,3-diphenyl-1,3-propanedione (76° C.–79° C.), N-methyl-p-toluenesulfonamide (76° C.–79° C.), 3'-nitroacetophenone (76° C.–80° C.), 4-phenylcyclohexanone (76° C.–80° C.), eicosanic acid (76° C.), 4-chlorobenzophenone (77° C.–78° C.), (±)-3-hydroxytetradecanoic acid (77° C.–80° C.), 2-hexadecyloctadecanoic acid (77° C.–80° C.), p-nitrophenyl acetate (77° C.–80° C.), 4'-nitroacetophenone (77° C.–81° C.), 12-hydroxystearic acid (77° C.), α,α'-dibromo-m-xylene (77° C.), 9-methylanthracene (78° C.–81° C.), 1,4-cyclohexanedione (78° C.), m-diethylaminophenol (78° C.), methyl m-nitrobenzoate (78° C.), (±)-2-hydroxytetradecanoic acid (79° C.–82° C.), 1-(phenylsulfonyl)indole (79° C.), di-p-tolylmethane (79° C.), propioneamide (79° C.), (±)-3-hydroxytridecanoic acid (80° C.–83° C.), guaiacol glycerin ether (80° C.–85° C.), octanoyl-N-methylglucamide (80° C.–90° C.), o-fluoroacetanilide (80° C.), acetanilide (80° C.), docosanoic acid (81° C.–82° C.), p-bromobenzophenone (81° C.), triphenylphosphine (81° C.), dibenzofuran (82.8° C.), (±)-2-hydroxypentadecanoic acid (82° C.–85° C.), 2-octadecyleicosanic acid (82° C.–85° C.), 1,12-dodecanediol (82° C.), methyl 3,4,5-trimethoxybenzoate (83° C.), p-chloronitrobenzene (83° C.), (±)-3-hydroxyhexadecanoic acid (84–85° C.), o-hydroxybenzyl alcohol (84° C.–86° C.), 1-triacontanol (84° C.–88° C.), o-aminobenzyl alcohol (84° C.), 4-methoxybenzyl acetate (84° C.), (±)-2-hydroxyhexadecanoic acid (85° C.–88° C.), m-dimethylaminophenol (85° C.), p-dibromobenzene (86° C.–87° C.), methyl 2,5-dihydroxybenzoate (86–88° C.), (±)-3-hydroxypentadecanoic acid (86–89° C.), 4-benzylbiphenyl (86° C.), p-fluorophenylacetic acid (86° C.), 1,14-tetradecanediol (87° C.–89° C.), 2,5-dimethyl-2,5-hexanediol (87° C.–90° C.), p-pentylbenzoic acid (87° C.–91° C.), α-(trichloromethyl)benzyl acetate (88° C.–89° C.), 4,4'-dimethylbenzoin (88° C.), diphenyl carbonate (88° C.), m-dinitrobenzene (89.57° C.), (3R,5R)-(+)-2,6-dimethyl-3,5-heptanediol (90° C.–93° C.), (3S,5S)-(−)-2,6-dimethyl-3,5-heptanediol (90° C.–93° C.), cyclohexanoneoxime (90° C.), p-bromoiodobenzene (91° C.–92° C.), 4,4'-dimethylbenzophenone (92° C.–95° C.), triphenylmethane (92° C.–95° C.), stearic acid anilide (92° C.–96° C.), p-hydroxyphenyl ethanol (92° C.), monoethylurea (92° C.), acenaphthylene (93.5° C.–94.5° C.), m-hydroxyacetophenone (93° C.–97° C.), xylitol (93° C.–97° C.), p-iodophenol (93° C.), methyl p-nitrobenzoate (94° C.–98° C.), p-nitrobenzyl alcohol (94° C.), 1,2,4-triacetoxybenzene (95° C.–100° C.), 3-acetylbenzonitrile (95° C.–103° C.), ethyl 2-cyano-3,3-diphenylacrylate (95° C.–97° C.), 16-hydroxyhexadecanoic acid (95° C.–99° C.), D(−)-ribose (95° C.), o-benzoylbenzoic acid (95° C.), α,α'-dibromo-o-xylene (95° C.), benzyl (95° C.), iodoacetamide (95° C.), n-propyl p-hydroxylbenzoate (96° C.–97° C.) flavone (96° C.–97° C.), 2-deoxy-D-ribose (96° C.–98° C.), lauryl gallate (96° C.–99° C.), 1-naphthol (96° C.), 2,7-dimethylnaphthalene (96° C.), 2-chlorophenylacetic acid (96° C.), acenaphthene (96° C.), dibenzyl terephthalate (96° C.), fumaronitrile (96° C.), 4'-amino-2',5-diethoxybenzanilide (97° C.–100° C.), phenoxyacetic acid (97° C.–100° C.), 2,5-dimethyl-3-hexyne-2,5-diol (97° C.), D-sorbitol (97° C.), m-aminobenzyl alcohol (97° C.), diethyl acetamidomalonate (97° C.), 1,10-phenanthroline monohydrate (98° C.–100° C.), 2-hydroxy-4-methoxy-4'-methylbenzophenone (98–100° C.), 2-bromo-4'-chloroacetophenone (98° C.), methylurea (98° C.), 4-phenoxyphthalonitrile (99° C.–100° C.), o-methoxybenzoic acid (99° C.–100° C.), p-butylbenzoic acid (99° C.–100° C.) xanthene (99° C.–100° C.), pentafluorobenzoic acid (99° C.–101° C.), phenanthrene (99° C.), p-t-butylphenol (100.4° C.) 9-fluorenylmethanol (100° C.–101° C.), 1,3-dimethylurea (100° C.–102° C.), 4-acetoxyindole (100° C.–102° C.), 1,3-cyclohexanedione (100° C.), stearic acid amide (100° C.) tri-m-tolylphosphine (100° C.), 4-biphenylmethanol (101–102° C.), 1,4-cyclohexanediol (mixture of cis- and trans-) (101° C.), α,α'-dichloro-p-xylene (101° C.), 2-t-butylanthraquinone (102° C.), dimethylfumaric acid (102° C.), 3,3-dimethylglutaric acid (103° C.–104° C.), 2-hydroxy-3-methyl-2-cyclopenten-1-one (103° C.), 4-chloro-3-nitroaniline (103° C.), N,N-diphenylacetamide (103° C.), 3(2)-t-butyl-4-hydroxyanisole (104° C.–105° C.), 4,4'-dimethylbenzyl (104° C.–105° C.), 2,2-bis(hydroxymethyl)-2,2',2"-nitrilotriethanol (104° C.), m-trifluoromethylbenzoic acid (104° C.), 3-pentanol (105° C.–108° C.), 2-methyl-1,4-naphthoquinone (105° C.), α,α,α',α'-tetrabromo-m-xylene (105° C.), 4-chlorophenylacetic acid (106° C.), 4,4'-difluorobenzophenone (107.5° C.–108.5° C.), 2,4-dichloro-1-naphthol (107° C.–108° C.), L-ascorbic acid palmitic acid ester (107° C.–117° C.), 2,4-dimethoxybenzoic acid (108° C.–109° C.), o-trifluoromethylbenzoic acid (108° C.–109° C.), p-hydroxyacetophenone (109° C.), dimethylsulfone (109° C.) 2,6-dimethylnaphthalene (110° C.–111° C.), 2,3,5,6-tetramethyl-1,4-benzoquinone (110° C.), tridecane diacid (110° C.), triphenylchloromethane (110° C.), fluoranthene (110° C.), laurylamide (110° C.), 1,4-benzoquinone (111° C.) 3-benzylindole (111° C.), resorcinol (111° C.), 1-bromomethane (112.3° C.), 2,2-bis(bromomethyl)-1,3-propanediol (112–114° C.), p-ethylbenzoic acid (113.5° C.), 1,4-diacetoxy-2-methylnaphthalene (113° C.), 1-ethyl-2,3-piperadinedione (113° C.), 4-methyl-2-nitroaniline (113° C.), L-ascorbic acid dipalmitic acid ester (113° C.), o-phenoxybenzoic acid (113° C.), p-nitrophenol (113° C.), methyl(diphenyl)phosphine oxide (113° C.), cholesterol acetate (114° C.–115° C.), 2,6-dimethylbenzoic acid (114° C.–116° C.), 3-nitrobenzonitrile (114° C.), m-nitroaniline (114° C.), ethyl α-D-glucoside (114° C.), acetanilide (115° C.–116° C.), (±)-2-phenoxypropionic acid (115° C.), 4-chloro-1-naphthol (116° C.–117° C.), p-nitrophenylacetonitrile (116° C.–117° C.), ethyl p-hydroxybenzoate (116° C.), p-isopropylbenzoic acid (117° C.–118° C.), D(+)-galactose (118° C.–120° C.), o-dinitrobenzene (118° C.), benzyl p-benzyloxybenzoate (118° C.), 1,3,5-tribromobenzene (119° C.), 2,3-dimethoxybenzoic acid (120° C.–122° C.), 4-chloro-2-methylphenoxyacetic acid (120° C.), meso-erythritol (121.5° C.), 9,10-dimethyl-1,2-benzanthracene (122° C.–123° C.), 2-naphthol (122° C.), N-phenylglycine (122° C.), bis(4-hydroxy-3-methylphenyl)sulfide (122° C.), p-hydroxybenzyl alcohol (124.5° C.–125.5° C.), 2',4'-dihydroxy-3'-propylacetophenone (124° C.–127° C.), 1,1-bis(4-hydroxyphenyl)ethane (124° C.), m-fluorobenzoic acid (124° C.), diphenylsulfone (124° C.), 2,2-dimethyl-3-hydroxypropionic acid (125° C.), 3,4,5-trimethoxycinnamic acid (125° C.), o-fluorobenzoic acid (126.5° C.), isonitrosoacetophenone (126–128° C.), 5-methyl-1,3-cyclohexanedione (126° C.), 4-benzoylbutyric acid (127° C.), methyl p-hydroxybenzoate (127° C.), p-bromonitrobenzene (127° C.), 3,4-dihydrocyphenylacetic acid (128° C.–130° C.), 5α-cholestane-3-one (128° C.–130° C.), 6-bromo-2-naphthol (128° C.), isobutylamide (128° C.), 1-naphthylacetic acid (129° C.), 2,2-dimethyl-1,3-propanediol (129° C.), p-diiodobenzene (129° C.), dodecane diacid (129° C.), 4,4'-dimethoxybenzyl (131° C.–133° C.), dimethylolurea (132.5° C.), o-ethoxybenzamide (132° C.–134° C.), cebacic acid (132° C.), p-toluenesulfonamide (134° C.), salicylanilide (135° C.), β-cytosterol (136–137° C.), 1,2,4,5-tetrachlorobenzene (136° C.), 1,3-bis(1-hydroxy-1-methylethyl)benzene (137° C.), phthalonitrile (138° C.), 4-n-propylbenzoic acid (139° C.), 2,4-dichlorophenoxyacetic acid (140.5° C.), 2-naphthylacetic acid (140° C.), methyl terephthalate (140° C.), 2,2-dimethylsuccinic acid (141° C.), 2,6-dichlorobenzonitrile (142.5° C.–143.5° C.), o-chlorobenzoic acid (142° C.), 1,2-bis(diphenylphosphino)ethane (143° C.–144° C.), α,α,α-tribromomethylphenylsulfone (143° C.), D(+)-xylose (144° C. -145° C.), phenylurea (146° C.), n-propyl gallate (146° C.), 4,4'-dichlorobenzophenone (147° C.–148° C.), 2',4'-dihydroxyacetophenone (147° C.), cholesterol (148.5° C.), 2-methyl-1-pentanol (148° C.), 4,4'-dichlorodiphenylsulfone (148° C.), diglycolic acid (148° C.), adipic acid (149° C.–150° C.), 2-deoxy-D-glucose (149° C.), diphenylacetic acid (149° C.), and o-bromobenzoic acid (150° C.).

In the invention, the thermal solvent is preferably added in a range of from 0.01 $g/m^2$ to 5.0 $g/m^2$, more preferably from 0.05 $g/m^2$ to 2.5 $g/m^2$, and most preferably, from 0.1 $g/m^2$ to 1.5 $g/m^2$. Preferably, the thermal solvent is incorporated in the image forming layer.

The thermal solvent may be used alone, but two or more types thereof may be added in combination.

In the invention, the thermal solvent may be incorporated into photosensitive material by being added into the coating solution, such as in the form of a solution, an emulsion dispersion, a solid particle dispersion, and the like.

As a well known emulsion dispersion method, there can be mentioned a method comprising dissolving the thermal solvent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid particle dispersion method, there can be mentioned a method comprising dispersing the powder of the thermal solvent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surface active agent (for instance, an anionic surface active agent such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in a range of from 1 ppm to 1000 ppm. It is practically acceptable so long as Zr is incorporated in an amount of 0.5 mg or less with respect to 1 g of silver.

Preferably, a preservative (for instance, sodium benzoisothiazolinone salt) is added in the water dispersion. In the invention, furthermore, the thermal solvent is preferably used as solid dispersion.

9. Hydrogen Bonding Compound

In the invention, it is preferred to use in combination, a non-reducing compound having a group capable of reacting with an aromatic hydroxyl group (—OH) of the reducing agent group, and that is also capable of forming a hydrogen bond therewith. As a group forming a hydrogen bond with a hydroxyl groups, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferred as the hydrogen-bonding compound is the compound expressed by general formula (D) shown below.

General formula (D)

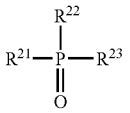

In general formula (D), $R^{21}$ to $R^{23}$ each independently represent an alkyl group, an aryl group, an alkoxy group, an aryloxy group, an amino group, or a heterocyclic group, which may be substituted or not substituted. In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like. As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like. As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like. As aryloxy groups, there can be mentioned phenoxy group, cresyloxy group, isopropylphenoxy group, 4-t-butylphenoxy group, naphthoxy group, biphenyloxy group, and the like. As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by general formula (D) of the invention and others are shown below, but it should be understood that the invention is not limited thereto.

(D-1)

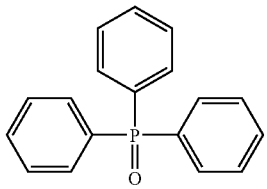

(D-2)

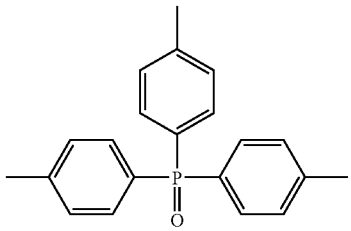

(D-3)

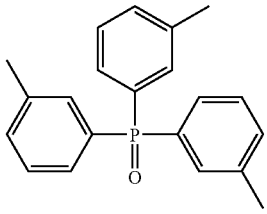

(D-4)

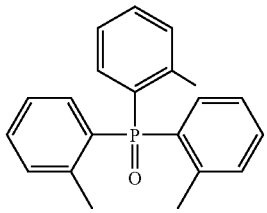

(D-5)

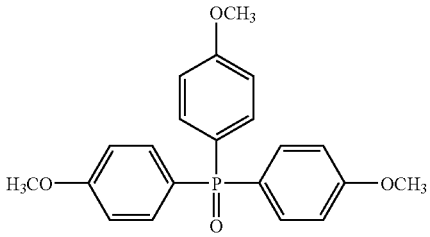

-continued
(D-6)
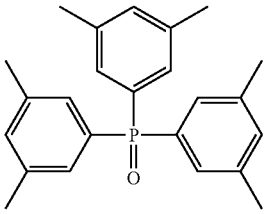
(D-7)
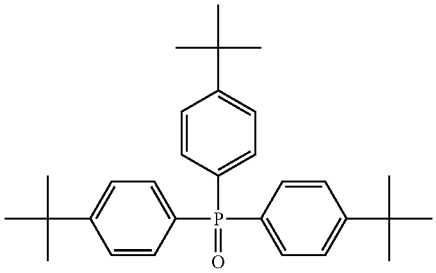
(D-8)
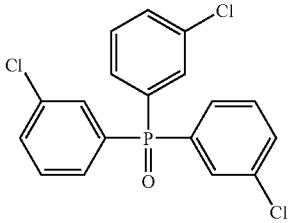
(D-9)
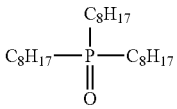
(D-10)
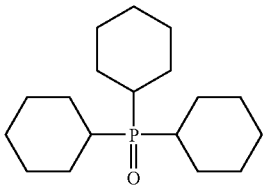
(D-11)
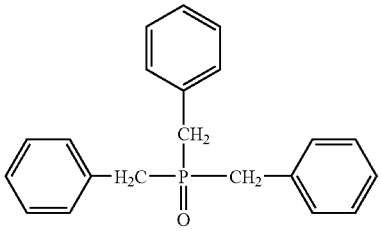
(D-12)
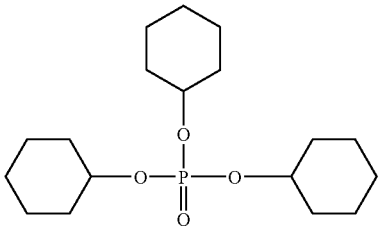
-continued
(D-13)
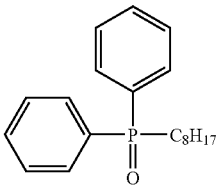
(D-14)
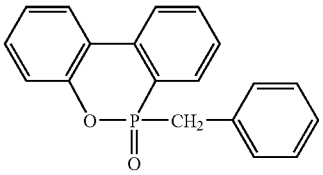
(D-15)
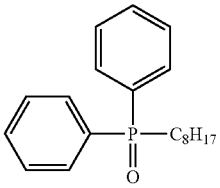
(D-16)
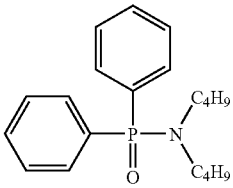
(D-17)
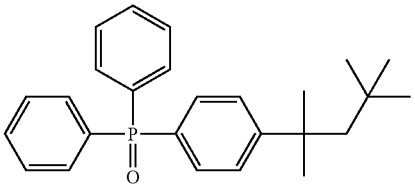
(D-18)
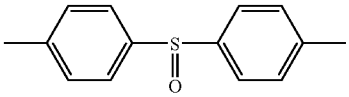
(D-19)
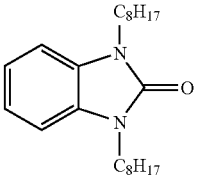
(D-20)
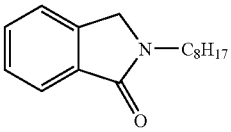
(D-21)
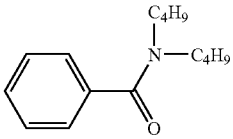

Specific examples of hydrogen bonding compounds other than those enumerated above can be found in those described in EP-A No. 1096310 and in Japanese Patent Application Nos. 2000-270498 and 2001-124796.

The compound expressed by general formula (D) used in the invention can be used in the photosensitive material by being incorporated into the coating solution in the form of solution, emulsion dispersion, or solid-dispersed fine particle dispersion similar to the case of reducing agent, however, it is preferred to be used after it is prepared in the form of solution. In the solution, the compound expressed by general formula (D) forms a hydrogen-bonded complex with a compound having a phenolic hydroxyl group, and can be isolated as a complex in crystalline state depending on the combination of the reducing agent and the compound expressed by general formula (D). It is particularly preferred to use the crystal powder thus isolated in the form of a solution by dissolving it into a coating solvent, because it provides stable performance.

The compound expressed by general formula (D) is preferably used in a range of from 1 to 200 mol %, more preferably from 10 to 150 mol %, and most preferably, from 20 to 100 mol %, with respect to the reducing agent.

10. Binder

Any type of polymer may be used as the binder for the image forming layer in the photosensitive material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly (vinyl alcohol), hydroxyethyl cellulose, cellulose acetate, cellulose acetate butyrate, poly (vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal)(e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide).

If necessary, two or more binders may be used. In such a case, two types or more of polymers differing in glass transition temperature (which is denoted Tg hereinafter) may be blended for use.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition)(Wiley-Interscience, 1989).

1) Binder for Organic Solvents

In the case the binder is applied by using the following organic solvents, any of those below can be selected: polyvinyl acetal, polyvinyl chloride, polyvinyl acetate, cellulose acetate, polyolefin, polyester, polystyrene, polyacrylonitrile, polycarbonate, polyvinyl butyral, butylethyl cellulose, metacrylate copolymer, maleic anhydride ester copolymers, polystyrene and butadiene-styrene copolymers, and the like.

In the image forming layer, in particular, polyvinyl butyral is preferably incorporated as the binder. More specifically, polyvinyl butyral is added as a binder to account for 50% by weight or more with respect to the total composition of the binder for the image forming layer. As a matter of fact, copolymers and terpolymers are also included. The preferred total content of polyvinyl butyral is in a range of 50% by weight to 100% by weight, more preferably, is in a range of 70% by weight to 100% by weight, with respect to the total composition of the binder incorporated in the image forming layer. The Tg of the binder is preferably in a range of from 40 to 90° C., and more preferably, from 50 to 80° C. In the case two types or more of polymers differing in Tg are used in blends, the weight average Tg preferably falls in the above range.

The total amount of the binders is such that, for instance, the component of the image forming layer can be sufficiently maintained within the layer. That is, the binders are used in an amount effective to function as binder. The effective range can be properly determined by those skilled in the art. In the case of holding at least an organic silver salt, the suitable ratio of binders to an orgagnic silver salts is from 15:1 to 1:3, particularly preferably, from 8:1 to 1:2 by weight.

Specific examples of solvents can be found in Solvent Pocket Book (new edition) (Ohm Publishing, 1994), but the invention is not limited thereto. Furthermore, the boiling point of the solvents used in the invention is preferably in a range of 40° C. to 180° C. As examples of the solvents, specifically mentioned are hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, metyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, water, and the like. Among them, methyl ethyl ketone is preferably used, because it has favorable boiling point and is capable of providing uniform coated film plane with less load of drying and with less solvent residues.

After coating and drying, it is preferred that the solvent used for the coating remains less in the film. In general, residual solvent volatilizes into the environment on exposing or thermal developing the photothermographic material, which not only makes people uncomfortable but also is harmful to the health.

In the case of using MEK in the invention, the residual amount of MEK is preferably in a range of from 0.1 $mg/m^2$ to 150 $mg/m^2$, more preferably, from 0.1 $mg/m^2$ to 80 $mg/m^2$, and most preferably, from 0.1 $mg/m^2$ to 40 $mg/m^2$.

2) Binder for Water Solvent

In the case the layer containing organic silver salt is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

$$\text{Equilibrium water content under 25° C. and 60\% } RH=[(W1-W0)/W0]\times 100 \text{ (\% by weight)}$$

where, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in a range of from 1 to 50,000 nm, preferably 5 nm to 1,000 nm, more preferably, 10 nm to 500 nm, and most preferably, 50 nm to 200 nm. There is no particular limitations concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1000,000, preferably from 10,000 to 200,000. Those having too small molecular weight exhibit insufficient mechanical strength on forming the image forming layer, and those having too large molecular weight are also not preferred because the filming properties result poor. Further, crosslinking polymer latexes are particularly preferred for use.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

Particularly preferred as the polymer latex for use in the invention is that of styrene-butadiene copolymer. The weight ratio of monomer unit for styrene to that of butadiene constituting the styrene-butadiene copolymer is preferably in a range of from 40:60 to 95:5. Further, the monomer unit of styrene and that of butadiene preferably accounts for 60 to 99% by weight with respect to the copolymer. Moreover, the polymer latex of the invention contains acrylic acid or methacrylic acid, preferably, for 1 to 6% by weight, and more preferably, for 2 to 5% by weight, with respect to the total mass of the monomer unit of styrene and that of butadiene. The polymer latex of the invention preferably contains acrylic acid. The preferred range of the molecular weight is the same as that described above.

As the latex of styrene-butadiene copolymer preferably used in the invention, there can be mentioned P-3 to P-8 and P-15, or commercially available LACSTAR-3307B, 7132C, Nipol Lx416, and the like.

In the layer containing organic silver salt of the photosensitive material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the layer containing organic silver salt.

The layer containing organic silver salt is, in general, a photosensitive layer (image forming layer) containing a photosensitive silver halide, i.e., the photosensitive silver salt; in such a case, the weight ratio for total binder to silver halide is in a range of from 400 to 5, more preferably, from 200 to 10.

In the case water solvent is used for the preparation, the total binder content in the image forming layer is preferably in a range of from 0.2 g/m$^2$ to 30 g/m$^2$, more preferably from 1 g/m$^2$ to 15 g/m$^2$, and most preferably, from 2 g/m$^2$ to 10 g/m$^2$. In the image forming layer of the invention, there may be added a crosslinking agent for crosslinking, or a surface active agent and the like to improve coating properties.

11. Surface Active Agent

As the surface active agent, the solvent, the support, antistatic agent or the electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573 and in paragraph Nos. 0049 to 0062 of Japanese Patent Application No. 11-106881.

In the invention, preferably used are fluorocarbon surface active agent. Specific examples of fluorocarbon surface active agents can be found in those described in JP-A Nos. 10-197985, 2000-19680, and 2000-214554. Polymer fluorocarbon surface active agents described in JP-A 9-281636 can be also used preferably. For the photothermographic material in the invention, the fluorocarbon surface active agents described in JP-A Nos. 2002-82411, 2001-242357, and 2001-264110 are preferably used. Especially, the usage of the fluorocarbon surface active agents described in JP-A Nos. 2001-242357 and 2001-264110 in an aqueous coating solution is preferred viewed from the standpoint of capacity in static control, stability of the coating side state and sliding facility. The fluorocarbon surface active agent described in JP-A No. 2001-264110 is mostly preferred because of high capacity in static control and that it needs small amount to use.

According to the invention, the fluorocarbon surface active agent can be used on either side of image forming layer side or back layer side, but is preferred to use on the both sides. Further, it is particularly preferred to use in combination with electrically conductive layer including aforementioned metal oxides. In this case the amount of the fluorocarbon surface active agent on the side of the electrically conductive layer can be reduced or removed.

The amount of the fluorocarbon surface active agent used is preferably in the range of 0.1 mg/m$^2$ to 100 mg/m$^2$ on each side of image forming layer and back layer, more preferably 0.3 mg/m$^2$ to 30 mg/m$^2$, further preferably 1 mg/m$^2$ to 10 mg/m$^2$. Especially, the fluorocarbon surface active agent described in JP-A No. 2001-264110 is effective, and used preferably in the range of 0.01 mg/m$^2$ to 10 mg/m$^2$, more preferably 0.01 mg/m$^2$ to 5 Mg/m$^2$.

12. Toner

In the photothermographic material of the present invention, the addition of a toner is preferred. The description of the toner can be found in JP-A No.10-62899 (paragraph Nos. 0054 to 0055), EP-A No.0803764A1 (page21, lines 23 to 48), JP-A Nos.2000-356317 and 2000-187298. Particularly preferred are phthalazinones (phthalazinone, phthalazinone derivatives and metal salts thereof, e.g., 4-(1-naphthyl) phthalazinone, 6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine). In the iodide rich silver halide, particularly preferred is a combination of phthalazines and phthalic acids.

In the present invention, a high speed transportation process and a developing apparatus in which the distance between the exposing section and the developing section is short are used. For these reasons, there is a possibility that phtalazines causes a contaminant as volatiles and contaminates around the exposing section, around the developing section and phothothermographic material itself. To prevent this contamination, it is preferred to use the phtalazines represented by the following general formula (I).

General Formula (I)

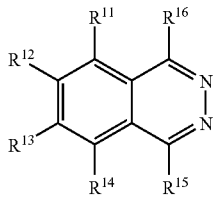

$R^{11}$, $R^{12}$, $R^{13}$, $R^{14}$, $R^{15}$ and $R^{16}$ each independently represents a hydrogen atom or mono valent substituent which may combine each other to form a ring. But, all of $R^{11}$, $R^{12}$, $R^{13}$ $R^{14}$ $R^{15}$ and $R^{16}$ can not be hydrogen atoms. Examples of substituents are an alkyl group (preferably an alkyl group having 1 to 20 carbon atoms, more preferably an alkyl group having 1 to 12 carbon atoms, most preferably an alkyl group having 1 to 8 carbon atoms; e.g., a methyl group, an ethyl group, a n-propyl group, an iso-propyl group, a n-butyl group, a sec-butyl group, an iso-butyl group, a tert-butyl group, a n-pentyl group, a-tert-pentyl group, a n-hexyl group, a n-octyl group, a n-decyl group, a n-hexadecyl group, a cyclopropyl group, a cyclopentyl group, a cyclohexyl group, a benzyl group and so on), an alkenyl group, (preferably an alkenyl group having 2 to 20 carbon atoms, more preferably an alkenyl group having 2 to 12 carbon atoms, most preferably an alkenyl group having 2 to 8 carbon atoms; e.g., a vinyl group, an allyl group, a 2-butenyl group, a 3-pentenyl group and so on), an alkynyl group (preferably an alkynyl group having 2 to 20 carbon atoms, more preferably an alkynyl group having 2 to 12 carbon atoms, most preferably an alkynyl group having 2 to 8 carbon atoms; e.g., a propargyl group, a 3-pentynyl group and so on), an aryl group (preferably an aryl group having 6 to 30 carbon atoms, more preferably an aryl group having 6 to 20 carbon atoms, most preferably an aryl group having 6 to 12 carbon atoms; e.g., a phenyl group, a p-methylphenyl group, a naphthyl group and so on), an amino group (preferably an amino group having 0 to 20 carbon atoms, more preferably an amino group having 0 to 10 carbon atoms, most preferably an amino group having 0 to 6 carbon atoms; e.g., an amino group, a methylamino group, a dimethylamino group, a diethylamino group, a dibenzylamino group and so on), an alkoxy group (preferably an alkoxy group having 1 to 20 carbon atoms, more preferably an alkoxy group having 1 to 12 carbon atoms, most preferably an alkoxy group having 1 to 8 carbon atoms; e.g., a methoxy group, an ethoxy group, an iso-propoxy group, a butoxy group and so on), an aryloxy group (preferably an aryloxy group having 6 to 20 carbon atoms, more preferably an aryloxy group having 6 to 16 carbon atoms, most preferably an aryloxy group having 6 to 12 carbon atoms; e.g., a phenyloxy group, a 2-naphthyloxy group and so on), an acyl group (preferably an acyl group having 1 to 20 carbon atoms, more preferably an acyl group having 1 to 16 carbon atoms, most preferably an acyl group having 1 to 12 carbon atoms; e.g., an acetyl group, a benzoyl group, a formyl group, a pivaloyl group and so on), an alkoxycarbonyl group (preferably an alkoxycarbonyl group having 2 to 20 carbon atoms, more preferably an alkoxycarbonyl group having 2 to 16 carbon atoms, most preferably an alkoxycarbonyl group having 2 to 12 carbon atoms; e.g., a methoxycarbonyl group, an ethoxycarbonyl group and so on), an aryloxycarbonyl group (preferably an aryloxycarbonyl group having 7 to 20 carbon atoms, more preferably an aryloxycarbonyl group having 7 to 16 carbon atoms, most preferably an aryloxycarbonyl group having 7 to 10 carbon atoms; e.g., a phenyloxycarbonyl group and so on), an acyloxy group (preferably an acyloxy group having 2 to 20 carbon atoms, more preferably an acyloxy group having 2 to 16 carbon atoms, most preferably an acyloxy group having 2 to 12 carbon atoms; e.g., an acetoxy group, a benzoyloxy group and so on), an acylamino group (preferably an acylamino group having 2 to 20 carbon atoms, more preferably an acylamino group having 2 to 16 carbon atoms, most preferably an acylamino group having 2 to 10 carbon atoms; e.g., an acetylamino group, a benzoylamino group and so on), an alkoxycarbonylamino group (preferably an alkoxycarbonylamino group having 2 to 20 carbon atoms, more preferably an alkoxycarbonylamino group having 2 to 16 carbon atoms, most preferably an alkoxycarbonylamino group having 2 to 12 carbon atoms; e.g., a methoxycarbonylamino group and so on), an aryloxycarbonylamino group (preferably an aryloxycarbonylamino group having 7 to 20 carbon atoms, more preferably an aryloxycarbonylamino group having 7 to 16 carbon atoms, most preferably an aryloxycarbonylamino group having 7 to 12 carbon atoms; e.g., a phenyloxycarbonylamino group and so on), a sulfonylamino group (preferably a sulfonylamino group having 1 to 20 carbon atoms, more preferably a sulfonylamino group having 1 to 16 carbon atoms, most preferably a sulfonylamino group having 1 to 12 carbon atoms; e.g., a methanesulfonylamino group, a benzenesulfonylamino group and so on), a sulfamoyl group (preferably a sulfamoyl group having 0 to 20 carbon atoms, more preferably a sulfamoyl group having 0 to 16 carbon atoms, most preferably a sulfamoyl group having 0 to 12 carbon atoms; e.g., a sulfamoyl group, a methylsulfamoyl group, a dimethylsulfamoyl group, a phenylsulfamoyl group and so on), a carbamoyl group (preferably a carbamoyl group having 1 to 20 carbon atoms, more preferably a carbamoyl group having 1 to 16 carbon atoms, most preferably a carbamoyl group having 1 to 12 carbon atoms; e.g., a carbamoyl group, a methylcarbamoyl group, a diethylcarbamoyl group, a phenylcarbamoyl group and so on), an alkylthio group (preferably an alkylthio group having 1 to 20 carbon atoms, more preferably an alkylthio group having 1 to 16 carbon atoms, most preferably an alkylthio group having 1 to 12 carbon atoms; e.g., a methylthio group, an ethylthio group and so on), an arylthio group (preferably an arylthio group having 6 to 20 carbon atoms, more preferably an arylthio group having 6 to 16 carbon atoms, most preferably an arylthio group having 6 to 12 carbon atoms; e.g., a phenylthio group and so on), a sulfonyl group (preferably a sulfonyl group having 1 to 20 carbon atoms, more preferably a sulfonyl group having 1 to 16 carbon atoms, most preferably a sulfonyl group having 1 to 12 carbon atoms; e.g., a mesyl group, a tosyl group and so on), a sulfinyl group (preferably a sulfinyl group having 1 to 20 carbon atoms, more preferably a sulfinyl group having 1 to 16 carbon atoms, most preferably a sulfinyl group having 1 to 12 carbon atoms; e.g., a methanesulfinyl group, a benzenesulfinyl group and so on), an ureido group (preferably an ureido group having 1 to 20 carbon atoms, more preferably an ureido group having 1 to 16 carbon atoms, most preferably an ureido group having 1 to 12 carbon atoms; e.g., an ureido group, a methylureido group, a phenylureido group and so on), a phosphoramido group (preferably a phosphoramido group having 1 to 20 carbon atoms, more preferably a phosphoramido group having 1 to 16 carbon atoms, most preferably a phosphoramido group having 1 to 12 carbon atoms; e.g., a diethylphosphoramide group, a phenylphosphoramide group and so on), a hydroxy group, a mercapto group, a halogen atom (e.g., a fluorine atom, a chlorine atom, a bromine atom and an iodine atom), a cyano group, a sulfo group a carboxyl group, a nitro group, a hydroxamic acid group, a sulfino group, a hydrazino group and a hetero ring group (e.g., an imidazolyl group, a pyridyl group, a furyl group, a pyperidyl group, a morpholino group, a thienyl group and so on) and so on. These substituents can be more substituted by another substituents and the substituents having a capability of salt formation, can form a salt thereof. Examples of the ring formed by binding of $R^{11}$ to $R^{16}$ include a dioxolene ring and a benzene ring and so on.

In the present invention, preferred substituents of $R^{11}$, $R^{12}$, $R^{13}$ and $R^{14}$ in general formula (I) include a hydrogen atom, an alkyl group, an aryl group, a halogen atom and an acyl group. More preferred substituents include a hydrogen atom, an alkyl group, an aryl group and an acyl group and particularly preferred compounds include a hydrogen atom and an alkyl group. For $R^{15}$ and $R^{16}$, a hydrogen atom is preferred.

Examples represented by general formula (I) of the present invention can be prepared easily by the relevant trader with the known method described in R. G. Elderfield, "Heterocyclic Compounds", John Wiley and Sons, Vol. 1–9, (1950–1967) or A. R. Katritzky, "Comprehensive Heterocyclic Chemistry", Pergamon Press,(1984) and so on.

Specific examples of general formula (I) of the present invention are set forth below, however, the present invention is not limited to these specific examples.

(I-1)

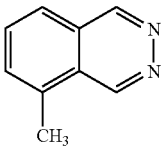

(I-2)

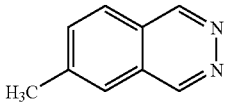

(I-3)

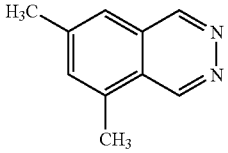

(I-4)

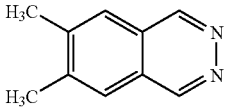

(I-5)

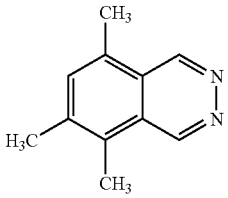

(I-6)

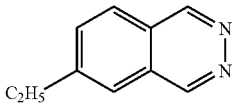

-continued (I-7)

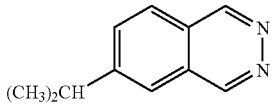

(I-8)

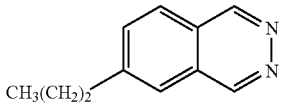

(I-9)

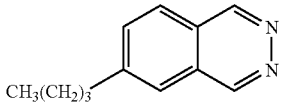

(I-10)

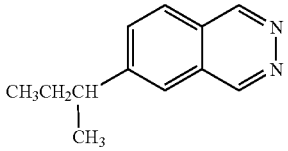

(I-11)

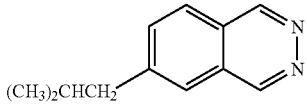

(I-12)

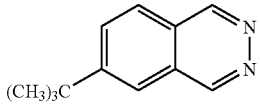

(I-13)

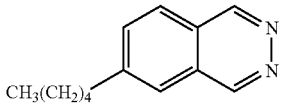

(I-14)

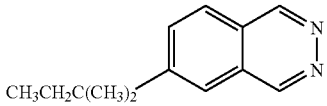

(I-15)

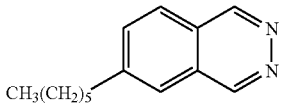

(I-16)

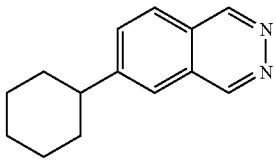

(I-17)

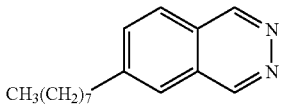

(I-18)

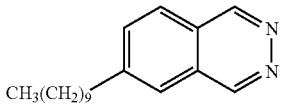

-continued
(I-19)
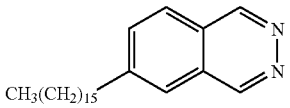
(I-20)
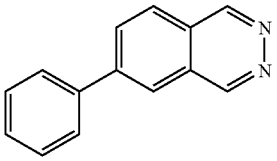
(I-21)
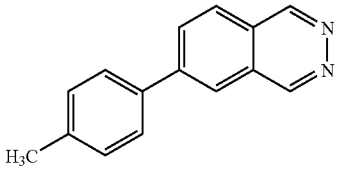
(I-22)
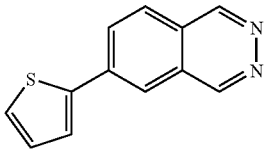
(I-23)
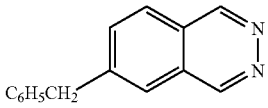
(I-24)
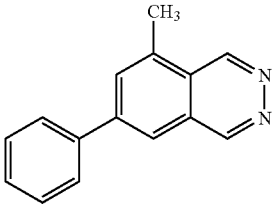
(I-25)
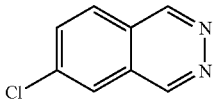
(I-26)
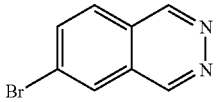
(I-27)
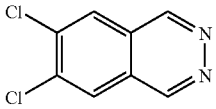
(I-28)
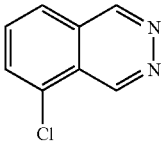
-continued
(I-29)
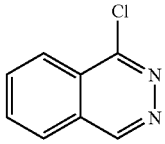
(I-30)
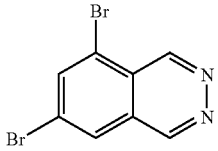
(I-31)
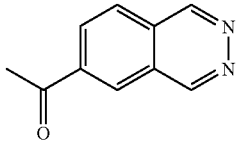
(I-32)
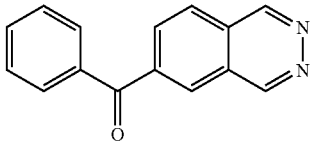
(I-33)
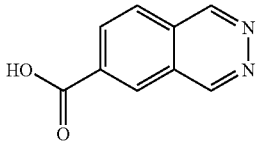
(I-34)
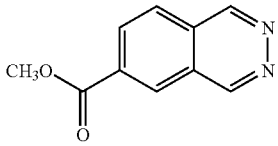
(I-35)
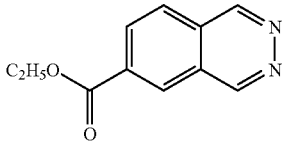
(I-36)
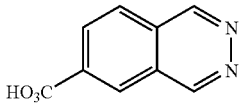
(I-37)
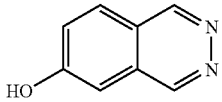
(I-38)
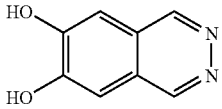
(I-39)
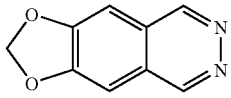

-continued
(I-40)
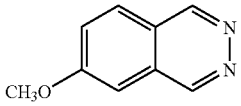
(I-41)
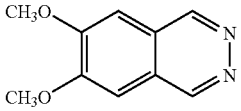
(I-42)
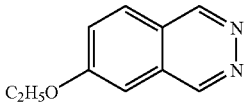
(I-43)
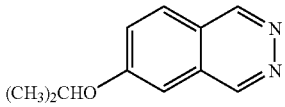
(I-44)
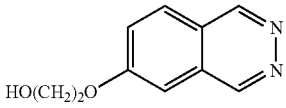
(I-45)
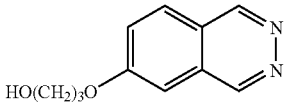
(I-46)
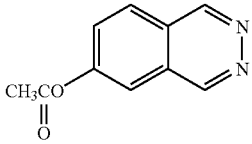
(I-47)
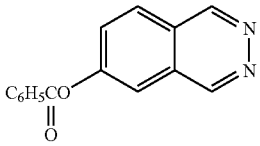
(I-48)
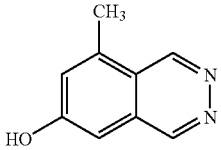
(I-49)
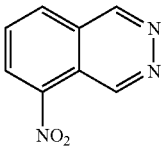
(I-50)
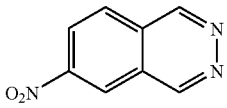
(I-51)
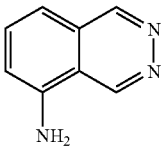
-continued
(I-52)
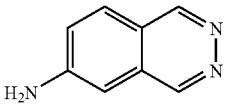
(I-53)
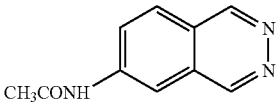
(I-54)
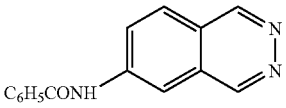
(I-55)
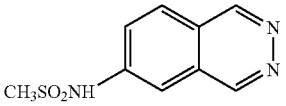
(I-56)
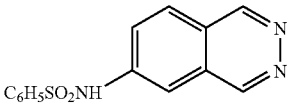
(I-57)
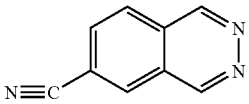
(I-58)
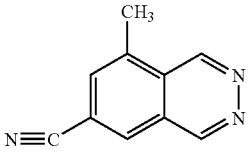
(I-59)
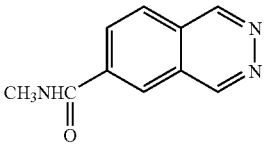
(I-60)
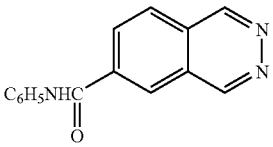
(I-61)
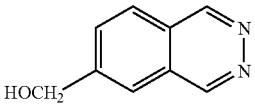
(I-62)
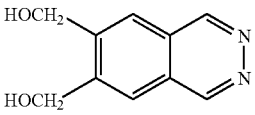
(I-63)
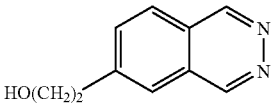

-continued
(I-64)
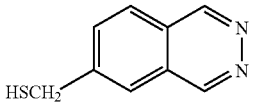
(I-65)
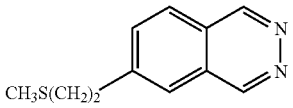
(I-66)
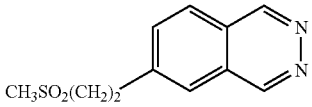
(I-67)
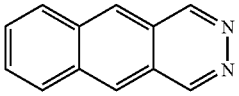
(I-68)
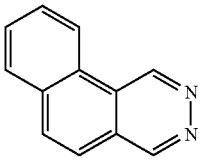
(I-69)
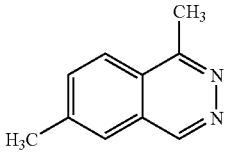
(I-70)
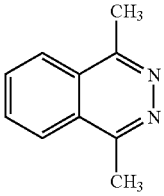
(I-71)
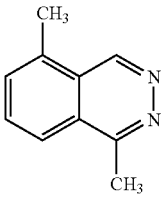
(I-72)
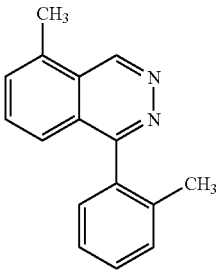
-continued
(I-73)
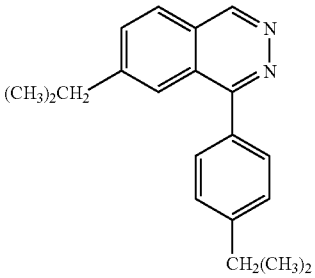
(I-74)
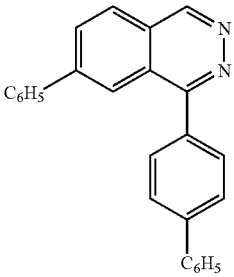
(I-75)
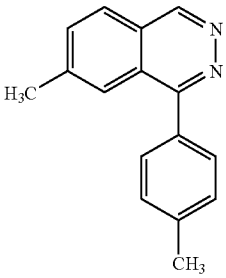
(I-76)
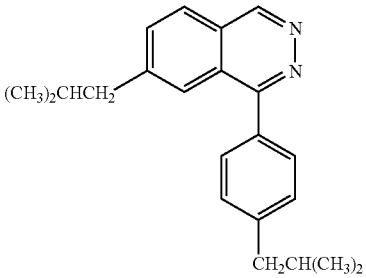
(I-77)
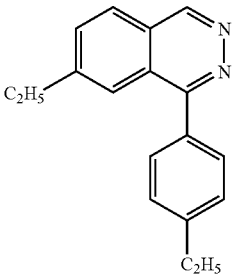

-continued (I-78)

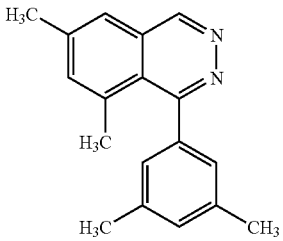

(I-79)

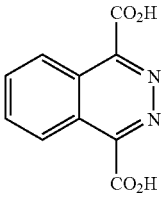

(I-80)

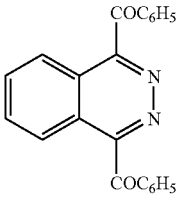

(I-81)

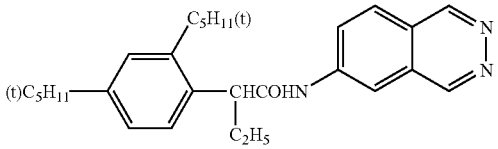

(I-82)

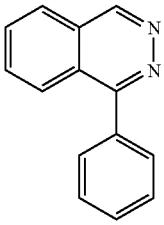

(I-83)

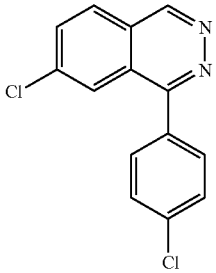

(I-84)

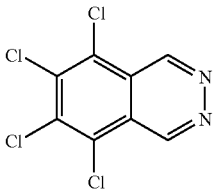

13. Other Additives

1) Mercapto Compounds, Disulfides and Thiones

In the invention, mercapto compounds, disulfide compounds, and thione compounds may be added in order to control the development by suppressing or enhancing development, to improve spectral sensitization efficiency, or to improve storage properties before and after development. Descriptions can be found in paragraph Nos. 0067 to 0069 of JP-A No. 10-62899, a compound expressed by general formula (I) of JP-A No. 10-186572 and specific examples thereof shown in paragraph Nos. 0033 to 0052, and in lines 36 to 56 in page 20 of EP No. 0803764A1. Among them, mercapto-substituted heterocyclic aromatic compound described in JP-A Nos. 9-297367, 9-304875, and 2001-100358, as well as in Japanese Patent Application Nos. 2001-104213 and 2001-104214, and the like, are particularly preferred.

2) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573 and in paragraph Nos. 0049 to 0062 of Japanese Patent Application No. 11-106881.

3) Dyes and Pigments

From the viewpoint of improving image tone, of preventing the generation of interference fringes and of preventing irradiation on laser exposure, various types of dyes and pigments (for instance, C.I. Pigment Blue 60, C.I. Pigment Blue 64, and C.I. Pigment Blue 15:6) may be used in the photosensitive layer of the invention. Detailed description can be found in WO No. 98/36322, JP-A Nos. 10-268465 and 11-338098, and the like.

4) Ultra-High Contrast Promoting Agent

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118, paragraph Nos. 0136 to 0193 of JP-A No. 11-223898, as compounds expressed by formulae (H), (1) to (3), (A), and (B) in Japanese Patent Application No. 11-87297, as compounds expressed by formulae (III) to (V)(specific compound: chemical No.21 to chemical No.24) in Japanese Patent Application No. 11-91652; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, one mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coverage per 1 $m^2$ of the photosensitive material) may be set as desired depending on the sensitivity and fogging, but preferred is an amount of 0.1 $mg/m^2$ to 500 $mg/m^2$, and more preferably, of 0.5 $mg/m^2$ to 100 $mg/m^2$.

5) Preparation of Coating Solution for Image Forming Layer

The temperature for preparing the coating solution for use in the image forming layer of the invention is preferably from 30° C. to 65° C., more preferably, from 35° C. to 60° C., and most preferably, from 35° C. to 55° C. Furthermore, the temperature of the coating solution for the image forming layer immediately after adding the polymer latex is preferably maintained in the temperature range from 30° C. to 65° C.

14. Layer Constitution and Other Constituting Components

The image forming layer of the invention is constructed on a support by one or more layers. In the case of constituting the layer by a single layer, it comprises an organic silver salt, photosensitive silver halide, a reducing agent, and a binder, which may further comprise additional materials as desired if necessary, such as a toner, a coating aid, and other auxiliary agents. In the case of constituting the image forming layer from two layers or more, the first image forming layer (in general, a layer placed adjacent to the support) contains an organic silver salt and a photosensitive silver halide, and some of the other components must be incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the photosensitive layers as described in U.S. Pat. No. 4,460,681.

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The coverage of polyvinyl alcohol (per 1 $m^2$ of support) in the protective layer (per one layer) is preferably in a range of from 0.3 $g/m^2$ to 4.0 $g/m^2$, and more preferably, from 0.3 $g/m^2$ to 2.0 $g/m^2$.

The coverage of total binder (inclusive of water-soluble polymer and latex polymer) (per 1 $m^2$ of support) in the surface protective layer (per one layer) is preferably in a range of from 0.3 $g/m^2$ to 5.0 $g/m^2$, and more preferably, from 0.3 $g/m^2$ to 2.0 $g/m^2$.

2) Antihalation Layer

The photothermographic material of the present invention may comprise an antihalation layer provided to the side farther from the light source with respect to the photosensitive layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The amount of adding the thermal bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably, from 0.2 to 1. The usage of dyes to obtain optical density in the above range is generally from about 0.001 $g/m^2$ to 1 $g/m^2$.

By thermal bleaching the dye in such a manner, the optical density after thermal development can be lowered to 0.1 or lower. Two types or more of thermal bleaching dyes may be used in combination in a photothermographic material. Similarly, two types or more of base precursors may be used in combination.

In thermal bleaching process using such a thermal bleaching dye and a base precursor, preferred is to use a substance (for instance, diphenylsulfone, 4-chlorophenyl(phenyl)sulfone, and the like) as disclosed in JP-A No. 11-352626, as well as 2-naphthyl benzoate and the like, which is capable of lowering the melting point of a base precursor by 3° C. when mixed with a basic precursor from the viewpoint of thermal bleaching property or the like.

3) Back Layer

Back layers usable in the invention are described in paragraph Nos. 0128 to 0130 of JP-A No. 11-65021.

In the invention, coloring matters having maximum absorption in the wavelength range of from 300 nm to 450 nm may be added in order to improve a color tone of developed images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range of from 0.1 mg/m$^2$ to 1 g/m$^2$, preferably to the back layer provided to the side opposite to the photosensitive layer.

In order to control the basic color tone, it is preferred to use a dye having an absorption peak in the wavelength range of from 580 to 680 nm. As a dye satisfying this purpose, preferred are oil-soluble azomethine dyes described in JP-A Nos. 4-359967 and 4-359968, or water-soluble phthalocyanine dyes described in Japanese Patent Application No. 2002-96797, which have low absorption intensity on the short wavelength side. The dyes for this purpose may be added to any of the layers, but more preferred is to add them in the non-photosensitive layer on the emulsion plane side, or in the back plane side.

The photothermographic material of the invention is preferably a so-called one-side photosensitive material, which comprises at least one layer of a photosensitive layer containing silver halide emulsion on one side of the support, and a back layer on the other side.

4) Matting Agent

A matting agent may be preferably added to the photothermographic material of the invention in order to improve transportability. Description on the matting agent can be found in paragraphs Nos. 0126 to 0127 of JP-A No.11-65021. The amount of adding the matting agents is preferably in the range from 1 mg/m$^2$ to 400 mg/m$^2$, more preferably, from 5 mg/m$^2$ to 300 mg/m$^2$, with respect to the coating amount per one m$^2$ of the photosensitive material.

There is no particular restriction on the shape of the matting agent usable in the invention and it may fixed form or non-fixed form. Preferred is to use those having fixed form and globular shape. Average particle size is preferably in the range of from 0.5 μm to 10 μm, more preferably, from 1.0 μm to 8.0 μm, and most preferably, from 2.0 μm to 6.0 μm. Furthermore, the particle distribution of the matting agent is preferably set as such that the variation coefficient may become 50% or lower, more preferably, 40% or lower, and most preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean diameters is more than 3.

The matness on the image forming layer surface is not restricted as far as star-dust trouble occurs, but the matness of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in a range of 1200 seconds or less and 10 seconds or more; more preferably, 800 seconds or less and 20 seconds or more, as expressed by Beck smoothness.

In the invention, the matting agent is incorporated preferably in the outermost surface layer on the photosensitive layer plane or a layer functioning as the outermost surface layer, or a layer near to the outer surface, and a layer that functions as the so-called protective layer.

5) Polymer Latex

In the case of the photothermographic material of the invention for graphic arts in which changing of dimension is critical, it is preferred to incorporate polymer latex in the surface protective layer and the back layer. As such polymer latexes, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Ouyou (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid copolymer, a latex of methyl methacrylate (64.0% by weight)/styrene (9.0% by weight)/butyl acrylate (20.0% by weight)/2-hydroxyethyl methacrylate (5.0% by weight)/acrylic acid copolymer, and the like. Furthermore, as the binder for the surface protective layer, there can be applied a combination of polymer latex described in the specification of Japanese Patent Application No. 11-6872, the technology described in paragraph Nos. 0021 to 0025 of the specification of JP-A No. 2000-267226, the technology described in paragraph Nos. 0027 and 0028 of the specification of Japanese Patent Application No. 11-6872, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

6) Surface pH, and Surface pAg

The surface pH of the photothermographic material according to the invention preferably yields a pH of 7.0 or lower, more preferably, 6.6 or lower, before thermal development treatment. Although there is no particular restriction concerning the lower limit, the pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

The preferred surface pAg value of the photothermographic material according to the invention is in a range of 1 to 7, and more preferably, 3 to 5. The surface pAg value can be obtained by dropping 300 μl of distilled water on one cm$^2$ area of the photothermographic material, and by then measuring the potential using an electrode.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

8) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb. The amount of adding different types of atoms is preferably in a range of from 0.01 mol % to 30 mol %, and particularly preferably, in a range of from 0.1 mol % to 10 mol %. The shape of the metal oxides can include, for example, spherical, needle-like, or plate-like shape. The needle-like particles, with the rate of (the major axis)/(the minor axis) is more than two, or more preferably, 3.0 to 50, is preferred viewed from the standpoint of the electric conductivity effect. The metal oxides is used preferably in the range from 1 $mg/m^2$ to 1000 $mg/m^2$, more preferably from 10 $mg/m^2$ to 500 $mg/m^2$, and further preferably from 20 $mg/m^2$ to 200 $mg/m^2$. The antistatic layer can be laid on either side of the image forming layer side or the back layer side, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

9) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and in paragraph Nos. 0063 to 0080 of Japanese Patent Application No. 11-106881, and the like.

10) Other Additives

Furthermore, antioxidant, stabilizing agent, plasticizer, UV absorbent, or a coating aid may be added to the photothermographic material. Each of the additives is added to either of the photosensitive layer or the non-photosensitive layer. Reference can be made to WO No. 98/36322, EP-A No. 803764A1, JP-A Nos. 10-186567 and 10-18568, and the like.

11) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. The viscosity of the coating solution for the layer containing organic silver salt in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and heating time is preferably in a range of from 1 second to 60 seconds. More preferably, heating is performed in a temperature range of from 70° C. to 90° C. at the film surface for a duration of from 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to stably and continuously produce the photothermographic material of the invention.

The photothermographic material is preferably of monosheet type (i.e., a type which can form image on the photothermographic material without using other sheets such as an image-receiving material).

12) Wrapping Material

In order to suppress fluctuation from occurring on the photographic performance during a preservation of the photosensitive material of the invention before thermal development, or in order to improve curling or winding tendencies, it is preferred that a wrapping material having low oxygen transmittance and/or vapor transmittance is used. Preferably, oxygen transmittance is 50 ml/atm·m$^2$·day or lower at 25° C., more preferably, 10 ml/atm·m$^2$·day or lower, and most preferably, 1.0 ml/atm·m$^2$·day or lower. Preferably, vapor transmittance is 10 g/atm·m$^2$·day or lower, more preferably, 5 g/atm·m$^2$·day or lower, and most preferably, 1 g/atm·m$^2$·day or lower.

As specific examples of a wrapping material having low oxygen transmittance and/or vapor transmittance, reference can be made to, for instance, the wrapping material described in JP-A Nos.8-254793 and 2000-206653.

13) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064 and 2000-171936.

In instances of multi-color photothermographic materials, each photosensitive layer is in general, held distinctively each other by using a functional or nonfunctional barrier layer between each photosensitive layer as described in U.S. Pat. No. 4,460,681.

Constitution of the multi-color photothermographic material may include a combination of these two layers for each color. Alternatively, all ingredients may be included into a single layer as described in U.S. Pat. No. 4,708,928.

15. Image Forming Method

1) Exposure

Although the photosensitive material of the invention may be subjected to exposure by any methods, laser beam is preferred as an exposure light source. Particularly, silver halide emulsion of high content of silver iodide had a problem having low photosensitivity, but this problem was solved with the use of high illumination intensity like laser beam. And it made clear that it needs small amount of energy to record an image. Using thus strong light in a short time made it possible to achieve photosensitivity to the purpose.

Especially, for giving the exposure intensity to provide maximum density (Dmax), the light intensity on the surface of the photographic material is preferably in the range of 0.1 W/mm$^2$ to 100 W/mm$^2$, more preferably 0.5 W/mm$^2$ to 50 W/mm$^2$, most preferably 1 W/mm$^2$ to 50 W/mm$^2$.

As Laser beam according to the invention, preferably used are gas laser ($Ar^+$, He—Ne, He—Cd), YAG laser, pigment laser, semiconductor laser. Semiconductor laser and second harmonics generator element can also be used. Preferred laser is determined corresponding to the peak absorption wavelength of spectral sensitizer and the like, but preferred is He—Ne laser of red through infrared emission, red semiconductor laser, or $Ar^+$, He—Ne, He—Cd laser of blue through green emission, blue semiconductor laser. Meanwhile, modules having SHG (Second Hermonic Generator) chip and semiconductor laser which are integrated, or blue semiconductor laser have been espcially developed recently, and thus laser output devices for short wavelength region have attracted the attention. Blue semiconductor laser has been expected as a light source with increasing demand hereafter because image recording with high definition is possible, and increased recording density, as well as stable output with longer operating life are enabled.

Laser beam which oscillates in a longitudinal multiple modulation by a method such as high frequency superposition is also preferably employed. In comparison with scanning laser beam in a longitudinal single mode, such laser beam results in decreased deterioration of image qualities, for example, occurrence of unevenness like interference fringes.

For providing the longitudinal multiple modulation, methods such as wave coupling, utilization of return light, or high frequency superposition may be employed. Longitudinal multiple modulation means that the wavelength of the exposed light is not single, and in general, distribution of the exposed light may be 5 nm or greater, and preferably 10 nm or greater. Upper limit of the wavelength of the exposed light is not particularly limited, however, it is approximately 60 nm in general.

2) Thermal Development

Although the development of the photothermographic material of the invention is usually performed by elevating the temperature of the photothermographic material exposed imagewise, any method may be used for this thermal development process. The temperature for the development is preferably 80° C. to 250° C., preferably 100° C. to 140° C., and more preferably 110° C. to 130° C. Time period for the development is preferably 1 second to 60 seconds, more preferably 3 seconds to 30 seconds, particularly preferably 5 seconds to 25 seconds, and most preferably 7 seconds to 15 seconds.

3) Thermal Developing Device

The thermal developing device includes as main parts, a laser oscillator, a section where the laser is scanned and exposed according to the image information, a transport section for photothermographic materials, a heating section, a cooling section, and a discharge section.

It is important to heat the exposed photothermographic materials equally. In the process for the thermal development, either drum type heaters or plate type heaters may be used. However, plate type heater processes are more preferred. Preferable process for the thermal development by a plate type heater may be a process described in JP-A NO. 11-133572, which discloses a thermal developing device in which a visible image is obtained by bringing a photothermographic material with a formed latent image into contact with a heating means at a thermal development region, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 sections, with the leading end having the lower temperature by 1 to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

Figure 2:
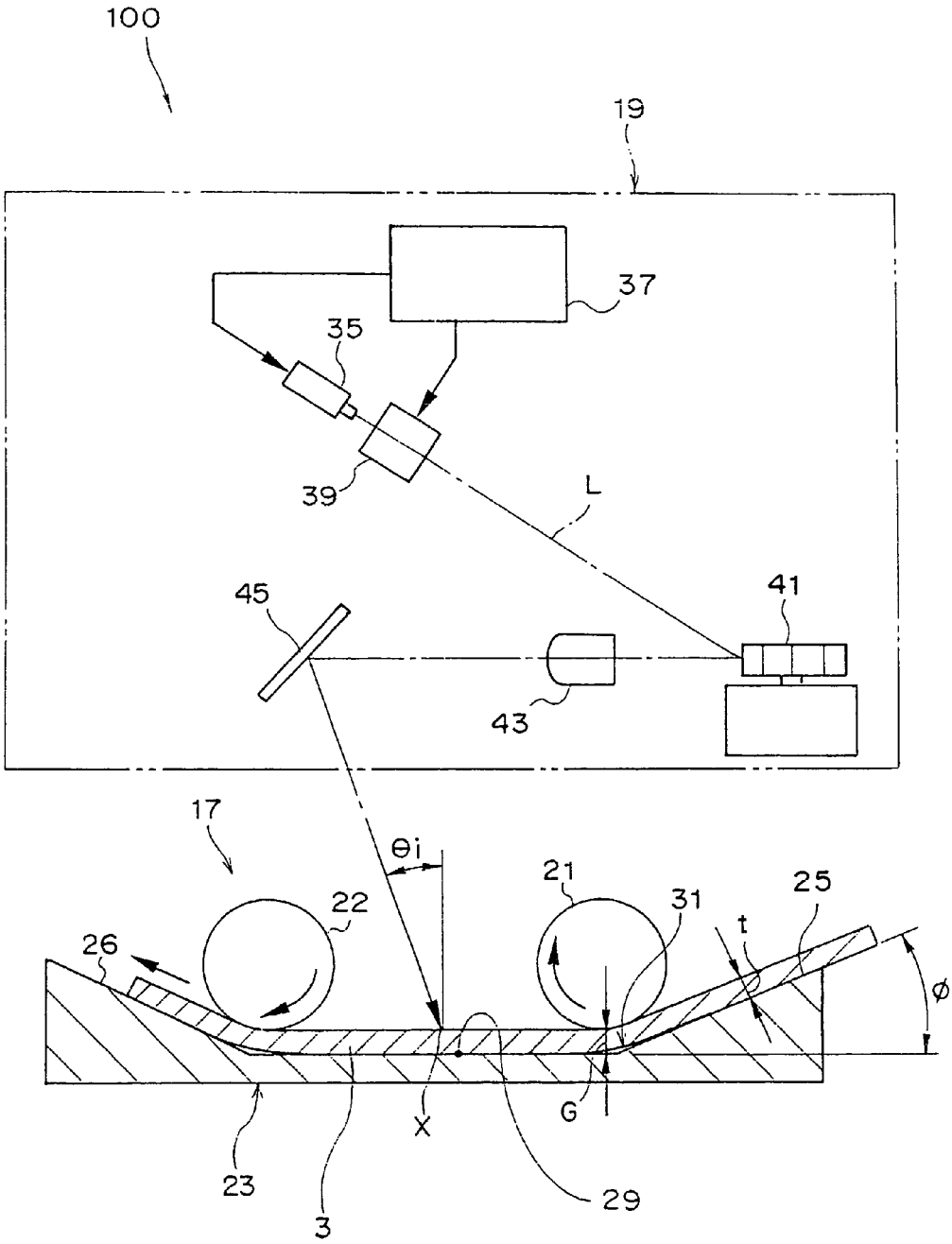
FIG. 2 is a schematic view of a laser scanning-exposing section of the thermal developing device and a conveying section for conveying a photothermographic material to a thermal developing section.
Figure 3:
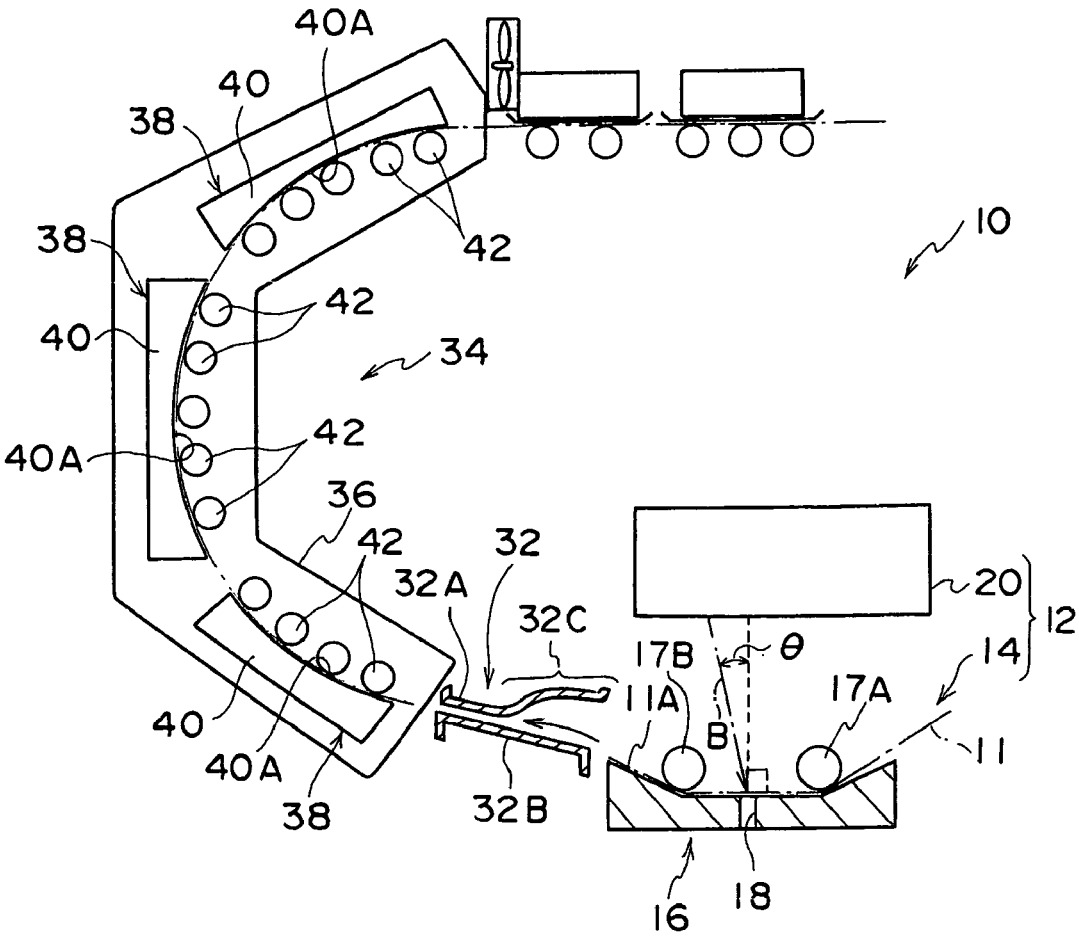
FIG. 3 is a schematic view of the conveying section for conveying the photothermographic material to the thermal developing section and the thermal developing section of the thermal developing device according to the present invention.

Now the image forming method of the present invention will be described further clearly with reference to a thermal developing device. FIGS. 1 to 3 show an example of a thermal developing device of the present invention.

Reference numerals used in the drawings will be listed below.

In FIGS. 1 and 2;

3: photothermographic material
10*a*, 10*b*, 10*c*: trays for photothermographic materials
13*a*, 13*b*, 13*c*: sheet conveyor rollers
15*a*, 15*b*, 15*c*: photothermographic materials
16: upper light-shielding cover
17: conveying section for sub-scanning (sub-scanning means)
19: scanning-exposing section (laser irradiation means)
21, 22: driving rollers
23: guide plate
25, 26: sloped portions
29: abutting section
31: guide plate
35: semiconductor laser
37: driving circuit
39: intensity modulator
41: polygon mirror
43: converging lens
45: mirror
51*a*, 51*b*, 51*c*: thermal developing plates
52: driving roller
53: reduction gear
55: opposition roller for conveyance
57: cooling rotor
59: cooling rotor
61: cooling plate
63: discharging roller
100: laser recording device
150: thermal developing recording device In FIG. 3;

10: image recording device
11: photothermographic material
11A: recording surface of photothermographic material
12: exposing section
B: laser beam
14: conveying section
16: presser plate
17A, 17B: driving rollers
18: through groove
20: scanning section (laser irradiation means)
32: guide plate
32A: upper guide plate
32B: lower guide plate
32C: expanding section
34: thermal developing section
36: casing
38: developing unit
40: heating plate
40A: heating surface
42: presser roller In FIGS. 1 and 2, a sheet of photothermographic material from among the photothermographic materials 15*a*, 15*b* or 15*c* in photothermographic material trays 10*a*, 10*b* or 10*c* is conveyed by one of sheet conveying rollers 13*a*, 13*b* and 13*c* to an image exposing section B. While conveyed in a main scanning direction, the photothermographic material is scanned in a sub-scanning direction by a laser irradiated from a scanning-exposing section (i.e., a laser irradiation means) 19 so that an image on the photothermographic material is exposed two-dimensionally. The laser is irradiated at an angle θi. Before the scanning-exposure completes, a leading end of the photothermographic material is inserted into a thermal developing section C where development begins. The thermal developing section has, as main components thereof, three thermal developing plates 51*a*, 51*b* and 51*c*, a plurality of opposition rollers 55 for conveyance and a driving roller 52. After the development in the thermal developing section, the photothermographic material is conveyed through a cooling section D, where the photothermographic material is cooled down to a temperature at which development no more continues, and then discharged outside the device by a discharging roller 63.

In the present invention, the distance between the exposing section and the developing section is not more than 50 cm, thereby reducing processing time of the series of exposure and development remarkably. The distance is preferably 3 cm to 40 cm, and more preferably 5 cm to 30 cm.

The exposing section is a position at which the photothermographic material is irradiated with light from an exposure light source. The developing section is a position at which the photothermographic material is first heated for thermal development. The distance between the exposing section and the developing section in the present invention is the distance between the point X in the exposing section in FIG. 2 and an end surface Y of the developing section 51*a*, to which the exposed photothermographic material first contacts at first.

It is preferable to control a heater more stably to reduce the size of the thermal developing section and reduce time for thermal development. It is also preferable to begin thermal development when a sheet of photosensitive material is in a state in which the leading end, which has been exposed, begins to be thermal developed while the trailing end is still unexposed. An example of an imager that provides rapid processing preferable to the present invention is described in, for example, Japanese Patent Application Nos. 2001-088832, 2001-091114, 2001-170642 and 2002-92635. The imager disclosed in these patent applications enables thermal development in 14 seconds in a three-staged plate heater of which temperature is controlled to 107° C. to 121° C. The time before the first sheet is outputted is reduced to about 60 seconds.

Because the exposing section and the developing section are disposed close to each other, a sheet begins to be developed at an exposed portion thereof while another portion is still exposed. In this image forming method in which the sensitive material is exposed at a portion and developed at another portion at the same time, because vibration of the sensitive material during conveyance has a direct effect on image quality, a photothermographic material that is not likely to be affected by vibration has been required.

In the present invention, it is preferable to thermal-develop the photothermographic material while conveying the same at a processing rate of not less than 23 mm/sec. The line velocity of development is the speed at which the photothermographic material passes through between the presser roller and the plate heater.

When conveyed at high speed, e.g., at a line velocity of not less than 23 mm/sec., to reduce the time required for the series of exposure and development, the photothermographic material is likely to be subject to vibration. In this case, as in the case in which the exposing section and the developing section are disposed close to each other, a photothermographic material that is less likely to be subject to vibration is advantageously used.

4) System

Examples of a medical laser imager equipped with a light exposing part and a thermal developing part include Fuji Medical Dry Laser Imager FM-DP L. In connection with FM-DPL, description is found in Fuji Medical Review No. 8, pages 39–55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

16. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

1. Preparation of PET Support and Undercoating 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C., and the dye BB having the following structure was included at 0.04% by weight. Thereafter, the mixture was extruded from a T-die and rapidly cooled to form a non-tentered film having such a thickness that the thickness should become 175 μm after tentered and thermal fixation.

dye BB

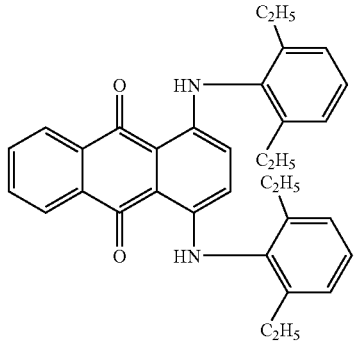

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part were slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

2. Preparation and Coating of Coating Solution for Back Layer

To 830 g of MEK were added 84.2 g of cellulose acetate butyrate (Eastman Chemical, CAB381-20) and 4.5 g of a polyester resin (Bostic Co., Vitel PE2200B) with stirring, and dissolved. To this dissolved solution was added 0.30 g of dye-1, and thereto were added 4.5 g of a fluorocarbon surfactant (Asahi Glass Co., Ltd., Surflon HK40) which had been dissolved in 43.2 g of methanol, and 2.3 g of a fluorocarbon surfactant (Dai-Nippon Ink & Chemicals, Inc., Megafac(R) F120K). The mixture was thoroughly stirred until dissolution was completed. Finally, 75 g of silica (W. R. Grace Co., Siloid 64×6000) dispersed in methyl ethyl ketone at a concentration of 1% by weight with a dissolver type homogenizer was added thereto followed by stirring to prepare a coating solution for the back layer.

Thus prepared coating solution for the back layer was coated on the support with an extrusion coater so that the dry film thickness became 3.5 μm and dried. Drying was executed by a hot air with a temperature of 100° C., and a dew point of 10° C. over 5 minutes.

3. Image-Forming Layer and Surface Protective Layer 3-1. Preparation of Materials for Coating 1) Silver Halide Emulsion (Preparation of Silver Halide Emulsion-1)

To 1420 mL of distilled water was added 3.1 mL of a 1% by weight potassium bromide solution. Further, a liquid added with 3.5 mL of sulfuric acid having the concentration of 0.5 mol/L and 31.7 g of phthalated gelatin was kept at 27° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1.

Hexachloroiridium(III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron(II) hexacyanide aqueous solution was added at a total amount of $3\times10^{-4}$ mol per one mol of silver. The mixture was adjusted to the pH of 3.8 with sulfuric acid at the concentration of 0.5 mol/L. After stopping stirring, the mixture was subjected to precipitation/desalting/water washing steps. The mixture was adjusted to the pH of 5.9 with sodium hydroxide at the concentration of one mol/L to produce a silver halide dispersion having the pAg of 8.0. Grains in thus prepared silver halide emulsion were silver iodide bromide grains having a mean sphere equivalent diameter of 0.035 μm, a variation coefficient of 15%, which uniformly include iodine at 3.5 mol %. Grain size and the like were determined from the average of 1000 grains using an electron microscope.

The silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per one mol of silver, and then pAg was adjusted to 5.5. At additional 5 minutes later, a tellurium sensitizer C in a methanol solution was added at $2.9\times10^{-4}$ mol per one mol of silver and subjected to aging for 91 minutes. After adjusting pAg of the emulsion to 7.5, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver, and 1-(3-methylureidophenyl)-5-mercaptotetrazole in an aqueous solution at $8.5\times10^{-3}$ mol per one mol of silver were added to produce a silver halide emulsion-1.

(Preparation of Silver Halide Emulsion-2 and -3)

Preparations of silver halide emulsion-2 and -3 were conducted in a similar manner to the process in the preparation of the silver halide emulsion-1 except that: the temperature of the liquid upon the nucleation process was altered from 27° C. to 35° C. or 47° C.

The mean sphere equivalent diameter of the emulsion grains in the silver halide emulsion-2 was 0.055 μm, and that of the grains in the silver halide emulsion-3 was 0.080 μm.

2) Preparations of Silver Salts of Fatty Acid

<<Preparation of Silver Salt of Fatty Acid-1>>

To 4720 mL of purified water were added behenic acid, arachidic acid, and stearic acid at 0.7552 mol in total with a ratio 42 mol %, 34 mol % and 24 mol %, respectively. After dissolving at 80° C., 540.2 mL of a 1.5 N aqueous NaOH solution was added to the solution, and thereto was added 6.9 mL of concentrated nitric acid, followed by cooling to 55° C. to obtain a solution of sodium salt of organic acid. While keeping the temperature of the sodium salt of organic acid solution at 55° C., 45.3 g of the aforementioned silver halide emulsion and 450 mL of purified water were added thereto. The mixture was stirred with a homogenizer manufactured by IKA JAPAN Co. (ULTRA-TURRAXT-25) at 13200 rpm (corresponding to 21.1 kHz of mechanical vibration frequency) for 5 minutes. Then, 702.6 mL of a 1 mol/L silver nitrate solution was added thereto over 2 minutes, followed by stirring for 10 minutes to obtain an organic silver salt dispersion. Thereafter, the resulting organic silver salt dispersion was transferred to a washing vessel, and thereto was added deionized water followed by stirring. The mixture was allowed to stand still so that the organic silver salt dispersion was floatated, and thus water soluble salts present in the bottom part were removed. Then, washing with deionized water and drainage of the waste water was repeated until the electric conductivity of the waste water became 2 μS/cm. After performing centrifugal dewatering, drying in a circulating dryer was performed with warm air having the oxygen partial pressure of 10% by volume at 40° C. until weight loss did not take place to obtain the silver salt of fatty acid-1 including photosensitive silver halide.

<<Preparations of Silver Salt of Fatty Acid-2 and -3>>

Preparations of silver salt of fatty acids-2 and -3 were conducted in a similar manner to the process in the preparation of the silver salt of fatty acid-1 except using silver halide emulsion-2 and -3, instead of using silver halide emulsion-1.

<<Preparations of Silver Salt of Fatty Acid-4 to -7>>

Preparations of silver salt of fatty acid-4 to -7 were conducted in a similar manner to the process in the preparation of the silver salt of fatty acid-1 except using silver halide emulsion-1 to -3 with a ratio presented in Table 1, instead of using silver halide emulsion-1.

3) Redispersion of Organic Silver Salts to Organic Solvent

<<Preparation of Organic Silver Salt Redispersion-1>>

209 g of powdery silver salt of fatty acid-1 above-mentioned and polyvinyl butyral powder (Monsanto Co., Butvar B-79) in an amount of 11 g were dissolved in 780 g of methyl ethyl ketone (MEK) while stirring with Dissolver DISPERMAT CA-40M type manufactured by VMA-GETZMANN Co., and then cooled overnight at 7° C. to yield a slurry. The slurry was subjected to two passes dispersion with a GM-2 pressure type homogenizer manufactured by SMT Limited to prepare an organic silver salt redispersion-1.

<<Preparations of Organic Silver Salt Redispersion-2 to -7>>

Preparations of organic silver salt redispersion-2 to -7 were conducted in a similar manner to the process in the preparation of the organic silver salt redispersion-1 except using silver salts of fatty acid-2 to -7, instead of using silver salt of fatty acid-1.

4) Preparation of Coating Solutions for Image Forming Layer-1 to -7

Either one of the organic silver salt redispersion-1 to -7 above-mentioned including photosensitive silver halide in an mount of 507 g, was stirred 15 minutes at 13° C., and thereto was added 3.9 mL of a 10% by weight methanol solution of pyridinium bromide perbromide (PHP). After stirring for 2 hours, thereto was added 5.2 mL of a 72% by weight methanol solution of calcium bromide. The mixture was subsequently stirred for 30 minutes, thereto was added 117 g of Butvar B-79. After stirring for 30 minutes, 27.3 g of reducing agent (R-2) was added to the mixture, followed by stirring for 15 minutes. Then, thereto was added sensitizing dye-1 in an amount of $1\times10^{-3}$ mol per one mol of silver halide followed by stirring for 15 minutes. Then was subsequently added 1.39 g of Desmodur N3300 (Mobay, aliphatic isocyanate) dissolved to 12.3 g of MEK, and stirred for additional 15 minutes, and then heated to 21° C. for 15 minutes.

Further, to 100 g of this dispersion was added polyhalide compound-1 in amount of 0.03 mol per one mol of coated silver, FED sensitizer-1, -2, and -3 in amount of $2\times10^{-3}$ mol each per one mol of silver halide, hydrogen bonding compound-1 in the same mol amount as reducing agent, development accelerator-1 and -2 each in an amount of $5\times10^{-3}$ mol per one mol of silver salt of fatty acid, 2.2 g of 4-chlorobenzophenone-2-carbonic acid, 0.47 g of 2-chlorobenzoic acid, and 0.47 g of 5-methyl-2 mercaptobenzimidazole, followed by stirring for one hour at 21° C. Then, thereto was added 0.368 g of phthalazine, 0.123 g of tetrachlorophthalic acid and 2 g of dye-1 to obtain coating solutions for image forming layer-1 to -7.

5) Preparation of Coating Solution for Surface Protective Layer

In 865 g of MEK were mixed, while stirring, 96 g of cellulose acetate butyrate (Eastman Chemical, CAB171-15S), 4.5 g of polymethyl methacrylic acid (Rohm and Haas, Acryloid A-21), 1.5 g of 1,3-di(vinylsulfonyl)-2-propanol, 1.0 g of benzotriazole, and 1.0 g of a fluorocarbon polymersurfactant (Asahi Glass Co., Ltd., Surflon HK40), and throughly dissolved. Thereto was added 30 g of the dispersion prepared by dispersing 13.6% by weight of cellose acetate butylate (Eastman Chemical, CAB171-15) and 9% by weight calcium carbonate (Speciality Minerals, Super-Pflex) to MEK using disolver type homogenizer at 8000 rpm for 30 minutes followed by stirring to prepare a coating solution for the surface protective layer-1.

3-2. Preparations of Photothermographic Materials

Photothermographic material-1 to -7 were prepared by simultaneous double coating of either one of the coating solutions for image forming layer prepared as shown above, and the coating solution for the surface protective layer using a dual knife coater, on a reverse: surface to the back layer of the support coated with the back layer. The coating was executed so that the image forming layer had the thickness after drying of 18.3 μm, and that the surface protective layer had the dry film thickness of 3.4 μm. This coating device has two knife coating blades which are laid side by side. After cutting the support to the size so that it meets with the volume of the solution used, knives equipped with a hinge were elevated to put them in a position on the coater floor. Then, the knives were brought down and fixed onto a predetermined position. The height of the knives was regulated using a wedge which was measured with an ammeter and which was controlled by a screw knob. Knife #1 was elevated up to a clearance corresponding to the thickness which was coordinated with total thickness of the substrate thickness and the desired wet thickness of the image forming layer (layer #1). Knife #2 was elevated up to the height equal to the total thickness of: support thickness+wet thickness of the image forming layer (layer #1)+desired thickness of the surface protective layer (layer #2). Thereafter, drying was performed with an air of the temperature of 75° C. and a dew point of 10° C. for 15 minutes.

In the case, the image forming layer is made of two layers, three knife coating blades are used, and the coating was executed so that the thickness after drying of each of the upper and the lower image forming layer becomes 9.15 μm. Preparations of photothermographic material-8 to -12 were conducted this way.

Chemical structures of the compounds used in Examples of the invention are shown below.

Polyhalogen Compound-1

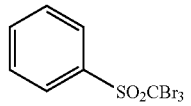

FED Chemical Sensitizer-1

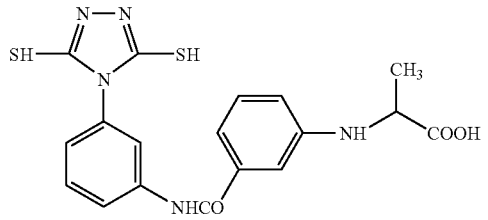

FED Chemical Sensitizer-2

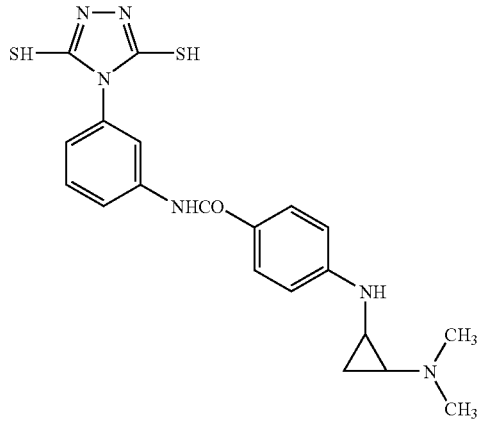

-continued

FED Chemical Sensitizer-3

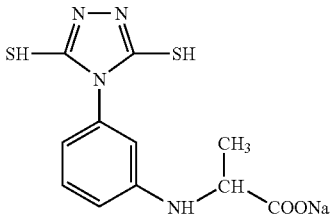

Dye-1

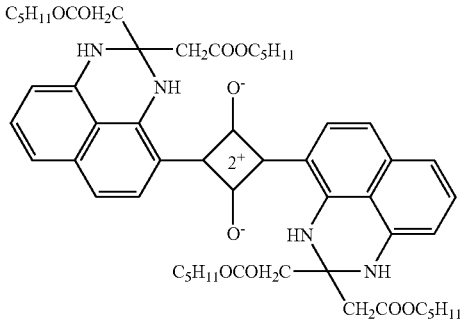

Tellurium Sensitizer

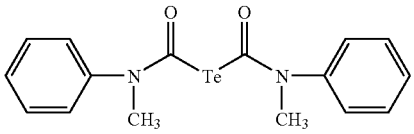

Hydrogen Bonding Compound-1

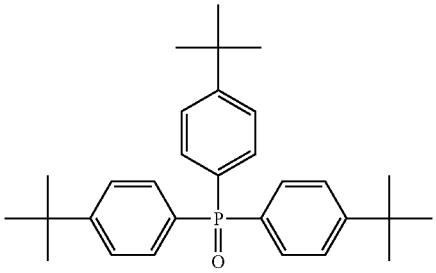

Spectral Sensitizer-1

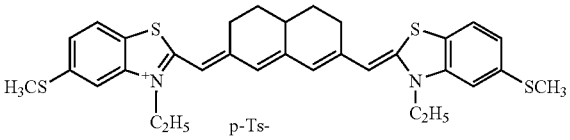

Development Accelerator-1

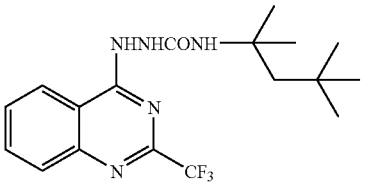

-continued

Development Accelerator-2

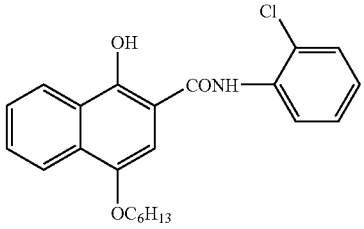

4. Evaluation of Photographic Performances 4-1. Preparation

The resulting sample was cut into a half-cut size (43 cm in length×35 cm in width), and was wrapped with the following packaging material under an environment of 25° C. and 50% RH, and stored for 2 weeks at an ambient temperature.

(Packaging Material)

PET 10 μm/PE 12 μm/aluminum foil 9 μm/Ny 15 μm/polyethylene 50 μm containing carbon at 3% by weight, oxygen permeability: 0.02 mL/atm·$m^2$·25° C.·day, vapor permeability: 0.10 g/atm·$m^2$ 25 C day.

4-2. Exposure and Development of Photothermographic Material

An exposure machine was manufactured by way of trial, with semiconductor laser, which was longitudinally multiple modulated at the wavelength of 800 nm through 820 nm with high frequency superposition, as an exposure light source. Exposure was provided by laser scanning using this exposure machine to the image forming layer surface side of the sample-1 to -12 prepared as described hereinbefore. Upon the exposure, images were recorded with an incident angle of the scanning laser beam to the surface of the photothermographic material set to be 75°. After the exposure, thermal development was performed using an automated developing apparatus including heat drum, the protective layer of the photothermographic material being in contact with the surface of the drum, with the development temperature set to be 124° C. and total development time period of 14 seconds. Evaluation of thus resulting images was carried out with a densitometer. In this process, the distance between the exposure section and the development section was 15 cm and the line speed of the photothermographic materials upon the thermal development was 21.3 mm/sec.

4-3. The Evaluation of Photographic Properties

1) An Image Quality

The minimum density Dmin was obtained by measuring the image of the each photothermographic materials with Macbeth densitometer TD 904 (the visual density), and the uniform image was developed at the exposure value to give the optical density of Dmin+1.2, so that the uniformity of the density and the color tone of the silver images was evaluated and ranked to 4 levels:

A; the excellent images with a high uniformity and the best color toned,

B; better images having a slight irregularity in a density and an image color tone, C; images observed an irregularity in a density and an image color tone, which may be allowable to be used practically in a market, D; images having an actual irregularity in a density and an image color tone, which may be troubled to be used practically in a market.

2) A Calculation of Gamma Value

A gamma value was calculated through a measuring an optical density of the developed photothermographic materials.

A gamma value at an optical density of 1.2 in a characterisitic curve was indicated.

A photographic characterisitic curve is a D-logE curve, were the vertical axis is an optical density (a photographic diffuse dnsity D), and the horizontal axis is a logarithmic value of an exposure amount which is an exposure energy. A gamma value is a gradient of a tangent at an optical density of 1.2 in a photographic characterisitic curve, that is a tan θ where is θ an angle between a tangent and a horizontal axis.

TABLE 1

| Photothermographic material | Silver halide emulsion | γ value | Result of evaluation | Dmax |
|---|---|---|---|---|
| 1 | 1 | 5 | D | 4.5 |
| 2 | 2 | 4.3 | C | 3.5 |
| 3 | 3 | 3.8 | B | 2.5 |
| 4 | 1 + 2(9:1) | 3.5 | B | 4.4 |
| 5 | 1 + 3(9:1) | 3 | A | 4.3 |
| 6 | 2 + 3(9:1) | 3.3 | B | 3.5 |
| 7 | 1 + 2 + 3(8:1:1) | 2.8 | A | 4.2 |
| 8 | upper layer:2<br>lower layer:1 | 3.2 | A | 4.4 |
| 9 | upper layer:3<br>lower layer:2 | 3 | A | 3.5 |
| 10 | upper layer:3<br>lower layer:1 | 2.7 | A | 4.3 |
| 11 | upper layer:2 + 3<br>lower layer:1 + 2 | 2.6 | A | 4.2 |
| 12 | upper layer:1 + 2 + 3<br>lower layer:1 + 2 | 2.5 | A | 4 |

As shown in Table 1, the developed images having a gamma of 2.0 to 4.0 were excellent in an uniform density.

Above them, especially excellent performances were resulted, when the gamma value was 2.0 to 3.2.

Example 2

The photothermographic materials were exposed and developed in a similar manner to that in Example 1 except that the line speed in the development was 28.6 mm/sec, and were evaluated in similar manner that in Example 1 to obtain the similar results.

In the case, the line speed was raised to over 23 mm/sec, the developed images having a γ value of 2.0 to 4.0 were excellent in an uniform density.

Example 3

Coating solutions for the image forming layer-13 to -19 were prepared in the similar manner to that in Example 1 except that sensitizing dye-2 was used instead of sensitizing dye-1 in the preparation of solutions for the image forming layer-1 to -7.

Spectral Sensitizer-2

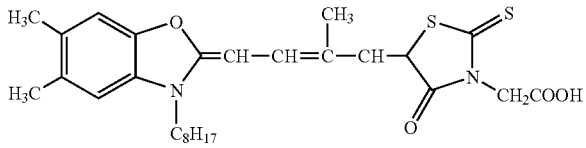

Using coating solutions for the image forming layer-13 to -19, the photothermographic material-13 to -19 having one layered image forming layer and the photothermographic material-20 to -24 having two layered image forming layer were prepared in the similar manner to Example 1.

(Exposure and Development of Photothermographic Material)

Exposure and thermal development (14 seconds in total with 4 panel heaters set to be 112° C.-119° C.-121° C.-121° C.) with Fuji Medical Dry Laser Imager FM-DP L (equipped with 660 nm semiconductor laser having the maximum output of 60 mW (IIIB)) reconstructed to raise the line speed of the development section were performed to above obtained photothermographic material-13 to -24. Line speed in this process was 29.3 mm/sec.

(Evaluation of Photographic Performances)

Evaluations were carried out in the similar manner to that of Example 1. The results are shown in Table 2.

TABLE 2

| Photothermographic material | Silver halide emulsion | γ value | Result of evaluation | Dmax |
|---|---|---|---|---|
| 13 | 1 | 4.9 | D | 4.7 |
| 14 | 2 | 4.2 | C | 3.7 |
| 15 | 3 | 3.7 | B | 2.7 |
| 16 | 1 + 2(9:1) | 3.4 | B | 4.6 |
| 17 | 1 + 3(9:1) | 2.9 | A | 4.5 |
| 18 | 2 + 3(9:1) | 3.2 | A | 3.7 |
| 19 | 1 + 2 + 3(8:1:1) | 2.7 | A | 4.4 |
| 20 | upper layer:2<br>lower layer:1 | 3.1 | A | 4.6 |
| 21 | upper layer:3<br>lower layer:2 | 2.9 | A | 3.7 |
| 22 | upper layer:3<br>lower layer:1 | 2.6 | A | 4.5 |
| 23 | upper layer:2 + 3<br>lower layer:1 + 2 | 2.5 | A | 4.4 |
| 24 | upper layer:1 + 2 + 3<br>lower layer:1 + 2 | 2.4 | A | 4.2 |

As shown in Table 2, the results were excellent similar to Example 1 and the developed images having gamma of 2.0 to 4.0 were excellent in an uniform density, even in case sensitizing dye was changed to sensitizing dye-2 used for red laser beam and exposed by red laser beam.

Example 4

1. Redispersion of Organic Silver Salt to Organic Solvent

The slurries were dispersed with a media type dispersion machine packed with 80% by volume 1 mm Zr beads (manufactured by Toray) at a circumferential velocity of 13 m, and retention time of 0.5 minutes in the similar manner to the redispersion of silver salt of fatty acid in Example 1 except that the slurries of silver salt of fatty acid-1 to -7 were subjected to two passes dispersion with a GM-2 pressure type homogenizer manufactured by SMT Limited, to obtain organic silver salt dispersion-1 to -7 including photosensitive sliver halide.

2. Preparation of Coating Solution for Image Forming Layer-25 to -31

Using 500 g of either of the aforementioned photosensitive silver halide containing organic silver salt dispersion-1 to-7, 100 g of methyl ethyl ketone (MEK) was added thereto while stirring under a nitrogen gas stream, and incubated at 24° C. The antifoggant-1 as described below (2.5 mL of a 10% methanol solution) was added thereto followed by stirring for 15 minutes. Thereto was added 1.8 mL of a 1:5 mixed solution of the following dye adsorption promotor and potassium acetate (a 20% by weight ethanol solution of the dye adsorption promotor), followed by stirring for 15 minutes. Next, sensitizing dye-3 in amount of $1\times10^{-3}$ mol per one mol of silver halide, 7 mL of a mixed solution of 4-chloro-2-benzoylbenzoic acid and super-sensitizer (5-methyl-2-mercaptobenzimidazole), with a mixing ratio of 25:2 by weight, polyhalide compound-2 in amount of 0.03 mol per one mole of coated silver, FED sensitizer-1, -2, and -3 each in an amount of $2\times10^{2}$ mol per one mol of silver halide, halogen bonding compound 1 in the same mol amount of reducing agent-1, and development accelerator-1 and -2 each in an amount of $5\times10^{-3}$ mol per one mol silver of silver salt of fatty acid were added, followed by stirring for 1 hour. Thereafter, the temperature was lowered to 13° C., and the mixture was further stirred for 30 minutes. To this mixture was added 48 g of polyvinyl butyral while keeping the temperature at 13° C. After allowing for sufficient dissolution, the following additives were added. All of these operations were performed under a nitrogen gas stream.

| | |
|---|---|
| Phthalazine | 1.5 g |
| Tetrachlorophthalic acid | 0.5 g |
| 4-Methylphthalic acid | 0.5 g |
| Dye-2 | 2.0 g |
| Reducing agent (R-5) | 15.0 g |
| Desmodur N3300 (Mobay, aliphatic isocyanate) | 1.10 g |
| Antifoggant-2 | 0.9 g |

Polyhalogen Compound-2

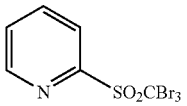

Spectral Sensitizer-3

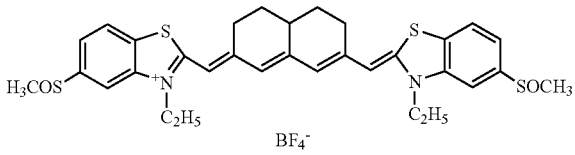

Dye Adsorption Promoting Agent

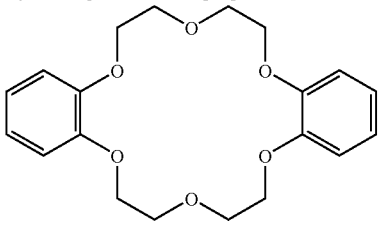

-continued

Antifoggant-1

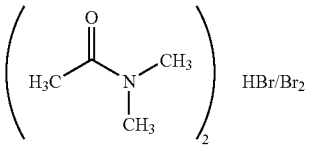

Dye-2

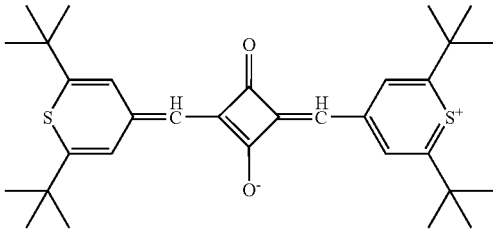

Antifoggant-2

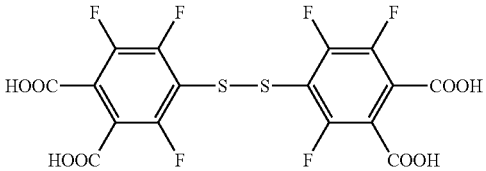

3. Coating Solution for Surface Protective Layer

The coating solution for the surface protective layer was prepared in the similar manner to that in Example 1.

4. Coating

Image forming layer: the support used in the Example 1 was coated back layer similar to that of Example 1. To the surface on the reverse side of the back side of this support were simultaneously coated with the coating solution for the image forming layer, so that the coating amount of silver of 1.8 g/m$^2$ and the amount of polyvinyl butyral in the binder of 8.5 g/m$^2$ are provided, to obtain sample-25 to -36. Further, sample-32 to -36 having the image forming layer in two layered form were prepared in the similar manner to Example 1.

Surface protective layer was coated at wet coating amount of 100 μm.

5. Evaluation of Photographic Performance

Evaluations were carried out in the similar manner to that of Example 1. The results are shown in Table 3.

TABLE 3

| Photothermographic material | Silver halide emulsion | γ value | Result of evaluation | Dmax |
|---|---|---|---|---|
| 25 | 1 | 5.2 | D | 4.2 |
| 26 | 2 | 4.5 | D | 3.2 |
| 27 | 3 | 4 | C | 2.2 |
| 28 | 1 + 2(9:1) | 3.7 | B | 4.1 |
| 29 | 1 + 3(9:1) | 3.2 | A | 4 |
| 30 | 2 + 3(9:1) | 3.5 | B | 3.2 |
| 31 | 1 + 2 + 3(8:1:1) | 3 | A | 3.9 |
| 32 | upper layer:2<br>lower layer:1 | 3.4 | B | 4.1 |
| 33 | upper layer:3<br>lower layer:2 | 3.2 | A | 3.2 |
| 34 | upper layer:3<br>lower layer:1 | 2.9 | A | 4 |

TABLE 3-continued

| Photothermographic material | Silver halide emulsion | γ value | Result of evaluation | Dmax |
|---|---|---|---|---|
| 35 | upper layer:2 + 3<br>lower layer:1 + 2 | 2.8 | A | 3.9 |
| 36 | upper layer:1 + 2 + 3<br>lower layer:1 + 2 | 2.7 | A | 3.7 |

As similar to Example 1, the developed images having γ value of 2.0 to 4.0 were uniform in density and exhibited an excellent image quality.

Example 5

1. Preparation of Silver Halide Emulsion (Preparation of Silver Halide Emulsion-4)

To 420 mL of distilled water was added 4.3 mL of a 1% by weight potassium iodide solution. Further, a liquid added with 3.5 mL of sulfuric acid having the concentration of 0.5 mol/L and 36.7 g of phthalated gelatin was kept at 42° C. while stirring in a stainless steel reaction pot, and thereto were added total amount of: solution A prepared through diluting 22.22 g of silver nitrate by adding distilled water to give the volume of 195.6 mL; and solution B prepared through diluting 21.8 g of potassium iodide with distilled water to give the volume of 218 mL, over 9 minutes at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 60 g of potassium iodide with distilled water to give the volume of 600 mL were added. A controlled double jet method was executed through adding total amount of the solution C at a constant flow rate over 120 minutes, accompanied by adding the solution D while maintaining the pAg at 8.1.

Hexachloroiridium(III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron(II) hexacyanide aqueous solution was added at a total amount of $3\times10^{-4}$ mol per one mol of silver. The mixture was adjusted to the pH of 3.8 with sulfuric acid at the concentration of 0.5 mol/L. After stopping stirring, the mixture was subjected to precipitation/desalting/water washing steps. The mixture was adjusted to the pH of 5.9 with sodium hydroxide at the concentration of one mol/L to produce a silver halide dispersion having the pAg of 8.0. Grains in thus prepared silver halide emulsion were pure silver iodide grains having a mean sphere equivalent diameter of 0.030 μm, a variation coefficient of 17%. Grain size and the like were determined from the average of 1000 grains using an electron microscope.

The above-mentioned silver halide dispersion was kept at 38° C. with stirring, and thereto was added 5 mL of a 0.34% by weight methanol solution of 1,2-benzoisothiazoline-3-one, followed by elevating the temperature to 47° C. At 20 minutes after elevating the temperature, sodium benzene thiosulfonate in a methanol solution was added at $7.6\times10^{-5}$ mol per one mol of silver, and then pAg was adjusted to 5.5. At additional 5 minutes later, a tellurium sensitizer C in a methanol solution was added at $2.9\times10^{-4}$ mol per one mol of silver and subjected to aging for 91 minutes. After adjusting pAg of the emulsion to 7.5, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver were added to produce a silver halide emulsion-4.

(Preparations of Silver Halide Emulsion-5 and -6)

Preparations of silver halide emulsion-5 and -6 were conducted in a similar manner to the process in the preparation of the silver halide emulsion-4 except that: the temperature of the liquid upon the nucleation process was altered from 42° C. to 50° C. or 60° C.

The mean sphere equivalent diameter of the emulsion grains in the silver halide emulsion-5 was 0.050 μm, and that of the grains in the silver halide emulsion-6 was 0.070 μm.

2. Preparation of Silver Salt of Fatty Acid

<<Preparations of silver salt of fatty acid-8 to -10>>

Preparations of silver salts of fatty acid-8 to -10 were conducted in the similar manner to the process in the preparation of silver salt of fatty acid-1 in Example 1, except using silver halide emulsion-4 to -6 instead of using silver halide emulsion-1.

<<Preparations of silver salt of fatty acid-11 to -14>>

Preparations of silver salts of fatty acid-11 to -14 were conducted in the similar manner to the process in the preparation of silver salt of fatty acid-1, except using mixtures of silver halide emulsion-4 to -6 with the rate shown in Table 4 instead of using silver halide emulsion-1.

3. Redispersion of Organic Silver Salt to Organic Solvent

Preparations of organic silver salt redispersion-8 to -14 were conducted in the similar manner to the process in the redispersion of organic silver salt in Example 1, except using above-mentioned silver salts of fatty acid-8 to -14 instead of using silver salts of fatty acid-1 to -7.

4. Preparations of Coating Solution for Image Forming Layer-37 to -43

Preparations of coating solution for image forming layer-37 to -43 were conducted in the similar manner to the process in the preparation of coating solution for image forming layer-1 to -7 in Example 1 except that: using either of above-mentioned organic silver salt redispersion-8 to -14 instead of using organic silver salt redispersion-1 to -7, and not adding the sensitizing dye-1 used in the preparation of coating solution for image forming layer-1 to -7 in Example 1.

5. Preparations of Photothermographic Material-37 to -48

Photothermographic material-37 to -43 were prepared by simultaneous double coating of either one of the coating solutions for image forming layer prepared above, and the coating solution for the surface protective layer prepared in Example 1 using a dual knife coater, on a reverse surface to the back layer of the support coated with the back layer. The coating was executed so that the image forming layer had the thickness after drying of 18.3 μm, and that the surface protective layer had the dry film thickness of 3.4 μm. This coating device has two knife coating blades which are laid side by side. After cutting the support to the size so that it meets with the volume of the solution used, knives equipped with a hinge were elevated to put them in a position on the coater floor. Then, the knives were brought down and fixed onto a predetermined position. The height of the knives was regulated using a wedge which was measured with an ammeter and which was controlled by a screw knob. Knife #1 was elevated up to a clearance corresponding to the thickness which was coordinated with total thickness of the substrate thickness and the desired wet thickness of the image forming layer (layer #1). Knife #2 was elevated up to the height equal to the total thickness of: support thickness+wet thickness of the image forming layer (layer #1)+desired thickness of the surface protective layer (layer #2). Thereafter, drying was performed with an air of the temperature of 75° C. and a dew point of 10° C. for 15 minutes.

In the case, the image forming layer is made of two layers, three knife coating blades were used, and the coating was executed so that the thickness after drying of each of the upper and the lower image forming layer became 9.15 μm. Preparations of photothermographic material-44 to -48 were conducted this way.

6. Exposure and Development

Photothermographic material-37 to -48 were processed in the similar manner to that of Example 1 except using blue laser beam instead of using semiconductor laser which is longitudinally multiple modulated at the wavelength of 800 nm through 820 nm in Example 1. The results are shown in Table 4.

Table 4.

TABLE 4

| Photothermographic material | Silver halide emulsion | γ value | Result of evaluation | Dmax |
|---|---|---|---|---|
| 37 | 4 | 5.3 | D | 5 |
| 38 | 5 | 4.6 | D | 4 |
| 39 | 6 | 4.1 | C | 3 |
| 40 | 4 + 5(9:1) | 3.8 | B | 4.9 |
| 41 | 4 + 6(9:1) | 3.2 | A | 4.8 |
| 42 | 5 + 6(9:1) | 3.6 | B | 4 |
| 43 | 4 + 5 + 6(8:1:1) | 3.1 | A | 4.7 |
| 44 | upper layer: 2<br>lower layer: 1 | 3.5 | B | 4.9 |
| 45 | upper layer: 3<br>lower layer: 2 | 3.3 | B | 4.2 |
| 46 | upper layer: 3<br>lower layer: 1 | 3 | A | 4.8 |
| 47 | upper layer: 2 + 3<br>lower layer: 1 + 2 | 2.9 | A | 4.7 |
| 48 | upper layer: 1 + 2 + 3<br>lower layer: 1 + 2 | 2.8 | A | 4.5 |

As shown in Table 4, in the case that using silver iodide, not adding sensitizing dyes and exposing with blue laser beam, the developed images having a γ value of 2.0 to 4.0 ware uniform in density and exhibited an excellent image quality, as similar to Example 1.

Example 6

1 Preparation of Coating Solution for Undercoat Layer

Formula (1) (For Undercoat Layer on the Image Forming Layer Side)

Pesresin A-520 manufactured by Takamatsu Oil & Fat Co., Ltd. (30% by weight solution) 59 g polyethyleneglycol monononylphenylether (average ethylene oxide number=8.5) 10% by weight solution 5.4 g MP-1000 manufactured by Soken Chemical & Engineering Co., Ltd. (polymer fine particle, mean particle diameter of 0.4 μm) 0.91 g distilled water 935 mL Formula (2) (For First Layer on the Back Surface)

Styrene-butadiene copolymer latex (solid content of 40% by weight, styrene/butadiene weight ratio=68/32) 158 g 8% by weight aqueous solution of 2,4-dichloro-6-hydroxy-S-triazine sodium salt 20 g 1% by weight aqueous solution of sodium laurylbenzenesulfonate 10 mL distilled water 854 mL Formula (3) (For Second Layer on the Back Surface)

$SnO_2$/SbO (9/1 weight ratio, mean particle diameter of 0.038 μm, 17% by weight dispersion) 84 g gelatin (10% by weight aqueous solution) 89.2 g METOLOSE TC-5 manufactured by Shin-Etsu Chemical Co., Ltd. (2% by weight aqueous solution) 8.6 g MP-1000 manufactured by Soken Chemical & Engineering Co., Ltd. 0.01 g 1% by weight aqueous solution of sodium dodecylbenzenesulfonate 10 mL NaOH (1% by weight) 6 mL Proxel (manufactured by Imperial Chemical Industries PLC) 1 mL distilled water 805 mL 2. Undercoating Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/$m^2$, and dried at 180° C. for 5 minutes. Furthermore, the aforementioned formula (3) of the coating solution for the undercoat was coated on the reverse face (back surface) with a wire bar so that the amount of wet coating became 7.7 mL/$m^2$, and dried at 180° C. for 6 minutes. Thus, an undercoated support was produced.

3. Preparation of Coating Solution for Back Layer (Preparation of Dispersion of Solid Fine Particles (a) of Base Precursor)

A base precursor compound-1 in an amount of 2.5 kg, and 300 g of a surfactant (trade name: DEMOL N, manufactured by Kao Corporation), 800 g of diphenyl sulfone, 1.0 g of benzoisothiazolinone sodium salt and distilled water were added to give the total amount of 8.0 kg and mixed. The mixed liquid was subjected to beads dispersion using a horizontal sand mill (UVM-2: manufactured by IMEX Co., Ltd.). Process for dispersion included feeding the mixed liquid to UVM-2 packed with zirconia beads having the mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion (D450/D650) became 3.0 upon spectral absorption measurement. Thus resulting dispersion was diluted with distilled water so that the concentration of the base precursor became 25% by weight, and filtrated (with a polypropylene filter having the mean fine pore diameter of 3 μm) for eliminating dust to put into practical use.

4. Preparation of Coating Solution for Antihalation Layer (Preparation of Dispersion of Solid Fine Particle of Dye)

A cyanine dye compound-1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion (D650/D750) became 5.0 or greater upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

(Preparation of Coating Solution for Antihalation Layer)

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L aqueous sodium hydroxide solution, 40 g of the aforementioned dispersion of the solid fine particle of the dye, 90 g of the aforementioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis (vinylsulfone acetamide) was admixed to give a coating solution for the antihalation layer.

5. Preparation of Coating Solution for Back Surface Protective Layer

A vessel was kept at 40° C., and thereto were added 40 g of gelatin, 35 mg of benzoisothiazolinone and 840 ml of water to allow gelatin to be dissolved. Additionally, 5.8 ml of a 1 mol/L aqueous sodium hydroxide solution, liquid paraffin emulsion at 1.5 g equivalent to liquid paraffin, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorochemical surfactant (F-1), 2.4 mL of a 2% by weight solution of a fluorocarbon surfactant (F-2), and 32 g of a 19% by weight solution of methyl methacrylate/styrene/butyl acrylate/hydroxyethyl methacrylate/acrylic acid copolymer (copolymer weight ratio of 57/8/28/5/2) latex were admixed. Just prior to the coating, 25 mL of a 4% by weight aqueous solution of N,N-ethylenebis (vinylsulfone acetamide) was admixed to give a coating solution for the back surface protective layer.

6. Coating of Back Layer

The back surface side of the undercoated support as described above was subjected to simultaneous double coating so that the coating solution for the antihalation layer gives the coating amount of gelatin of 0.52 g/m$^2$, and so that the coating solution for the back surface protective layer gives the coating amount of gelatin of 1.7 g/m$^2$, followed by drying to produce a back layer.

7. Preparations of Image Forming Layer, Intermediate Layer, and Surface Protective Layer 7-1. Preparation of Materials for Coating (Silver Halide Emulsion)

<<Preparation of Silver Halide Emulsion-7>>

To 1421 mL of distilled water was added 3.1 mL of a 1% by weight potassium bromide solution. Further, a liquid added with 3.5 mL of sulfuric acid having the concentration of 0.5 mol/L and 31.7 g of phthalated gelatin was kept at 30° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Hexachloroiridium(III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron(II) hexacyanide aqueous solution was added at a total amount of $3\times10^{-4}$ mol per one mol of silver. The mixture was adjusted to the pH of 3.8 with sulfuric acid at the concentration of 0.5 mol/L. After stopping stirring, the mixture was subjected to precipitation/desalting/water washing steps. The mixture was adjusted to the pH of 5.9 with sodium hydroxide at the concentration of one mol/L to produce a silver halide dispersion having the pAg of 8.0.

The silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes. Thereafter, a methanol solution of a spectral sensitizer A and a spectral sensitizer B with a molar ratio of 3:1 was added thereto at $1.2\times10^{-3}$ mol in total of the spectral sensitizer A and B per one mol of silver. At one minute later, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver, and 1-(3-methylureidophenyl)-5-mercaptotetrazole in an aqueous solution at $8.5\times10^{-3}$ mol per one mol of silver were added to produce a silver halide emulsion-7.

Grains in thus prepared silver halide emulsion were silver iodide bromide grains having a mean sphere equivalent diameter of 0.042 μm, a variation coefficient of 20%, which uniformly include iodine at 3.5 mol %. Grain size and the like were determined from the average of 1000 grains using an electron microscope. The [100] face ratio of these grains were found to be 80% using a Kubelka-Munk method.

<<Preparation of Silver Halide Emulsion-8>>

Preparation of silver halide emulsion-8 was conducted in a similar manner to the process in the preparation of the silver halide emulsion-7 except that: the temperature of the liquid upon the nucleation process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium iron(II) hexacyanide was deleted. The precipitation/desalting/water washing/dispersion were carried out similarly to the silver halide emulsion-7. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion-7 except that: the amount of the tellurium sensitizer C to be added was changed to $1.1\times10^{-4}$ mol per one mol of silver; the amount of the methanol solution of the spectral sensitizer A and a spectral sensitizer B with a molar ratio of 3:1 to be added was changed to $7.0\times10^{-4}$ mol in total of the spectral sensitizer A and the spectral sensitizer B per one mol of silver; the addition of 1-phenyl-2-heptyl-5-mercapto-1,3,4-triazole was changed to give $3.3\times10^{-3}$ mol per one mol of silver; and the addition of 1-(3-methylureidophenyl)-5-mercaptotetrazole was changed to give $4.7\times10^{-3}$ mol per one mol of silver to produce a silver halide emulsion-8. The emulsion grains in the silver halide emulsion-8 were pure cubic silver bromide grains having a mean sphere equivalent diameter of 0.080 μm and a variation coefficient of 20%.

<<Preparation of Silver Halide Emulsion-9>>

Preparation of a silver halide emulsion-9 was conducted in a similar manner to the process in the preparation of the silver halide emulsion-7 except that the temperature of the liquid upon the nucleation process was altered from 30° C. to 27° C. In addition, the precipitation/desalting/water washing/dispersion were carried out similarly to the silver halide emulsion-7. Silver halide emulsion-9 was obtained similarly to the emulsion-7 except that: the addition of the methanol solution of the spectral sensitizer A and the spectral sensitizer B was changed to the solid dispersion (aqueous gelatin solution) at a molar ratio of 1:1 with the amount to be added being $6.0\times10^{-3}$ mol in total of the spectral sensitizer A and spectral sensitizer B per one mol of silver; the amount of the tellurium sensitizer C to be added was changed to $5.2\times10^{-4}$ mol per one mol of silver; and bromoauric acid at $5\times10^{-4}$ mol per one mol of silver and potassium thiocyanate at $2\times10^{-3}$ mol per one mol of silver were added at 3 minutes following the addition of the tellurium sensitizer. The grains in the silver halide emulsion-9 were silver iodide bromide grains having a mean sphere equivalent diameter of 0.034 μm and a variation coefficient of 20%, which uniformly include iodine at 3.5 mol %.

<<Preparation of Mixed Emulsion A for Coating Solution>>

The silver halide emulsion-7 at 70% by weight, the silver halide emulsion-8 at 15% by weight and the silver halide emulsion-9 at 15% by weight were dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution, and 1-(3-methylureidophenyl)-5-mercaptotetrazole was added to give 0.34 g per 1 kg of the mixed emulsion for a coating solution.

(Preparation of Dispersion of Silver Salt of Fatty Acid)

<<Preparation of Dispersion of Silver Salt of Fatty Acid G>>

Behenic acid, arachidic acid, stearic acid and lignoceric acid, each purified as in Example 1, were mixed to give 65, 20, 10 and 5 mol %, respectively. 87.6 kg of the mixed fatty acid, 423 L of distilled water, 49.2 L of an aqueous NaOH solution at the concentration of 5 mol/L, 120 L of t-butyl alcohol were admixed, and subjected to a reaction with stirring at 75° C. for one hour to give a solution A of a sodium salt of fatty acids. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution A of a sodium salt of fatty acids and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution A of a sodium salt of fatty acids was thereafter started, and during 14 minutes and 15 seconds following the completion of adding the aqueous silver nitrate solution, the added material was restricted to the solution A of a sodium salt of fatty acids alone. The temperature inside of the reaction vessel was then set to be 30° C., and the temperature outside was controlled so that the liquid temperature could be kept constant. In addition, the temperature of a pipeline for the addition system of the solution A of a sodium salt of fatty acids was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution A of a sodium salt of fatty acids was added and the position at which the aqueous silver nitrate solution was added were arranged symmetrically with a shaft for stirring located at a center. Moreover, both of the positions were adjusted to avoid contact with the reaction liquid.

After completing the addition of the solution A of a sodium salt of fatty acids, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of the fatty acids was thus obtained. The resulting solid matters were stored as a wet cake without drying.

When the shape of the resulting particles of the silver salt of the fatty acids was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver salt of the fatty acids. For the cooling manipulation, coiled heat exchangers were equipped fore and aft of the interaction chamber respectively, and accordingly, the temperature for the dispersion was set to be 18° C. by regulating the temperature of the cooling medium.

(Preparation of Reducing Agent Dispersion)<

<<Preparation of Reducing Agent-1 Dispersion>>

To 10 kg of a reducing agent-I (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to thermal treatment at 60° C. for 5 hours to obtain a reducing agent-1 dispersion. Particles of the reducing agent included in thus resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of a reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent thermal treatment at 80° C. for one hour to obtain a reducing agent-2 dispersion. Particles of the reducing agent included in thus resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

(Preparation of Hydrogen Bonding Compound Dispersion)

To 10 kg of a hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent thermal treatment at 80° C. for one hour to obtain a hydrogen bonding compound dispersion. Particles of the hydrogen bonding compound included in thus resulting hydrogen bonding compound-1 dispersion had a median diameter of 0.45 μm, and a maximum particle diameter of 1.3 μm or less. The resultant hydrogen bonding compound-1 dispersion was subjected to filtration with a polypropylene filter having a pore size of 3.0 μm to remove foreign substances such as dust, and stored.

(Preparation of Development Accelerator-1 Dispersion)

To 10 kg of a development accelerator-1 and 20 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minuets. Thereafter, 0.2 g of a benzoisothiazolinone sodium salt and water were added thereto, thereby adjusting the concentration of the development accelerating agent to be 20% by weight. Accordingly, a development accelerator-1 dispersion was obtained. Particles of the development accelerator included in thus resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of a development accelerator-2 and a color-tone-adjusting agent-1, dispersion was executed in a similar manner to the development accelerator-1, and thus dispersions of 20% by weight and 15% by weight were respectively obtained.

(Preparation of Polyhalogen Compound)

<<Preparation of Organic Polyhalogen Compound-1 Dispersion>>

An organic polyhalogen compound-1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound-1 dispersion was obtained. Particles of the organic polyhalogen compound included in thus resulting polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were added, and thoroughly admixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound -2 dispersion. Particles of the organic polyhalogen compound included in thus resulting polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

(Preparation of Phthalazine Compound-1 Solution)

Modified polyvinyl alcohol MP203 manufactured by Kuraray Co., Ltd., in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of a phthalazine compound-1 (6-isopropyl phthalazine) to prepare a 5% by weight phthalazine compound-1 solution.

(Preparation of Mercapto Compound)

<<Preparation of an Aqueous Solution of Mercapto Compound-1>>

A mercapto compound-1 (1-(3-sulfophenyl)-5-mercaptotetrazole sodium salt) in an amount of 7 g was dissolved in 993 g of water to give a 0.7% by weight aqueous solution.

<<Preparation of an Aqueous Solution of Mercapto Compound-2>>

A mercapto compound-2 (1-(3-methylureidophenyl)-5-mercaptotetrazole) in an amount of 20 g was dissolved in 980 g of water to give a 2.0% by weight aqueous solution.

(Preparation of Pigment-1 Dispersion)

C.I. Pigment Blue 60 in an amount of 64 g and 6.4 g of DEMOL N manufactured by Kao Corporation were added to 250 g water and thoroughly mixed to give slurry. Zirconia beads having the mean particle diameter of 0.5 mm were provided in an amount of 800 g, and charged in a vessel with the slurry. Dispersion was performed with a dispersing machine (1/4G sand grinder mill: manufactured by IMEX Co., Ltd.) for 25 hours. Thereto was added water to adjust so that the concentration of the pigment became 5% by weight to obtain a pigment-1 dispersion. Particles of the pigment included in thus resulting pigment dispersion had a mean particle diameter of 0.21 μm.

(Preparation of SBR Latex Solution)

SBR latex was prepared as described below.

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/liter NaOH, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereinto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/liter NaOH and $NH_4OH$ to give the molar ratio of $Na^-$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.).

7-2. Preparation of Coating Solutions (Preparation of Coating Solution for Image Forming Layer-12)

The dispersion G of the silver salt of fatty acid obtained as described above in an amount of 1000 g, 135 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 153 g of the reducing agent-2 dispersion, 55 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution were serially added. The coating solution for the image forming layer prepared by adding 140 g of the silver halide mixed emulsion A thereto followed by thorough mixing just prior to the coating was fed directly to a coating die, and was coated.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 43, 41, 28, and 20 [mPa·s], respectively, at the shearing rate of 0.1, 1, 10, 100, 1000 [1/second].

The amount of zirconium in the coating solution was 0.32 mg per one g of silver.

(Preparation of Coating Solution for Intermediate Layer)

To 1000 g of polyvinyl alcohol PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

(Preparation of Coating Solution for Intermediate Layer)

To 1000 g of polyvinyl alcohol PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with NaOH to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

(Preparation of Coating Solution for First Layer of Surface Protective Layers)

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

(Preparation of Coating Solution for Second Layer of Surface Protective Layers)

In 800 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of a fluorocarbon surfactant (F-2), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm), and were mixed to give a coating solution for the surface protective layer, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

7-3. Coating of Photothermographic Material-51

The back surface side of the undercoated support was subjected to simultaneous double coating so that the coating solution for the antihalation layer gives the coating amount of gelatin of 0.52 g/m$^2$, and so that the coating solution for the back surface protective layer gives the coating amount of gelatin of 1.7 g/m$^2$, followed by drying to produce a back layer.

Reverse surface of the back surface was subjected to simultaneous overlaying coating by a slide bead coating method in order of the image forming layer, intermediate layer, first layer of the surface protective layer and second layer of the surface protective layer starting from the undercoated face, and thus a sample of the photothermographic material was produced. In this method, the temperature of the coating solution was adjusted to 31° C. for the image forming layer and intermediate layer, to 36° C. for the first layer of the surface protective layer, and to 37° C. for the second layer of the surface protective layer.

The coating amount of each compound for the image forming layer (g/m$^2$) is as follows.

| | |
|---|---|
| Silver salt of fatty acid | 5.27 |
| Pigment (C. I. Pigment Blue 60) | 0.036 |
| Polyhalogen compound-1 | 0.14 |
| Polyhalogen compound 2 | 0.28 |
| Phthalazine compound-1 | 0.18 |
| SBR latex | 9.43 |
| Reducing agent-2 | 0.77 |
| Hydrogen bonding compound-1 | 0.28 |
| Development accelerator-1 | 0.019 |
| Development accelerator-2 | 0.016 |
| Color-tone-adjusting agent-1 | 0.006 |
| Mercapto compound-2 | 0.003 |
| Silver halide (on the basis of Ag content) | 0.13 |

Conditions for coating and drying are as follows.

Coating was performed at the speed of 160 m/min, with the clearance between the leading end of the coating die and the support being 0.10 mm to 0.30 mm, and with the pressure in the vacuum chamber set to be lower than atmospheric pressure by 196 Pa to 882 Pa. The support was decharged by ionic wind prior to coating.

In the subsequent cooling zone, the coating solution was cooled by wind having the dry-bulb temperature of 10° C. to 20° C. Thereafter, conveyance with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C. After heating, the film surface was cooled to 25° C.

Thus prepared photothermographic material had the matness of 550 seconds on the image forming layer side surface, and 130 seconds on the back surface as Beck's smoothness.

In addition, measurement of the pH of the film surface on the image forming layer side surface gave the result of 6.0.

Chemical structures of the compounds used in Examples of the invention are shown below.

Spectral sensitizer A

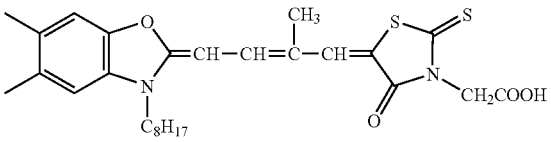

Spectral sensitizer B

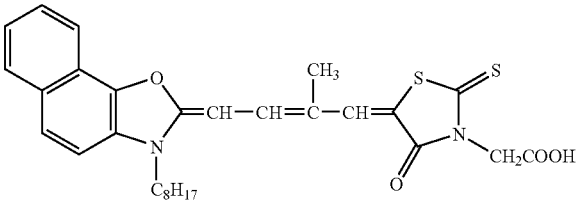

Tellurium Sensitizer C

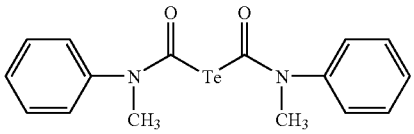

Base Precursor-1

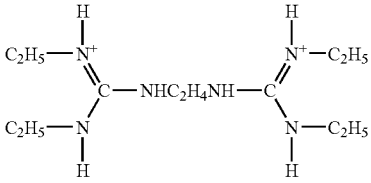

Phthalazine Compound-1

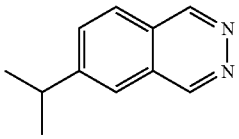

Color-Tone-Adjusting Agent-1

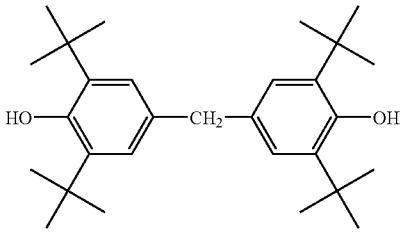

Development Accelerator-1

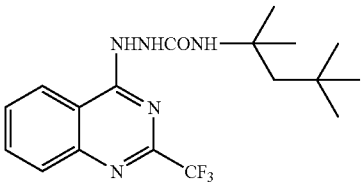

-continued

Development Accelerator-2

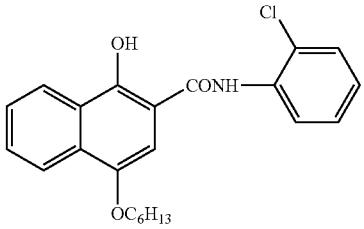

Cyanine Dye-1

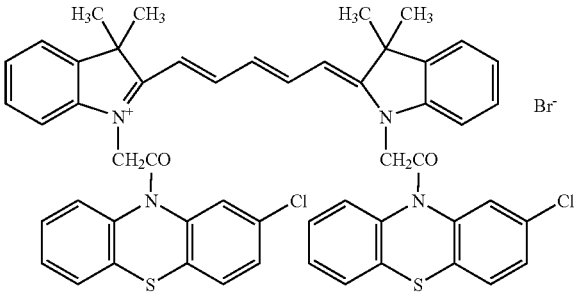

Blue Dye-1

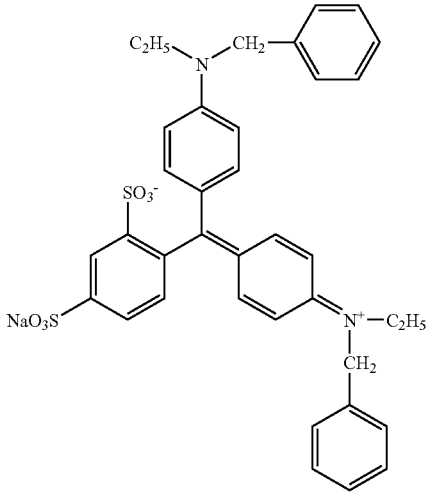

F-1 $CF_3(CF_2)_nCH_2CH_2SCH_2CH_2COOLi$
mixture of n=5~11

F-2 $CF_3(CF_2)_nCH_2CH_2O(CH_2CH_2O)_mH$
mixture of n=5~11 and m=5~15

8. Evaluation of Photographic Performances

1) Preparation and Packaging Material

Preparation and packaging materials employed were similar to those in Example 1.

2) Exposure and Development of Photothermographic Materials

<<Condition 1>>

Exposure and thermal development (18.8 seconds in total with 4 panel heaters set to be 105° C.-105° C.-121° C.-121° C.) were performed with Fuji Medical Dry Laser Imager FM-DP L (equipped with 660 nm semiconductor laser having the maximum output of 60 mW (IIIB)). Evaluation of thus resulting images was carried out with a densitometer. Line speed in this process was 21.3 mm/sec.

<<Condition 2>>

Exposure and thermal development (14 seconds in total with 3 panel heaters set to be 107° C.-121° C.-121° C.) were performed with a laser imager (equipped with 660 nm semiconductor laser having the maximum output of 50 mW (IIIB)) described in Japanese Patent Application No. 2002-088832 and Japanese Patent Application No. 2002-091114. Evaluation of thus resulting images was carried out with a densitometer. Line speed in this process was 28.6 mm/sec.

3) Evaluation of Photographic Performance

Evaluation of photographic performance was carried out in a similar manner to Example 1. The results are shown in Table 5.

TABLE 5

| Photo-thermographic material | Behenic acid (mol %) | Difference in the tone between the top and the last end of processing: Thermaldevelopment condition1 | Thermaldevelopment condition2 | Fog |
|---|---|---|---|---|
| 51 | 65 | A | A | 0.18 |

As shown in Table 5, output of stable images can be achieved with few differences found in color tone, as far as the content of silver salt of fatty acid is in the range from 30 mol % to 85 mol %, even if a sample was prepared with a coating solution of which solvent is water.

Example 7

1. Preparation of PET Support and Undercoating

PET support having thickness of 175 μm was prepared and undercoating was conducted in the similar manner to Example 1.

2. Preparation and Coating of Coating Solution for Back Layer

To 830 g of MEK were added 84.2 g of cellulose acetate butyrate (Eastman Chemical, CAB381-20) and 4.5 g of a polyester resin (Bostic Co., Vitel PE2200B) with stirring, and dissolved. To this dissolved solution was added 0.30 g of dye-2, and thereto were added 4.5 g of a fluorocarbon surfactant (Asahi Glass Co., Ltd., Surflon HK40) which had been dissolved in 43.2 g of methanol, and 2.3 g of a fluorocarbon surfactant (Dai-Nippon Ink & Chemicals, Inc., Megafac(R) F120K). The mixture was thoroughly stirred until dissolution was completed. Finally, 75 g of silica (W. R. Grace Co., Siloid 64×6000) dispersed in methyl ethyl ketone at a concentration of 1% by weight with a dissolver type homogenizer was added thereto followed by stirring to prepare a coating solution for the back layer.

Thus prepared coating solution for the back layer was coated on the support with an extrusion coater so that the dry film thickness became 3.5 μm and dried. Drying was executed by a hot air with a temperature of 100° C., and a dew point of 10° C. over 5 minutes.

3. Image Forming Layer and Surface Protective Layer 3-1. Preparation of Materials for Coating 1) Silver Halide Emulsion (Preparation of Silver Halide Emulsion-10)

In 5429 mL of water, 88.3 g of phenyl carbamoyl gelatin, 10 mL of a 10% by weight aqueous methanol solution of a PAO compound $(HO(CH_2CH_2O)_n—(CH(CH_3)CH_2O)_{17}—(CH_2CH_2O)_m—H$; m+n=5 to 7) and 0.32 g of potassium bromide were added and dissolved. To the resulting solution kept at 45° C., were added 659 mL of a 0.67 mol/L aqueous silver nitrate solution, and a solution including KBr at 0.703 mol and KI at 0.013 mol dissolved per one liter using a mixing and stirring machine disclosed in JP-B Nos. 58-58288 and 58-58289, while controlling the pAg of 8.09 by a parallel mixing process over 4 minutes and 45 seconds to proceed a neuclization. At one minute later, 20 mL of a 0.63 N potassium hydroxide solution was added thereto. After the lapse of 6 minutes, thereto were added 1976 mL of a 0.67 mol/L aqueous silver nitrate solution, and a solution including KBr at 0.657 mol, potassium iodide at 0.013 mol and potassium secondary iridiumate hexachloride at 30 μmol dissolved per 1 liter while controlling the temperature at 45° C. and pAg of 8.09 by a parallel mixing process over 14 minutes and 15 seconds. After stirring for 5 minutes, the mixture was cooled to 40° C.

Thereto was added 18 mL of a 56% by weight aqueous acetic acid solution to precipitate a silver halide emulsion. The supernatant was removed so that 2 L of a precipitate portion remains. To the precipitate portion was added 10 L of water followed by stirring to precipitate the silver halide emulsion once again. Moreover, the supernatant was removed to leave 1.5 L of a precipitate portion, and 10 L of water was further added to the precipitate portion followed by stirring to precipitate the silver halide emulsion. After removing the supernatant to leave 1.5 L of a precipitate portion, thereto was added a solution of 1.72 g of sodium carbonate anhydride dissolved in 151 mL of water. Then, the mixture was warmed to 60° C., and stirring was conducted for additional 120 minutes. Finally, the solution was adjusted to pH of 5.0, and water was added thereto to yield 1161 g per one mol of the amount of silver.

The grains in this emulsion were monodispersing cubic silver iodide bromide grains having a mean sphere equivalent diameter of 0.058 μm, a variation coefficient of the sphere equivalent diameter of 12%, and the [100] face ratio of 92%. Grain size and the like were determined from the average of 1000 grains using an electron microscope.

2) Preparation of Silver Salt of Fatty Acid

<<Preparation of Silver Salt of Fatty Acid-15>>

To 4720 mL of purified water were added behenic acid, arachidic acid, and stearic acid at 0.7552 mol in total with a ratio 40 mol %, 30 mol % and 20 mol %, respectively. After dissolving at 80 C, 540.2 mL of a 1.5 N aqueous NaOH solution was added to the solution, and thereto was added 6.9 mL of concentrated nitric acid, followed by cooling to 55° C. to obtain a solution of sodium salt of organic acid. While keeping the temperature of the sodium salt of organic acid solution at 55° C., 45.3 g of the aforementioned silver halide emulsion and 450 mL of purified water were added thereto. The mixture was stirred with a homogenizer manufactured by IKA JAPAN Co. (ULTRA-TURRAXT-25) at 13200 rpm (corresponding to 21.1 kHz of mechanical vibration frequency) for 5 minutes. Then, 702.6 mL of a 1 mol/L silver nitrate solution was added thereto over 2 minutes, followed by stirring for 10 minutes to obtain an organic silver salt dispersion. Thereafter, the resulting organic silver salt dispersion was transferred to a washing vessel, and thereto was added deionized water followed by stirring. The mixture was allowed to stand still so that the organic silver salt dispersion was floatated, and thus water soluble salts present in the bottom part were removed. Then, washing with deionized water and drainage of the waste water was repeated until the electric conductivity of the waste water became 2 μS/cm. After performing centrifugal dewatering, drying in a circulating dryer was performed with warm air having the oxygen partial pressure of 10% by volume at 40° C. until weight loss did not take place to obtain the silver salt of fatty acid-15 powder including photosensitive silver halide.

3) Redispersion of Organic Silver Salt to Organic Solvent

<<Preparation of Organic Silver Salt Redispersion-15>>

Polyvinyl butyral powder (Monsanto Co., Butvar B-79) in an amount of 14.57 g was dissolved in 1457 g of methyl ethyl ketone (MEK), and thereto was gradually added 500 g of aforementioned powdery silver salt of fatty acid-15 while stirring with Dissolver DISPERMAT CA-40M type manufactured by VMA-GETZMANN Co., and thoroughly mixed to yield a slurry.

The slurry was subjected to two passes dispersion with a GM-2 pressure type homogenizer manufactured by SMT Limited to prepare a photosensitive emulsion fluid dispersion. Upon this operation, the pressure for treatment with first-pass was set to be 280 kg/cm$^2$, whilst the pressure for treatment with second-pass was set to be 560 kg/cm$^2$.

3-2. Preparations of Coating Solutions (Coating Solution for Image Forming Layer-61)

MEK was added in an amount of 15.1 g to 50 g of the aforementioned redispersion of organic silver salt-15, and the mixture was kept at 21° C. while stirring with a dissolver type homogenizer at 1000 rpm. Thereto was added 390 μL of a 10% by weight methanol solution of an aggregate of: two molecules of N,N-dimethyl acetamide/one molecule of oxalic acid/one molecule of bromine, followed by stirring for 1 hour. Furthermore, thereto was added 494 μL of a 10% by weight methanol solution of calcium bromide, and the mixture was stirred for 20 minutes. Subsequently, 167 mg of a methanol solution containing 15.9% by weight of dibenzo-18-crown-6 and 4.9% by weight of potassium acetate was added to the mixture, followed by stirring for 10 minutes. Then, thereto was added 2.6 g of a MEK solution of 0.24% by weight spectral sensitizer-4, 18.3% by weight 2-chlorobenzoic acid, 34.2% by weight salicylic acid-p-toluenesulfonate and 4.5% by weight 5-methyl-2-mercaptobenzimidazole, followed by stirring for one hour. Thereafter, the mixture was cooled to 13° C., and stirred for additional 30 minutes. After adding 13.31 g of polyvinyl butyral (Monsanto Co., Butvar B-79) while keeping the temperature at 13° C., followed by stirring for 30 minutes, 1.08 g of a 9.4% by weight tetrachlorophthalic acid solution was added thereto, followed by stirring for 15 minutes. While keeping stirring, 10.0 g of a 20% by weight MEK solution of the aforementioned reducing agent R-2, and 12.4 g of a 1.1% by weight MEK solution of 4-methyl phthalic acid and dye were added. Then was subsequently added 1.5 g of 10% by weight Desmodur N3300 (Mobay, aliphatic isocyanate). Further, thereto was added 4.27 g of an MEK solution of 7.4% by weight tribromomethyl-2-azaphenylsulfone and 7.2% by weight phthalazine to obtain coating solution for image forming layer-61.

(Preparation of Coating Solution for Surface Protective Layer-1)

Preparation of coating solution for surface protective layer-1 was conducted in the similar manner to Example 1.

3-3. Preparations of Photothermographic Materials

1) Preparations of photothermographic material-61 and -62

Photothermographic material-61 and -62 were prepared by simultaneous double coating of the aforementioned coating solution for image forming layer-61, and the coating solution for the surface protective layer-1 using a dual knife coater, on a reverse surface to the back layer of the support coated with the back layer. The coating of image forming layer was executed so that the total coating amount of fatty acid becomes the amount shown in Table 6, and that the surface protective layer had the dry film thickness of 1.5 μm. This coating device has two knife coating blades which are laid side by side. After cutting the support to the size so that it meets with the volume of the solution used, knives equipped with a hinge were elevated to put them in a position on the coater floor. Then, the knives were brought down and fixed onto a predetermined position. The height of the knives was regulated using a wedge which was measured with an ammeter and which was controlled by a screw knob. Knife #1 was elevated up to a clearance corresponding to the thickness which was coordinated with total thickness of the substrate thickness and the desired wet thickness of the image forming layer (layer #1). Knife #2 was elevated up to the height equal to the total thickness of: support thickness+wet thickness of the image forming layer (layer #1)+desired thickness of the surface protective layer (layer #2). Thereafter, drying was performed with an air of the temperature of 75° C. and a dew point of 10° C. for 15 minutes.

2) Preparations of photothermographic material-63 to -65

Preparations of photothermographic materal-63 to -65 was conducted in the similar manner to photothermographic materal-61 and -62, except that: the thickness of the surface protective layer was changed to 3.0 μm in stead of 1.5 μm, and the coating amount was adjusted so that the amount of fatty acid become the amount shown in Table 6.

Chemical structure of the compound used in Example of the invention is shown below.

Spectral Sensitizer-4

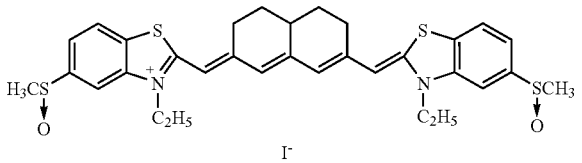

4. Evaluation of Photographic Performance

1) Preparation

Preparation and packaging materials employed were similar to those in Example 1.

2) Exposure and Development of Photothermographic Materials

An exposure machine was manufactured by way of trial, with semiconductor laser, which was longitudinally multiple modulated at the wavelength of 800 nm through 820 nm with high frequency superposition, as an exposure light source. Exposure was provided by laser scanning using this exposure machine to the image forming layer surface side of the sample-61 to -65 prepared as described hereinabove. Upon the exposure, images were recorded with an incident angle of the scanning laser beam to the surface of the photothermographic materials set to be 75°. After that, the photothermographic materials were developed at 124° C. and for 15 seconds using an automatic processor having a heating drum and being set to contact the protective layer of the photothermographic materials with the surface of the heating drum. The evaluations of the obtained images were performed with Macbeth densitometer. In this case, thinking that the part where the laser beam was exposed to the exposure site of photothermographic materials is an exposing section and that the part where exposed photothermographic materials touched the heating drum is an developing section, the distance between an exposing section and a developing section was 15 cm.

Using thus processor, the samples cut into a half-cut size were exposed uniform to give the optical density of 1.2, and 5000 sheets of the samples were processed continuously.

3) Results of Evaluation

<Evaluation of the Influence of Volatilization Materials>

The image of the last photothermographic material processed continuously was used to evaluate the uniformity of the density and ranked to 4 levels.

A; the excellent images with a high uniformity and the best color toned,

B; better images having a slight irregularity in a density and an image color tone, C; images observed an irregularity in a density and an image color tone, which may be allowable to be used practically in a market, D; images having an actual irregularity in a density and an image color tone, which may be troubled to be used practically in a market.

TABLE 6

| Photothermographic material | Coating amount of fatty acid (mmol/m$^2$) | Thickness of protective layer (μm) | Result of evaluation |
|---|---|---|---|
| 61 | 25 | 1.5 | D |
| 62 | 17 | 1.5 | C |
| 63 | 25 | 3.0 | D |
| 64 | 17 | 3.0 | B |
| 65 | 14 | 3.0 | A |

As shown in Table 6, in photothermographic material-62, -64 and -65 having mol converted fatty acid of 5 mmol/m$^2$ to 18 mmol/m$^2$, an improvement of the uniformity of density can be seen.

Especially, in photothermographic material-65 having mol converted fatty acid of 14 mmol/m$^2$ and thickness of the surface layer of 3 μm, the result was excellent.

Further, photothermographic material-61, which is obviously not uniform in density, were processed 5000 sheets continuously and then, around the exposing section (mirror and so on) and around the developing section were cleaned and after that, one sheet of photothermographic material-61 and one sheet of photothermographic material-65 were processed. The results of both photothermographic material-61 and -65 were ranked A. From this result, it can be considered that the contrast of the density was occurred by the stains which are around the exposing section and around the developing section and the stains were given by the volatilization materials coming from the photothermographic materials processed continuously.

Example 8

<<Preparations of Coating Solution for Surface Protective Layer-2 to -11>>

Preparations of coating solution for surface protective layer-2 to -11 were conducted in the similar manner to that of surface protective layer-1 except that the 10 kinds of compounds having —NH— bond shown in Table 7 are added in the amount shown in Table 7.

<<Preparations of Photothermographic Material-66 to 75>>

Photothermographic materials-66 to -75 were prepared by simultaneous double coating of the coating solution for image forming layer-61, and either one of the aforementioned coating solution for the surface protective layer-2 to -11 using a dual knife coater, on a reverse surface to the back layer of the support coated with the back layer. The coating of image forming layer was executed so that the coating amount of mol reduced fatty acid of silver salt of fatty acid and fatty acid becomes 17 mmol/m$^2$, and that the surface protective layer had the dry film thickness of 1.5 μm.

TABLE 7

| Photothermographic material | Coating solution for surface protective layer | Compound having —NH—bond | Addition amount (g/m$^2$) | Coating solution for image forming layer | Coating amount of fatty acid (mmol/m$^2$) | Thickness of protective layer (μm) | Result of evaluation |
|---|---|---|---|---|---|---|---|
| 62 | 1 | — | — | 1 | 17 | 1.5 | C |
| 66 | 2 | 2-acrylamide-2-methylpropanesulfonate | 0.52 | 1 | 17 | 1.5 | A |
| 67 | 3 | glycolylurea | 0.52 | 1 | 17 | 1.5 | A |
| 68 | 4 | succinic amide | 0.52 | 1 | 17 | 1.5 | A |
| 69 | 5 | 5-dimethylhydantoin | 0.52 | 1 | 17 | 1.5 | A |
| 70 | 6 | allantoin | 0.52 | 1 | 17 | 1.5 | A |
| 71 | 7 | isocyanuric acid | 0.52 | 1 | 17 | 1.5 | A |
| 72 | 8 | 3,5-dimethyl-1-phenylpyrazole | 0.52 | 1 | 17 | 1.5 | A |
| 73 | 9 | 5-methylbenztriazole | 0.52 | 1 | 17 | 1.5 | A |
| 74 | 10 | 3-amino-5,6-dimethyl-1,2,4-triazine | 0.52 | 1 | 17 | 1.5 | A |
| 75 | 11 | 6-methyl-8-hydroxytriazolopyridazine | 0.52 | 1 | 17 | 1.5 | A |

Evaluations were performed in the similar manner to Example 7.

As shown in Table 7, the results of evaluations were excellent. The developed images were uniform in density when the compounds having —NH— bond are added.

Example 9

<<Comparison Example; Preparation of Coating Solution for Barrier Layer-1>>

Coating solution for barrier layer-1 was prepared by adding 0.26 g of VS-1 (vinyl sulfone compound shown by the formula below) dissolved in 183 g of MEK to 15 g of cellose acetate butylate (CAB171-15S, Eastman Chemicals Co. Ltd.).

VS-1 $(CH{=}CHSO_2CH_2)_2CHOH$

<<The Present Invention; Preparation of Coating Solution for Barrier Layer-2>>

To 15 g of poly(vinyl alcohol) (Kurare Co. Ltd.) was added 50% by weight coloidal silica, and thereto was added VS-1 (vinyl sulfone compound shown by the formula below) dissolved in 183 g of MEK to 15 g of cellulose acetate butylate (CAB171-15S, Eastman Chemicals Ltd.) to obtain the coating solution.

<<The Present Invention; Preparations of Coating Solution for Barrier Layer-3 to -8>>

Preparations of coating solution for barrier layer-3 to -8 were conducted in the similar manner to that of coating solution for barrier layer-2 expect that using either one of the following polyesters-1 to -6 instead of poly(vinyl alcohol) used in the preparation of coating solution for barrier layer-2.

| | Polyester | Average Molecular Weight (Mn) | Tg (° C.) |
|---|---|---|---|
| 1 | 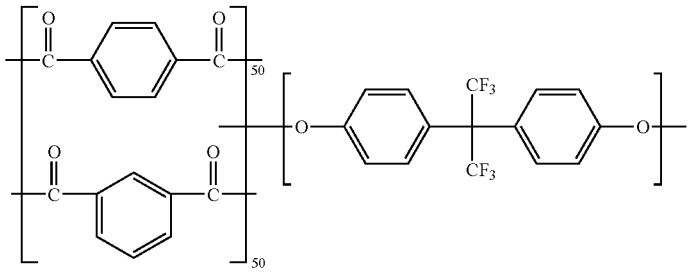 | 29,900 | 223 |
| 2 | 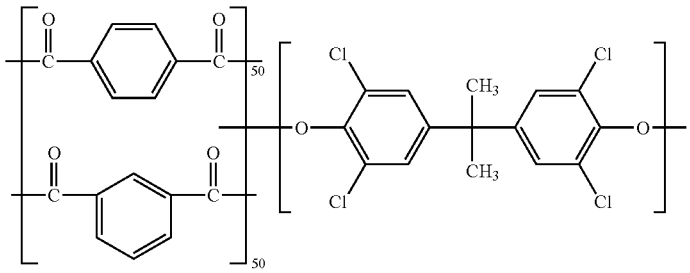 | 38,800 | 231 |
| 3 | 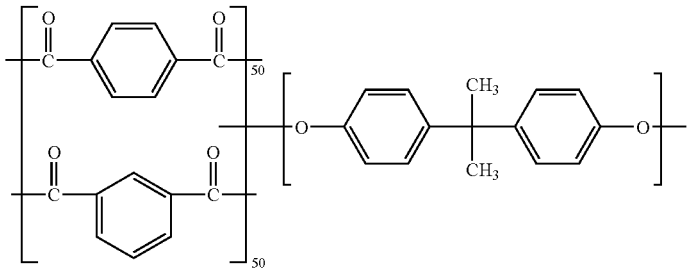 | 32,100 | 170 |
| 4 | 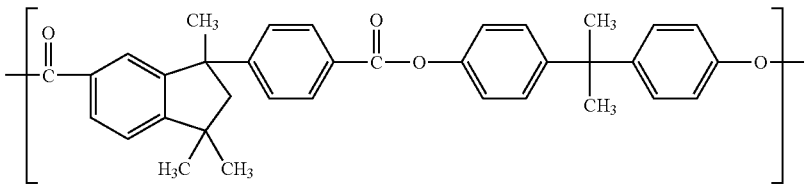 | 30,500 | 247 |
| 5 | 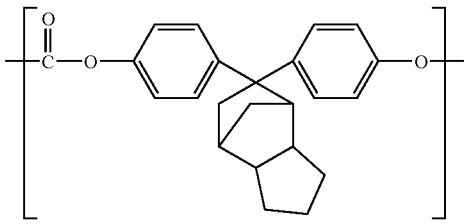 | 25,000 | 229 |

-continued

| | Polyester | Average Molecular Weight (Mn) | Tg (° C.) |
|---|---|---|---|
| 6 | 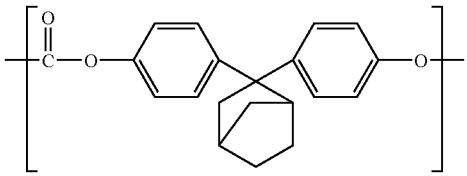 | 32,000 | 222 |

<<The Present Invention; Preparations of Coating Solution for Barrier Layer-9 and -10>>

Preparations of coating solution for barrier layer-9 and -10 were conducted in the similar manner to that of coating solution for barrier layer-2 expect that using either one of the mixtures of cellulose acetate butylate (CAB171-15S, Eastman Chemicals Ltd.) and poly(glycidyl methacrylate) (two kinds of 50/50 and 25/75) instead of poly(vinyl alcohol) used in the preparation of coating solution for barrier layer-2.

<<Preparations of Photothermographic Material-76 to -85>>

Photothermographic materials-76 to -85 were prepared by simultaneous double coating of the coating solution for image forming layer-61, the coating solution for the surface protective layer-1 and either one of the coating solution for barrier layer-1 to -10 using a dual knife coater, on a reverse surface to the back layer of the support coated with the back layer. The coating of image forming layer was executed so that the coating amount of mol reduced fatty acid of silver salt of fatty acid and fatty acid becomes 17 mmol/m$^2$, and that the surface protective layer had the dry film thickness of 1.5 μm, and that the barrier layer had the dry film thickness of 2.7 μm.

TABLE 8

| Photothermographic material | Composition of barrier layer | Coating solution for image forming layer | Coating amount of fatty acid (mmol/m$^2$) | Thickness of protective layer (μm) | Result of evaluation |
|---|---|---|---|---|---|
| 62 | — | 1 | 17 | 1.5 | C |
| 76 | Cellulose acetate butylate | 1 | 17 | 1.5 | A |
| 77 | Poly(vinyl alcohol) | 1 | 17 | 1.5 | A |
| 78 | polyester-1 | 1 | 17 | 1.5 | A |
| 79 | polyester-2 | 1 | 17 | 1.5 | A |
| 80 | polyester-3 | 1 | 17 | 1.5 | A |
| 81 | polyester-4 | 1 | 17 | 1.5 | A |
| 82 | polyester-5 | 1 | 17 | 1.5 | A |
| 83 | polyester-6 | 1 | 17 | 1.5 | A |
| 84 | Cellulose acetate butylate/ poly(glycizyl methacrylate) = 50/50 | 1 | 17 | 1.5 | A |
| 85 | Cellulose acetate butylate/ poly(glycizyl methacrylate) = 25/75 | 1 | 17 | 1.5 | A |

The results of the evaluation performed similarly to Example 7 are shown in Table 8. It is obvious from Table 8 that a barrier layer, which comprises a specific component, makes the density of the image more uniform, and the results were excellent.

Example 10

<<Preparation of Silver Salt of Fatty Acid-16>>

Preparation of silver salt of fatty acid-16 was conducted in the similar manner to the preparation of silver salt of fatty acid-15 except that using fatty acid comprising 80 mol % of behenic acid, 15 mol % of arachidic acid, 5 mol % of stearic acid instead of the fatty acid used in the preparation of silver salt of fatty acid-15.

<<Preparation of Redispersion of Organic Silver Salt-16>>

Preparation of redispersion of organic silver salt-16 was conducted in a similar manner to the preparation of redispersion of organic silver salt-15 except that using silver salt of fatty acid-16 instead of using silver salt of fatty acid-15.

<<Preparation of Coating Solution for Image forming layer-62>>

Preparation of coating solution for image forming layer-62 was conducted in the similar manner to that of coating solution for image forming layer-61 except that using redispersion of organic silver salt-16 instead of using redispersion of organic silver salt-15.

<<Preparation of Photothermographic Material-86>>

Photothermographic material-86 was prepared by simultaneous double coating of the coating solution for image forming layer-62 and the coating solution for the surface protective layer-1 using a dual knife coater, on a reverse surface to the back layer of the support coated with the back layer. The coating of image forming layer was executed so that the coating amount of mole converted amount of silver salt of fatty acid and fatty acid becomes 17 mmol/m$^2$, and that the surface protective layer had the dry film thickness of 1.5 μm.

TABLE 9

| Photothermographic material | Coating solution for image forming layer | Content of behenic acid (mol %) | Coating amount of fatty acid (mmol/m$^2$) | Thickness of protective layer (μm) | Result of evaluation |
|---|---|---|---|---|---|
| 62 | 1 | 40 | 17 | 1.5 | C |
| 86 | 2 | 80 | 17 | 1.5 | B |

Evaluations were performed similar to Example 7. As shown in Table 9, in case the photothermographic material having silver salt of fatty acid which contains more than 50% of silver behenate is used, the developed image was excellent in an uniform density.

Example 11

1. Preparation and Coating of Coating Solution for Undercoat Layer

Preparation and coating of coating solution for undercoat layer were conducted similar to Example 6.

2. Preparation and Coating of Coating Solution for Back Layer

Preparation and coating of coating solution for back layer were conducted similar to Example 6.

3. Preparation of Image Forming Layer, Intermediate Layer and Surface Protective Layer 3-1. Preparation of Materials for Coating (Silver Halide Emulsion)

Mixed emulsion A for coating solution was prepared in the similar manner to Example 6, preparing three kinds of silver halide emulsion and mixing them similar to Example 6.

(Preparation of Dispersion of Silver Salt of Fatty Acid C)

87.6 kg of behenic acid (Henkel Co., trade name: Edenor C22-85R), 423 L of distilled water, 49.2 L of an aqueous NaOH solution at the concentration of 5 mol/L, 120 L of t-butyl alcohol were admixed, and subjected to a reaction with stirring at 75° C. for one hour to give a solution A of a sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution A of a sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution A of a sodium behenate was thereafter started, and during 14 minutes and 15 seconds following the completion of adding the aqueous silver nitrate solution, the added material was restricted to the solution A of a sodium behenate alone. The temperature inside of the reaction vessel was then set to be 30° C., and the temperature outside was controlled so that the liquid temperature could be kept constant. In addition, the temperature of a pipeline for the addition system of the solution A of a sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution A of a sodium behenate was added and the position at which the aqueous silver nitrate solution was added were arranged symmetrically with a shaft for stirring located at a center. Moreover, both of the positions were adjusted to avoid contact with the reaction liquid.

After completing the addition of the solution A of a sodium behenate, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of the fatty acids was thus obtained. The resulting solid matters were stored as a wet cake without drying.

When the shape of the resulting particles of the silver behenate was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

(Preparation of Dispersion of Reducing Agent)

Preparation of dispersion of reducing agent was conducted similar to Example 6.

(Preparation of Dispersion of Hydrogen bonding Compound)

Preparation of dispersion of hydrogen bonding compound was conducted similar to Example 6.

(Preparations of Dispersion of Development Accerelator and Solid Particle Dispersion of Color-tone-Adjusting Agent)

These were done similar to Example 6.

(Preparation of Polyhalogen Compound)

It was done similar to Example 6.

(Preparation of Solution of Phthalazine Compound-1)

It was done similar to Example 6.

(Preparation of Aqueous Solution of Mercapto Compound-1)

It was done similar to Example 6.

(Preparation of Pigment-1 Dispersion)

It was done similar to Example 6.

(Preparation of SBR Latex Solution)

It was done similar to Example 6.

3-2. Preparation of Coating Solution (Preparation of Coating Solution for Image Forming Layer)

The dispersion C of the silver salt of fatty acid obtained as described above in an amount of 1000 g, 135 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 153 g of the reducing agent-2 dispersion, 55 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution were serially added. The coating solution for the image forming layer prepared by adding 140 g of the silver halide mixed emulsion A thereto followed by thorough mixing just prior to the coating was fed directly to a coating die.

(Preparation of Coating Solution for Intermediate Layer)

Preparation of coating solution for intermediate layer was conducted in the similar manner to the preparation of coating solution for intermediate layer in Example 6.

(Preparation of Coating Solution for First Layer of Surface Protective Layer-1)

Preparation of coating solution for first layer of surface protective layer-1 was conducted similar to the preparation of coating solution for first layer of surface protective layer-1 in Example 6.

(Preparation of Coating Solution for First Layer of Surface Protective Layer-2)

Preparation of coating solution for first layer of surface protective layer-2 was conducted similar to the preparation of coating solution for first layer of surface protective layer-2 in Example 6.

3-2. Preparation of Photothermographic Material-87

Reverse surface of the back surface was subjected to simultaneous overlaying coating by a slide bead coating method in order of the image forming layer, intermediate layer, first layer of the surface protective layer and second layer of the surface protective layer starting from the undercoated face, and thus a sample of the photothermographic material was produced. The coating of image forming layer was executed so that the coating amount of mole converted total amount of silver salt of fatty acid and fatty acid becomes 13 mmol/m$^2$, and that the total dry film thickness of the first layer of surface protective layer and the second layer of surface protective layer becomes 3.0 μm.

The coating amount of each compound for the image forming layer (g/m$^2$) is as follows.

| | |
|---|---|
| Silver salt of fatty acid | shown in Table 10 |
| Pigment (C. I. Pigment Blue 60) | 0.036 |
| Polyhalogen compound-1 | 0.14 |
| Polyhalogen compound-2 | 0.28 |
| Phthalazine compound-1 | 0.18 |
| SBR latex | 9.43 |
| Reducing agent-2 | 0.77 |
| Hydrogen bonding compound-1 | 0.28 |
| Development accelerator-1 | 0.019 |
| Development accelerator-2 | 0.016 |
| Color-tone-adjusting agent-1 | 0.006 |
| Mercapto compound-2 | 0.003 |
| Silver halide (on the basis of Ag content) | 0.13 |

Conditions for coating and drying were performed similar to Example 6.

4. Evaluation of Photographic Performance

1) Preparation

Preparation and packaging materials employed were similar to those in Example 1.

2) Exposure and Development of Photothermographic Materials

Exposure and thermal development (14 seconds in total with 3 panel heaters set to be 107° C.-121° C.-121° C.) were performed with a laser imager (equipped with 660 nm semiconductor laser having the maximum output of 50 mW (IIIB)) described in Japanese Patent Application No. 2002-088832 and Japanese Patent Application No. 2002-091114. Evaluation of thus resulting images was carried out with a densitometer. Line speed in this process was 28.6 mm/sec.

The samples were cut in a half-cut size and exposed uniformly to give the density of 1.2, and 5000 sheets of the samples were processed continuously using aforementioned processor, similar to Example 7.

3) Evaluation of Photographic Performance

Evaluation of photographic performance was carried out in a similar manner to Example 7. The results are shown in Table 10.

TABLE 10

| Photothermographic material | Coating amount of fatty acid (mmol/m$^2$) | Thickness of protective layer (μm) | Result of evaluation |
|---|---|---|---|
| 87 | 13 | 3.0 | B |

As shown in Table 10, it is obvious that in case the sample is prepared by coating solution with water solvent, the photothermographic material having coating amount of mole converted fatty acid of 5 mmol/m$^2$ to 18 mmol/m$^2$ was excellent in an uniform density, even that photothermographic material was processed by a processor which exposing section and developing section is near.

Example 12

(Preparation of PET Support)

1) Film Manufacturing

It was done similar to Example 6.

2) Surface Corona Discharge Treatment

It was done similar to Example 6.

3) Undercoating

It was done similar to Example 6.

(Back Layer)

1) Preparation of Coating Solution for Back Layer

It was done similar to Example 6.

2) Coating of Back Layer

It was done similar to Example 6.

(Image Forming Layer, Intermediate Layer and Surface Protective Layer)

1. Preparation of Materials for Coating

1) Silver Halide Emulsion (Silver Halide Emulsion)

Mixed emulsion A for coating solution was prepared in the similar manner to Example 6, preparing three kinds of silver halide emulsion and mixing them similar to Example 6.

2) Preparation of Dispersion of Silver Salt of Fatty Acid

Preparation of dispersion of silver salt of fatty acid C was conducted similar to Example 11.

3) Preparation of Reducing Agent Dispersion

It was done similar to Example 6.

4) Preparation of Dispersion of Hydrogen Bonding Compound

It was done similar to Example 6.

5) Preparations of Dispersion of Development Accelerator and Solid Particle Dispersion of Color-Tone-Adjusting Agent These were done similar to Example 6.

6) Preparation of Polyhalogen Compound

It was done similar to Example 6.

7) Preparation of Solution of Phthalazine Compound-1

It was done similar to Example 6.

8) Preparation of Aqueous Solution of Mercapto Compound-1

It was done similar to Example 6.

9) Preparation of Solution of Benzotriazole Compound-1

20 g of Benzotriazole Compound-1 (1-1) was dissolved to 1980 g of methanol to obtain 1.0% by weight solution.

10) Preparation of Pigment-1 Dispersion

It was done similar to Example 6.

11) Preparation of SBR Latex Solution

It was done similar to Example 6.

12) Preparation of Dispersion of Thermal Solvent

To 10 kg of a thermal solvent (stearic amide (melting point of 100° C.)) and 16 kg of a 10% by weight aqueous solution of modified polyvinyl alcohol (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours and 30 minutes. Thereafter, 0.2 g of a benzoisothiazolinone sodium salt and water were added thereto, thereby adjusting the concentration of the thermal solvent to be 22% by weight to obtain a thermal solvent dispersion. Time period for dispersion was regulated so that the median diameter became 0.45 μm. Accordingly, particles of the thermal solvent included in thus resulting hot melt agent dispersion had a median diameter of 0.45 μm, and a maximum particle diameter of 1.4 μm or less. The resultant hot melt agent dispersion was subjected to filtration with a polypropylene filter having a pore size of 3.0 μm to remove foreign substances such as dust.

2. Preparation of Coating Solution

1) Preparation of Coating Solution for Image Forming Layer-64

The dispersion C of the silver salt of fatty acid in an amount of 1000 g, 135 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 153 g of the reducing agent-2 dispersion, 55 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, 8 mL of the mercapto compound-2 aqueous solution, 8 mL of benzotriazole compound-1 solution, and 76 g of themal solvent dispersion were serially added. The coating solution for the image forming layer prepared by adding 140 g of the silver halide mixed emulsion A thereto followed by thorough mixing just prior to the coating was fed directly to a coating die.

2) Preparation of Coating Solution for Intermediate Layer

Preparation of coating solution for intermediate layer was conducted in the similar manner to the preparation of coating solution for intermediate layer in Example 6.

3) Preparation of Coating Solution for First Layer of Surface Protective Layer-1

Preparation of coating solution for first layer of surface protective layer-1 was conducted similar to the preparation of coating solution for first layer of surface protective layer-1 in Example 6.

4) Preparation of Coating Solution for First Layer of Surface Protective Layer-2

Preparation of coating solution for first layer of surface protective layer-2 was conducted similar to the preparation of coating solution for first layer of surface protective layer-2 in Example 6.

3. Preparation of Photothermographic Material

Preparation of Photothermographic Material-101

Reverse surface of the back surface was subjected to simultaneous overlaying coating by a slide bead coating method in order of the image forming layer, intermediate layer, first layer of the surface protective layer and second layer of the surface protective layer starting from the undercoated face, and thus a sample of the photothermographic material was produced. At this moment, the coating solutions for image forming layer and for intermediate layer was set to be 31° C., the coating solution for the first layer of the protective layer was set to be 36° C., and the coating solution for the second layer of the protective layer was set to be 37° C.

The coating amount of each compound for the image forming layer (g/m$^2$) is as follows.

| | |
|---|---|
| Silver salt of fatty acid | 5.27 |
| Thermal solvent | 0.35 |
| Pigment (C. I. Pigment Blue 60) | 0.036 |
| Polyhalogen compound-1 | 0.14 |
| Polyhalogen compound-2 | 0.28 |
| Phthalazine compound-1 | 0.18 |
| SBR latex | 9.43 |
| Reducing agent-1 | 0.77 |
| Hydrogen bonding compound-1 | 0.28 |
| Development accelerator-1 | 0.019 |
| Development accelerator-2 | 0.016 |
| Color-tone-adjusting agent-1 | 0.006 |
| Mercapto compound-1 | 0.003 |
| Benzotriazole compound-1 | 0.0015 |
| Silver halide (on the basis of Ag content) | 0.13 |

Conditions for coating and drying were performed similar to Example 6.

4. Evaluation of Photographic Performance (Preparation)

Preparation and packaging materials employed were similar to those in Example 1.

(Exposure and Development of Photothermographic Materials)

Exposure and thermal development (14 seconds in total with 3 panel heaters set to be 107° C.-121° C.-121° C.) were performed with a laser imager (equipped with 660 nm semiconductor laser having the maximum output of 50 mW (IIIB)) described in Japanese Patent Application No. 2002-088832 and Japanese Patent Application No. 2002-091114.

Sample 101A was obtained to process the sample with the processor of which the distance between the thermal development heating section and development discharging section was set to be 80 cm, and the transportation speed was 2.86 cm/second. And Sample 101B was obtained to process the sample with the processor of which the distance between the thermal development heating section and development discharging section was set to be 50 cm, and the transportation speed was 2.13 cm/second. Both of these samples were discharged within 35 seconds after heating for thermal development was finished.

5. Results

According to both samples, the cooling time between the thermal development heating section and development discharging section was 35 seconds or less, the developed images were clear. From this result, the cooling time in the cooling section could be shortened, and it was planned to make the speed of the process per one sheet of photothermographic material more rapid and to reduce the size of the image recording apparatus.

Example 13

<<Preparations of Dispersion of Silver Salt of Fatty Acid D to F>>

Preparations of dispersion of silver salt of fatty acid D to F were conducted in the similar manner to that of dispersion of silver salt of fatty acid C except that using fatty acids (behenic acid, stearic acid, lignoceric acid and arachidic acid) with a ratio presented in Table 11 instead of using behenic acid (Henkel Co.).

TABLE 11

| Silver salt of | Fatty acid constitution | | | |
|---|---|---|---|---|
| fatty acid dispersion | behenic acid | lignoceric acid | arachidic acid | stearic acid |
| D | 96 | 2 | 2 | 0 |
| E | 75 | 5 | 10 | 10 |
| F | 40 | 5 | 25 | 30 |
| G | 15 | 5 | 40 | 40 |

<<Preparation of Reducing Agent Dispersion>>

Preparation of reducing agent dispersion was conducted similar to Example 12 except that using reducing agent shown in Table 12 instead of the reducing agent used in Table 12.

<<Preparation of Dispersion of Development Accelerator>>

Preparation of dispersion of development accelerator was conducted similar to Example 12 except that using development accelerator shown in Table 12 instead of the development accelerator used in Table 12.

<<Preparation of Thermal Solvent Dispersion>>

Preparation of thermal solvent dispersion was conducted similar to Example 12 except that using thermal solvent shown in Table 12 instead of the thermal solvent used in Table 12.

<<Preparations of Coating Solution for Image Forming Layer-65 to -77>>

Preparations of coating solution for image forming layer-65 to -77 were conducted in the similar manner to the preparation of coating solution for image forming layer-64, changing dispersion of silver salt of fatty acid, reducing agent dispersion, dispersion of development accelerator and thermal solvent dispersion to those ones shown in Table 12.

<<Preparations of Photothermographic Material-102 to -114>>

Preparations of photothermographic material-102 to -114 were conducted in the similar manner to the preparation of photothermographic material-101, except that using coating solution for image forming layer-65 to -77 instead of coating solution for image forming layer-64 used in the preparation of photothermographic material-101.

(Exposure and Development of Photothermographic Materials)

Exposure and thermal development (14 seconds in total with 3 panel heaters set to be 107° C.-121° C.-121° C.) were performed with a laser imager (equipped with 660 nm semiconductor laser having the maximum output of 50 mW (IIIB)) described in Japanese Patent Application No. 2002-088832 and Japanese Patent Application No. 2002-091114. The exposure value was detected to make the image density of 1.0 by a thermal development of 14 seconds. The exposure was performed with that exposure value, followed by a thermal development of 16 seconds, and the optical density of the image was measured. The distance between the thermal development heating section and development discharging section was 57 cm, and the transportation speed at this space was 2.86 cm/second. And the time (cooling time) at this space was 23.9 seconds.

(Evaluation of Photographic Properties)

The photothermographic materials described above were evaluated as follows.

1) Evaluation of Unevenness of Image Density

The samples cut in the half-cut size (43 cm in length×35 cm in width) was exposed to give uniform images and 5 sheets of them were developed continuously. The density of the center of the sheet was measured by a densitometer. Among the 5 sheets, the difference between the highest and the lowest value in the density is defined as ΔD. The smaller ΔD is, the more preferably it is, because it means that the stable image is given.

2) Evaluation of Fog

Evaluation of the unexposed part of photosensitive material was carried out with Macbeth TD904 densitometer (visible density). Results of the measurement were evaluated for the minimal density, Dmin (fog).

TABLE 12

| Photothermographic material | Content of silver behenate (mol %) | Reducing agent | Development accelerator | Thermal solvent | Density at development time of 14 sec | Density at development time of 16 sec | Fog (Dmin) | Density difference (ΔD) |
|---|---|---|---|---|---|---|---|---|
| 102 | 96 | R-4 | A-1/A-8 | — | 1.0 | 1.26 | 0.20 | 0.16 |
| 103 | 75 | R-4 | A-1/A-8 | — | 1.0 | 1.25 | 0.22 | 0.16 |
| 104 | 40 | R-4 | A-1/A-8 | — | 1.0 | 1.27 | 0.26 | 0.20 |
| 105 | 15 | R-4 | A-1/A-8 | — | 1.0 | 1.28 | 0.30 | 0.27 |
| 106 | 96 | R-3 | A-1/A-8 | — | 1.0 | 1.1 | 0.22 | 0.10 |
| 107 | 96 | R-18 | A-1/A-8 | — | 1.0 | 1.07 | 0.21 | 0.05 |
| 108 | 96 | R-5 | A-1/A-8 | — | 1.0 | 1.05 | 0.20 | 0.09 |
| 109 | 96 | R-6 | A-1/A-8 | — | 1.0 | 1.12 | 0.23 | 0.08 |
| 110 | 96 | R-4 | — | — | 1.0 | 1.28 | 0.22 | 0.16 |
| 111 | 96 | R-4 | A-1 | — | 1.0 | 1.25 | 0.20 | 0.18 |
| 112 | 96 | R-4 | A-8 | — | 1.0 | 1.26 | 0.21 | 0.16 |
| 113 | 96 | R-4 | A-1/A-8 | stearic amide | 1.0 | 1.11 | 0.24 | 0.11 |
| 114 | 96 | R-4 | A-1/A-8 | Salicyl anilide | 1.0 | 1.16 | 0.24 | 0.12 |

As shown in Table 12, it was possible to output the image in the image forming method where the cooling time is 35 seconds or less, and further, a stable output image was obtained by using photothermographic material which gives the image density 1.0 to 1.3 (in the condition that exposure was carried out with the exposure value to make the image density of 1.0 by a thermal development of 14 seconds, and thermal developed for 16 seconds). Especially, a stable output image was obtained by using organic silver salt containing 30 mol % to 100 mol % silver behenate, adding development accelerator and using reducing agent described by general formula (R) (especially the reducing agent where the $R^{11}$ and $R^{11'}$ in the formula each independently represent an secondary or tertiary alkyl group having 3 to 15 carbon atoms).

Example 14

<<Preparation of Benzotriazole Compound-2 Aqueous Solution>>

Preparation of benzotrazole compound-2 solution was conducted in the similar manner to the preparation of benzotriazole compound-1 aqueous solution in Example 12, except using benzotriazole compound-2 (2-2) instead of using benzotriazole compound-1.

<<Preparations of Coating Solution for Image Forming Layer-78 to -80>>

Preparations of coating solution for image forming layer-78 to -80 were conducted in the similar manner to the preparation of coating solution for image forming layer-64 except that changing mercapto compound and benzotriazole compound to the compounds shown in Table 13.

<<Preparations of Photothermographic Material-115 to -117>>

Preparations of photothermographic material-115 to -117 were conducted in the similar manner to the preparation of photothermographic material-101 except that using above-mentioned coating solution for image forming layer-78 to -80 instead of using coating solution for image forming layer-64.

Evaluations of above-mentioned photothermographic material-115 to -117 were carried out similar to Example 13.

TABLE 13

| Photothermographic material | Mercapto compound | Benzotriazole compound | Density at development time of 14 sec | Density at development time of 16 sec | Fog | Density difference (ΔD) |
|---|---|---|---|---|---|---|
| 101 | −1 | −1 | 1.0 | 1.26 | 0.20 | 0.16 |
| 115 | — | −1 | 1.0 | 1.28 | 0.44 | 0.18 |
| 116 | −1 | — | 1.0 | 1.28 | 0.32 | 0.20 |
| 117 | −1 | −2 | 1.0 | 1.25 | 0.17 | 0.15 |

As shown in Table 13, the fog value was lowered by adding mercapto compound and benzotriazole compound even though the cooling time was short like 35 seconds or less.

Example 15

<<Preparation of Phthalazine Compound Solution>>

Preparation of phthalazine compound solution was conducted similar to preparation of phthalazine compound-1 solution in Example 12 except that adding phthalazine compound-1 to adjust the concentration of the solvent to the concentration shown in Table 14.

<Preparations of Coating Solution for Image Forming Layer-81 to -83>>

Preparations of coating solution for image forming layer-81 to -83 were conducted in the similar manner to the preparation of coating solution for image forming layer-64 except that changing the application amount of phthalazine compound as shown in Table 14.

<<Preparations of Photothermographic Material-118 to -120>>

Preparations of photothermographic material-118 to -120 were conducted in the similar manner to the preparation of photothermographic material-101 except that using above-mentioned coating solution for image forming layer-81 to -83 instead of using coating solution for image forming layer-64.

Evaluations of above-mentioned photothermographic material-118 to -120 were carried out similar to Example 12.

TABLE 14

| Photothermographic material | Phthalazine compound | Addition amount of phthalazine compound | Density at development time 14 sec | Density at development time 16 sec | fog | Density difference ΔD |
|---|---|---|---|---|---|---|
| 101 | −1 | 0.18 | 1.0 | 1.26 | 0.20 | 0.16 |
| 118 | −1 | 0.14 | 1.0 | 1.29 | 0.21 | 0.27 |
| 119 | −1 | 0.16 | 1.0 | 1.26 | 0.20 | 0.16 |
| 120 | −1 | 0.2 | 1.0 | 1.2 | 0.22 | 0.10 |

As shown in Table 14, the developed image was more stable and the density between the photothermographic materials was uniform by adding the amount of phthalazine compound even though the cooling time was short like 35 seconds or less.

Example 16

(Preparation of PET Support)

1) Film Manufacturing

It was done similar to Example 6.

2) Surface Corona Discharge Treatment

It was done similar to Example 6.

3) Undercoating

It was done similar to Example 6.

(Back Layer)

4) Preparation of Coating Solution for Back Layer

It was done similar to Example 6.

5) Coating of Back Layer

It was done similar to Example 6.

(Image Forming Layer, Intermediate Layer and Surface Protective Layer)

1. Preparations of Materials for Coating

1) Silver Halide Emulsion (Mixed Emulsion A for Coating Solution)

Mixed emulsion A for coating solution was prepared in the similar manner to Example 6, preparing three kinds of silver halide emulsion and mixing them similar to Example 6.

(Mixed Emulsion B for Coating Solution)

<<Preparation of Silver Halide Emulsion-4>>

Preparation of silver halide emulsion-4 was conducted in the similar manner to the preparation of silver halide emulsion-1 except that changing spectral sensitization dye A and spectral sensitization dye B to spectral sensitization dye-4 in the same amount of the total mol amount of spectral sensitization dye A and spectral sensitization dye B.

<<Preparation of Silver Halide Emulsion-5>>

Preparation of silver halide emulsion-5 was conducted in the similar manner to the preparation of silver halide emulsion-2 except that changing spectral sensitization dye A and spectral sensitization dye B to spectral sensitization dye-4 in the same amount of the total mol amount of spectral sensitization dye A and spectral sensitization dye B.

<<Preparation of Silver Halide Emulsion-6>>

Preparation of silver halide emulsion-6 was conducted in the similar manner to the preparation of silver halide emulsion-3 except that changing spectral sensitization dye A and spectral sensitization dye B to spectral sensitization dye-4 in the same amount of the total mol amount of spectral sensitization dye A and spectral sensitization dye B.

<<Preparation of Mixed Emulsion B for Coating Solution>>

The silver halide emulsion 4 at 70% by weight, the silver halide emulsion 5 at 15% by weight and the silver halide emulsion 6 at 15% by weight were dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution, and 1-(3-methylureidophenyl)-5-mercaptotetrazole was added to give 0.34 g per 1 kg of the mixed emulsion for a coating solution. The obtained mixed silver halide emulsion B had maximum photosensitive wavelength of 810 nm.

2) Preparation of Dispersion of Silver Salt of Fatty Acid (Preparation of Dispersion of Silver Salt of Fatty Acid B)

Preparation of dispersion of silver salt of fatty acid B was conducted similar to Example 6.

(Preparation of Dispersion of Silver Salt of Fatty Acid C)

Preparation of dispersion of silver salt of fatty acid C was conducted similar to Example 11.

3) Preparation of Reducing Agent Dispersion

It was done similar to Example 6.

4) Preparation of Dispersion of Hydrogen Bonding Compound

It was done similar to Example 6.

4) Preparations of Dispersion of Development Accelerator and Solid Particle Dispersion of Color-Tone-Adjusting Agent These were done similar to Example 6.

6) Preparation of Polyhalogen Compound

It was done similar to Example 6.

7) Preparation of Solution of Phthalazine Compound-1

It was done similar to Example 6.

8) Preparation of Aqueous Solution of Mercapto Compound-1

It was done similar to Example 6.

9) Preparation of Solution of Benzotriazole Compound-1

20 g of Benzotriazole Compound-1 (1-1) was dissolved to 1980 g of methanol to obtain 1.0% by weight solution.

10) Preparation of Pigment-1 Dispersion

It was done similar to Example 6.

11) Preparation of SBR Latex Solution

It was done similar to Example 6.

2. Preparation of Coating Solution

1) Preparation of Coating Solution for Image Forming Layer-84

The dispersion C of the silver salt of fatty acid similar to Example 11 in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 mL of the mercapto compound-1 aqueous solution and 27 mL of the mercapto compound-2 aqueous solution were serially added. The coating solution for the image forming layer prepared by adding 118 g of the silver halide mixed emulsion A thereto followed by thorough mixing just prior to the coating was fed directly to a coating die.

Viscosity of the coating solution for the image forming layer was measured with a B type viscometer from Tokyo Keiki, and was revealed to be 25 [mPa·s] at 40° C. (No. 1 rotor, 60 rpm).

Viscosity of the coating solution at 38° C. when it was measured using RheoStress RS150 manufactured by Haake was 32, 35, 33, 26, and 17 [mPa·s], respectively, at the shearing rate of 0.1, 1, 10, 100, 1000 [1/second].

The amount of zirconium in the coating solution was 0.32 mg per one g of silver.

2) Preparation of Coating Solution for Image Forming Layer-85

The dispersion B of the silver salt of fatty acid similar to Example 6 in an amount of 1000 g, 135 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 153 g of the reducing agent-2 dispersion, 55 g of the hydrogen bonding compound-1 dispersion, 4.8 g of the development accelerator-1 dispersion, 5.2 g of the development accelerator-2 dispersion, 2.1 g of color-tone-adjusting agent-1 dispersion and 8 mL of the mercapto compound-2 aqueous solution were serially added. The coating solution for the image forming layer prepared by adding 140 g of the silver halide mixed emulsion A thereto followed by thorough mixing just prior to the coating was fed directly to a coating die.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 43, 41, 28, and 20 [mPa·s], respectively, at the shearing rate of 0.1, 1, 10, 100, 1000 [1/second].

The amount of zirconium in the coating solution was 0.30 mg per one g of silver.

3) Preparation of Coating Solution for Image Forming Layer-86

Preparation of coating solution for image forming layer-36 was conducted in the similar manner to the preparation of coating solution for image forming layer-84 except that using mixed silver halide emulsion B instead of mixed silver halide emulsion A.

4) Preparation of Coating Solution for Image Forming Layer-87

Preparation of coating solution for image forming layer-87 was conducted in the similar manner to the preparation of coating solution for image forming layer-85 except that using mixed silver halide emulsion B instead of mixed silver halide emulsion A.

5) Preparation of Coating Solution for Intermediate Layer

Preparation of coating solution for intermediate layer was conducted in the similar manner to the preparation of coating solution for intermediate layer in Example 6.

6) Preparation of Coating Solution for First Layer of Surface Protective Layer-1

Preparation of coating solution for first layer of surface protective layer-1 was conducted similar to the preparation of coating solution for first layer of surface protective layer-1 in Example 6.

7) Preparation of Coating Solution for First Layer of Surface Protective Layer-2

Preparation of coating solution for first layer of surface protective layer-2 was conducted similar to the preparation of coating solution for first layer of surface protective layer-2 in Example 6.

3. Preparation of Photothermographic Material

1) Preparation of Photothermographic Material-121

Reverse surface of the back surface was subjected to simultaneous overlaying coating by a slide bead coating method in order of the image forming layer using coating solution for image forming layer-84, intermediate layer, first layer of the surface protective layer and second layer of the surface protective layer starting from the undercoated face, and thus the photothermographic material-121 was produced. At this moment, the coating solutions for image forming layer and for intermediate layer was set to be 31° C., the coating solution for the first layer of the protective layer was set to be 36° C., and the coating solution for the second layer of the protective layer was set to be 37° C.

The coating amount of each compound for the image forming layer (g/m$^2$) is as follows.

| | |
|---|---|
| Silver salt of fatty acid C | 5.42 |
| Pigment (C. I. Pigment Blue 60) | 0.036 |
| Polyhalogen compound-1 | 0.12 |
| Polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Mercapto compound-1 | 0.002 |
| Mercapto compound-2 | 0.012 |
| Silver halide (on the basis of Ag content) | 0.10 |

Conditions for coating and drying were performed similar to Example 6.

The matness of the prepared photothermographic material was 550 seconds on the image forming layer side and 130 seconds on the back layer side in Beck smoothness. The pH of the surface of image forming layer side was 6.0.

2) Preparation of Photothermographic Material-122

Preparation of photothermographic material-122 was conducted similar to photothermographic material-121 except that changing coating solution for image forming layer-84 to coating solution for image forming layer-85.

The coating amount of each compound for the image forming layer (g/m$^2$) is as follows.

| | |
|---|---|
| Silver salt of fatty acid B | 5.27 |
| Pigment (C. I. Pigment Blue 60) | 0.036 |
| Polyhalogen compound-1 | 0.14 |

-continued

| | |
|---|---|
| Polyhalogen compound-2 | 0.28 |
| Phthalazine compound-1 | 0.18 |
| SBR latex | 9.43 |
| Reducing agent-2 | 0.77 |
| Hydrogen bonding compound-1 | 0.28 |
| Development accelerator-1 | 0.019 |
| Development accelerator-2 | 0.021 |
| Color-tone-adjusting agent-1 | 0.006 |
| Mercapto compound-2 | 0.03 |

Silver halide (on the basis of Ag content)0.13

3) Preparation of Photothermographic Material-123

Preparation of photothermographic material-123 was conducted similar to photothermographic material-121 except that changing coating solution for image forming layer-84 to coating solution for image forming layer-86.

4) Preparation of Photothermographic Material-124

Preparation of photothermographic material-124 was conducted similar to photothermographic material-121 except that changing coating solution for image forming layer-84 to coating solution for image forming layer-87.

4. Evaluation of Photographic Performance

1) Preparation

Preparation and packaging materials employed were similar to those in Example 1.

2) Exposure and Development of Photothermographic Materials

Photothermographic material-121 was exposed and thermal developed (24 seconds in total with 3 panel heaters set to be 112° C.-119° C.-121° C.) with a laser imager (equipped with 660 nm semiconductor laser having the maximum output of 50 mW (IIIB)) using an image recording apparatus shown in FIG. 3. The thermal development was performed by setting the distance between the laser exposing section and the insert portion of the thermal developing section to the length described in Table 15, by changing the length of the guide plate 32.

Photothermographic material-122 was exposed and thermal developed (14 seconds in total with 3 panel heaters set to be 112° C.-119° C.-121° C.) with a laser imager (equipped with 660 nm semiconductor laser having the maximum output of 50 mW (IIIB)), similar to photothermographic material-121. The thermal development was performed by setting the distance between the laser exposing section and the insert portion of the thermal developing section to the length described in Table 15, by changing the length of the guide plate 32.

Photothermographic material-123 was exposed and thermal developed (24 seconds in total with 3 panel heaters set to be 112° C.-119° C.-121° C.) with a laser imager (equipped with 810 nm semiconductor laser having the maximum output of 50 mW (IIIB)). The thermal development was performed by setting the distance between the laser exposing section and the insert portion of the thermal developing section to the length described in Table 15, by changing the length of the guide plate 32.

Photothermographic material-124 was exposed and thermal developed (14 seconds in total with 3 panel heaters set to be 112° C.-119° C.-121° C.) with a laser imager (equipped with 810 nm semiconductor laser having the maximum output of 50 mW (IIIB)). The thermal development was performed by setting the distance between the laser exposing section and the insert portion of the thermal developing section to the length described in Table 15, by changing the length of the guide plate 32.

3) Evaluation of Photographic Properties when Processed 20 Sheets Continuously 20 sheets of either of the photothermographic material-121 to -124 were continuously exposed and thermal developed in the aforementioned condition. The sensitivities of each of first, fifth, 10th and 20th sheet were shown in Table 15.

Sensitivity (S)=the inverse of the exposure value giving the blackening density. The sensitivities are shown in relative value, detecting the sensitivity of the first sheet of to be 100.

As obviously shown in Table 15, in photothermographic material-123 and -124 the sensitivity decreased by increasing the amount of continuous processing when the distance of the laser exposing section and the thermal developing section is shortened. To obtain a stable sensitivity, it is necessary to have distance of 75 cm or more, preferably 100 cm or more, and that means it is difficult to plan a compact design of the apparatus. On the other side, photothermographic material-121 and -122 gave excellent results and the sensitivity variation was within 1% even in case the distance was 45 cm.

TABLE 15

| Test No. | Photothermographic material | Maximum sensitive wavelength | Exposure wavelength of semiconductor laser | Path length from scanning line by laser irradiation means to insert portion of thermal developing section (cm) | Sensitivity 1st | 5th | 10th | 15th | 20th |
|---|---|---|---|---|---|---|---|---|---|
| 1 | Photothermographic material-121 | 660 nm | 660 nm | 45 | 100 | 100 | 99 | 99 | 99 |
| 2 | Photothermographic material-121 | 660 nm | 660 nm | 55 | 100 | 100 | 100 | 100 | 100 |
| 3 | Photothermographic material-121 | 660 nm | 660 nm | 75 | 100 | 100 | 100 | 100 | 100 |
| 4 | Photothermographic material-121 | 660 nm | 660 nm | 100 | 100 | 100 | 100 | 100 | 100 |
| 5 | Photothermographic material-122 | 660 nm | 660 nm | 45 | 95 | 95 | 94 | 94 | 94 |
| 6 | Photothermographic material-122 | 660 nm | 660 nm | 55 | 95 | 95 | 95 | 95 | 95 |
| 7 | Photothermographic material-122 | 660 nm | 660 nm | 75 | 95 | 95 | 95 | 95 | 95 |

TABLE 15-continued

| Test No. | Photothermographic material | Maximum sensitive wavelength | Exposure wavelength of semiconductor laser | Path length from scanning line by laser irradiation means to insert portion of thermal developing section (cm) | Sensitivity 1st | 5th | 10th | 15th | 20th |
|---|---|---|---|---|---|---|---|---|---|
| 8 | Photothermographic material-122 | 660 nm | 660 nm | 100 | 95 | 95 | 95 | 95 | 95 |
| 9 | Photothermographic material-123 | 810 nm | 810 nm | 45 | 100 | 90 | 88 | 86 | 85 |
| 10 | Photothermographic material-123 | 810 nm | 810 nm | 55 | 100 | 98 | 97 | 96 | 95 |
| 11 | Photothermographic material-123 | 810 nm | 810 nm | 75 | 100 | 99 | 98 | 98 | 97 |
| 12 | Photothermographic material-123 | 810 nm | 810 nm | 100 | 100 | 100 | 100 | 100 | 99 |
| 13 | Photothermographic material-124 | 810 nm | 810 nm | 45 | 95 | 85 | 83 | 81 | 80 |
| 14 | Photothermographic material-124 | 810 nm | 810 nm | 55 | 95 | 93 | 92 | 91 | 90 |
| 15 | Photothermographic material-124 | 810 nm | 810 nm | 75 | 95 | 94 | 93 | 93 | 92 |
| 16 | Photothermographic material-124 | 810 nm | 810 nm | 100 | 95 | 95 | 95 | 95 | 94 |

What is claimed is:

1. An image forming method for a photothermographic material comprising, on at least one side of the support, at least a photosensitive silver halide, a non-photosensitive organic silver salt, a reducing agent and a binder, wherein the photothermographic material is a sheet material and has a gamma value of 2.0 to 4.0 at an optical density of 1.2 in a photographic characteristic curve, comprising:

imagewise exposing the photothermographic material to laser radiation: and developing the photothermographic material in a thermal developing device configured such that a distance between an exposing section and a developing section is not more than 50 cm and the photothermographic material begins to be developed at an exposed portion thereof while another portion is still being exposed.

2. The method of claim 1, wherein the photothermographic material is thermally developed while conveyed at a speed of not less than 23 mm/sec.

3. The method of claim 1, wherein the photosensitive silver halide includes at least two silver halide emulsions having different grain sizes.

4. The method of claim 1, wherein the non-photosensitive organic silver salt is prepared in the presence of the photosensitive silver halide.

5. The method of claim 1, wherein:

the photothermographic material has a maximum photosensitive wavelength of from 600 nm to less than 700 nm;

the exposing section of the thermal developing device has a laser irradiation means; and a distance between a scanning line of the laser irradiation means and an inserting portion of the thermal developing section is not more than 50 cm.

6. An image forming method for a photothermographic material comprising an image forming layer formed on at least one side of the support, the image forming layer comprising at least a photosensitive silver halide, a non-photosensitive organic silver salt, a reducing agent and a binder, wherein:

the non-photosensitive organic silver salt includes a silver salt of fatty acid; the photothermographic material has the silver salt of fatty acid at an application amount of 5 mmol/$m^2$ to 18 mmol/$m^2$, comprising:

imagewise exposing the photothermoaranhic material to laser radiation: and developing the photothermographic material in a thermal developing device configured such that a distance between an exposing section and a developing section is not more than 50 cm and the photothermographic material begins to be developed at an exposed portion thereof while another portion is still being exposed.

7. The method of claim 6, wherein:

the photothermographic material has a protective layer formed at the side of the support at which the image forming layer is formed and at a position farther away from the support than the image forming layer; and the protective layer includes a compound which chemically reacts with materials vaporized at the time of thermal development to form non-volatile materials as a trapping agent.

8. The method of claim 7, wherein the trapping agent of the vaporized materials is a compound having a —NH— bond.

9. The method of claim 6, wherein the photothermographic material has a barrier layer formed at the side of the support at which the image forming layer is formed and at a position farther away from the support than the image forming layer, the barrier layer preventing transmission of the material vaporized at the time of thermal development.

10. The method of claim 9, wherein the barrier layer includes at least one polymer selected from a group consisting of polyvinyl alcohol, polystyrene and a copolymer thereof, polyvinyl chloride, polyvinyl acetate and a copolymer thereof, water soluble polyester, water insoluble polyester, gelatin and a derivative thereof, and polyvinyl pyrrolidone.

11. The method of claim 9, wherein the barrier layer includes water insoluble polyester having a glass transition temperature of not less than 150° C. and a number average molecular weight of not less than 10,000.

12. The method of claim 9, wherein the barrier layer includes polyvinyl alcohol having a saponification rate of not less than 88%.

13. The method of claim 9, wherein the barrier layer includes polystyrene having at least two epoxy groups in a molecule thereof.

14. The method of claim 9, wherein the barrier layer includes one of polyacrylate and polymethacrylate.

15. The method of claim 9, wherein the barrier layer includes one of polyacrylate and polymethacrylate having at least two epoxy groups in a molecule thereof.

16. The method of claim 7, wherein the protective layer of the photothermographic material has a thickness of 1 μm to 5 μm.

17. The method of claim 9, wherein the barrier layer of the photothermographic material has a thickness of 1 μm to 5 μm.

18. The method of claim 6, wherein the silver salt of fatty acid contains silver behenate not less than 50 mol %.

* * * * *